US010835954B2

(12) United States Patent
Wagstaff et al.

(10) Patent No.: US 10,835,954 B2
(45) **Date of Patent: *Nov. 17, 2020**

(54) MIXING EDUCTOR NOZZLE AND FLOW CONTROL DEVICE

(71) Applicant: Novelis Inc., Atlanta, GA (US)

(72) Inventors: Samuel R. Wagstaff, Marietta, GA (US); Robert B. Wagstaff, Greenacres, WA (US)

(73) Assignee: Novelis Inc., Atlanta, GA (US)

( * ) Notice: Subject to any disclaimer, the term of this patent is extended or adjusted under 35 U.S.C. 154(b) by 64 days.

This patent is subject to a terminal disclaimer.

(21) Appl. No.: 16/149,567

(22) Filed: Oct. 2, 2018

(65) Prior Publication Data

US 2019/0030598 A1 Jan. 31, 2019

Related U.S. Application Data

(62) Division of application No. 14/719,100, filed on May 21, 2015, now Pat. No. 10,118,221.

(Continued)

(51) Int. Cl.
*B22D 37/00* (2006.01)
*B22D 11/18* (2006.01)

(Continued)

(52) U.S. Cl.
CPC ..... *B22D 37/00* (2013.01); *B22D 11/103* (2013.01); *B22D 11/18* (2013.01); *B22D 21/04* (2013.01);

(Continued)

(58) Field of Classification Search
CPC ..... B22D 11/103; B22D 11/18; B22D 21/04; B22D 27/02; B22D 37/00; B22D 41/507; B22D 46/00; C22C 21/00

(Continued)

(56) References Cited

U.S. PATENT DOCUMENTS 3,478,808 A 11/1969 Adams
3,517,726 A 6/1970 Mills et al.

(Continued)

FOREIGN PATENT DOCUMENTS

BY 10263 C1 2/2008
CN 1165719 11/1997

(Continued)

OTHER PUBLICATIONS

Database WPI, Week 201202, Thomson Scientific, London, AN 2011-Q74164, Dec. 22, 2011, 3 pages.

(Continued)

*Primary Examiner* — Jessee R Roe
*Assistant Examiner* — Michael Aboagye
(74) *Attorney, Agent, or Firm* — Kilpatrick Townsend & Stockton LLP

(57) ABSTRACT

Techniques are disclosed for reducing macrosegregation in cast metals. Techniques include providing an eductor nozzle capable of increasing mixing in the fluid region of an ingot being cast. Techniques also include providing a non-contacting flow control device to mix and/or apply pressure to the molten metal that is being introduced to the mold cavity. The non-contacting flow control device can be permanent magnet or electromagnet based. Techniques additionally can include actively cooling and mixing the molten metal before introducing the molten metal to the mold cavity.

20 Claims, 31 Drawing Sheets

Related U.S. Application Data

(60) Provisional application No. 62/001,124, filed on May 21, 2014, provisional application No. 62/060,672, filed on Oct. 7, 2014.

(51) Int. Cl.

| | |
|---|---|
| ***B22D 41/50*** | (2006.01) |
| ***B22D 46/00*** | (2006.01) |
| ***B22D 21/04*** | (2006.01) |
| ***B22D 27/02*** | (2006.01) |
| ***C22C 21/00*** | (2006.01) |
| ***B22D 11/103*** | (2006.01) |

(52) U.S. Cl.
CPC ..... *B22D 27/02* (2013.01); *B22D 41/507* (2013.01); *B22D 46/00* (2013.01); *C22C 21/00* (2013.01)

(58) Field of Classification Search
USPC ..... 266/236, 208; 222/590; 164/502, 504, 164/418, 466, 468, 459, 419, 461
See application file for complete search history.

(56) References Cited

U.S. PATENT DOCUMENTS

| | | | |
|---|---|---|---|
| 3,669,181 | A | 6/1972 | Schrewe |
| 4,014,379 | A | 3/1977 | Getselev |
| 4,273,180 | A | 6/1981 | Tertishnikov et al. |
| 4,495,982 | A | 1/1985 | Kaneko et al. |
| 4,527,616 | A | 7/1985 | Kaneko et al. |
| 4,530,404 | A | 7/1985 | Vives |
| 4,567,936 | A | 2/1986 | Binczewski |
| 4,601,327 | A | 7/1986 | Kaneko et al. |
| 4,615,376 | A | 10/1986 | Mori et al. |
| 4,637,453 | A | 1/1987 | Ayata et al. |
| 4,671,335 | A | 6/1987 | Ayata et al. |
| 4,671,499 | A | 6/1987 | Ishiyama et al. |
| RE32,529 | E | 10/1987 | Vives |
| 4,724,896 | A | 2/1988 | Rose et al. |
| 4,828,015 | A | 5/1989 | Takeuchi et al. |
| 4,933,005 | A | 6/1990 | Mulcahy et al. |
| 5,027,885 | A | 7/1991 | Fujisake et al. |
| 5,227,078 | A | 7/1993 | Augustine, III |
| 5,244,032 | A | 9/1993 | Banksden et al. |
| 5,307,863 | A | 5/1994 | Kubota et al. |
| 6,021,842 | A | 2/2000 | Bulhoff et al. |
| 6,110,416 | A | 8/2000 | Chapellier et al. |
| 6,315,029 | B1 | 11/2001 | Cho et al. |
| 6,598,662 | B2 | 7/2003 | Kato et al. |
| 7,201,211 | B2 | 4/2007 | Kunstreich |
| 7,669,638 | B2 | 3/2010 | Kollberg et al. |
| 7,736,586 | B2 | 6/2010 | Takahashi |
| 7,815,846 | B2 | 10/2010 | Takahashi |
| 8,158,055 | B2 | 4/2012 | Takahashi |
| 8,210,239 | B2 | 7/2012 | Toh et al. |
| 8,336,603 | B2 | 12/2012 | Bischoff et al. |
| 8,418,749 | B2 | 4/2013 | Toh et al. |
| 9,593,884 | B2 | 3/2017 | Takahashi |
| 2004/0100002 | A1 | 5/2004 | Richaud |
| 2004/0244939 | A1 | 12/2004 | Marti et al. |
| 2007/0074846 | A1 | 4/2007 | Sommerhofer et al. |
| 2010/0025003 | A1 | 2/2010 | Wagstaff et al. |
| 2010/0263822 | A1 | 10/2010 | Kunstreich |
| 2011/0097701 | A1 | 4/2011 | Hickey |
| 2011/0248432 | A1 | 10/2011 | Takahashi |
| 2012/0104669 | A1 | 5/2012 | Takahashi |
| 2012/0160063 | A1* | 6/2012 | Odenthal ..... C22B 9/055 75/510 |
| 2013/0228045 | A1 | 9/2013 | Fan et al. |
| 2015/0190863 | A1 | 7/2015 | Tang et al. |

FOREIGN PATENT DOCUMENTS

| | | | |
|---|---|---|---|
| CN | 1400929 | | 3/2003 |
| CN | 1863625 | | 11/2006 |
| CN | 101166594 | | 4/2008 |
| CN | 102437710 | | 5/2012 |
| EP | 0093068 | | 11/1983 |
| EP | 0916434 | | 5/1999 |
| EP | 1059990 | | 12/2000 |
| EP | 2329899 | | 6/2011 |
| EP | 2045553 | | 4/2012 |
| EP | 2329899 | B1 | 9/2012 |
| EP | 2594351 | | 5/2013 |
| GB | 1097186 | A | 12/1967 |
| GB | 2079195 | | 1/1982 |
| JP | 47034119 | | 12/1972 |
| JP | S57130745 | A | 8/1982 |
| JP | 58196151 | | 11/1983 |
| JP | 60234754 | | 11/1985 |
| JP | 61108457 | | 5/1986 |
| JP | S61162254 | A | 7/1986 |
| JP | 63253854 | | 10/1988 |
| JP | 1266950 | | 10/1989 |
| JP | 1299747 | | 12/1989 |
| JP | 241747 | | 2/1990 |
| JP | 3198974 | | 8/1991 |
| JP | 6238413 | | 8/1994 |
| JP | 7148561 | | 6/1995 |
| JP | 7290214 | | 11/1995 |
| JP | 11123511 | | 5/1999 |
| JP | H11277219 | A | 10/1999 |
| JP | 2000317580 | A | 11/2000 |
| JP | 2001501132 | | 1/2001 |
| JP | 2010179363 | | 8/2010 |
| KR | 20030036247 | | 5/2003 |
| KR | 20050064417 | A | 6/2005 |
| KR | 20090056141 | A | 6/2009 |
| KR | 101286192 | | 7/2013 |
| KR | 1020130099331 | | 9/2013 |
| RU | 2216427 | C1 | 11/2003 |
| SU | 1731413 | A1 | 5/1992 |
| WO | 9814292 | | 4/1998 |
| WO | 9816001 | | 4/1998 |
| WO | 9830346 | | 7/1998 |
| WO | 2011097701 | | 8/2011 |
| WO | 2011158477 | | 12/2011 |
| WO | 2012008574 | | 1/2012 |
| WO | 2013069314 | | 5/2013 |

OTHER PUBLICATIONS

U.S. Appl. No. 14/719,100, Corrected Notice of Allowability dated Aug. 13, 2018, 3 pages.
U.S. Appl. No. 14/719,100, Corrected Notice of Allowability dated Oct. 11, 2018, 3 pages.
U.S. Appl. No. 14/719,100, Final Office Action dated Nov. 13, 2017, 10 pages.
U.S. Appl. No. 14/719,100, Non-Final Office Action dated Apr. 27, 2017, 14 pages.
U.S. Appl. No. 14/719,100, Notice of Allowance dated Mar. 7, 2018, 8 pages.
U.S. Appl. No. 14/719,100, Notice of Allowance dated Jul. 3, 2018, 9 pages.
Adachi et al., Application of Electromagnetic Stirrers, Continuous Casting, Iron and Steel Society of AIME, vol. 3, 1984, pp. 79-85.
Birat et al., Electromagnetic Stirring on Billet, Bloom and Slab Continuous Casters State of the Art in 1982, Continuous Casting, Iron and Steel Society of AIME, vol. 3, 1984, pp. 21-34.
Brazilian Application No. 112016026772-9, Office Action dated Aug. 20, 2019, 4 pages.
Canadian Application No. 2,949,837, Office Action dated Dec. 18, 2017, 4 pages.
Canadian Application No. 2,949,837, Office Action dated Jun. 18, 2019, 4 pages.
Canadian Application No. 2,949,837, Office Action dated Oct. 9, 2018, 5 pages.

(56) References Cited

OTHER PUBLICATIONS

Chinese Application No. 201580028282.9, Office Action dated Jul. 11, 2018, 15 pages (6 pages for the original document and 9 pages for the English translation).
Chinese Application No. 201580028282.9, Office Action dated Mar. 19, 2019, 15 pages (6 pages for the original document and 9 pages for the English translation).
Chinese Application No. 201580028282.9, Office Action dated Nov. 17, 2017, 22 pages (9 pages for the original document and 13 pages for the English translation).
Davis et al., Wrinkling Phenomena to Explain Vertical Fold Defects in DC-Cast Al-Mg4.5, Essential Readings in Light Metals, vol. 3, 2016, pp. 1-16.
European Application No. 15731424.6, Office Action dated Dec. 17, 2018, 4 pages.
Halldin, The Electro-Magnetic (EMBR) for Slab Continuous Casting Machines, Continuous Casting, Iron and Steel Society of AIME, vol. 3, 1984, pp. 111-114.
Japanese Application No. 2016-568671, Notice of Decision to Grant dated Apr. 23, 2019, 3 pages.
Japanese Application No. 2016-568671, Office Action dated Aug. 7, 2018, 13 pages (7 pages for the original document and 6 pages for the English translation).
Japanese Application No. 2016-568671, Office Action dated Nov. 14, 2017, 7 pages.
Japanese Application No. 2016-568671, Office Action dated Apr. 2, 2019, 4 pages (2 pages for the original document and 2 pages for the English translation).
Korean Application No. 10-2016-7035766, Notice of Decision to Grant dated May 15, 2018, 2 pages (1 page for the original document and 1 page for the English translation).
Korean Application No. 10-2016-7035766, Office Action dated Sep. 14, 2017, 24 pages (12 pages for the original document and 12 pages for the English translation).
Korean Application No. 10-2016-7035766, Office Action dated Mar. 19, 2018, 9 pages (5 pages for the original document and 4 pages for the English translation).
Moreau et al., MHD Flow in an Insulating Rectangular Duct Under a Non-Uniform Magnetic Field, PMC Physics B, Available Online at: https://pmcphysb.biomedcentral.com/track/pdf/10.1186/1754-0429-3-3, vol. 3. No. 3, 2010, pp. 1-43.
International Application No. PCT/US2015/032029, International Preliminary Report on Patentability dated Dec. 1, 2016, 10 pages.
International Application No. PCT/US2015/032029, International Search Report and Written Opinion dated Jan. 5, 2016, 15 pages.
International Application No. PCT/US2015/032029, Invitation to Pay Additional Fees and, Where Applicable, Protest Fee dated Sep. 23, 2015, 4 pages.
Trindade et al., Numerical Model of Electromagnetic Stirring for Continuous Casting Billets, IEEE Transactions on Magnetics, vol. 38, Issue 6, Nov. 2002, pp. 3658-3660.
Tzavaras, Solidification Control by Electromagnetic Stirring-State of the Art, Continuous Casting, Iron and Steel Society of AIME, vol. 3, 1984, pp. 47-67.
Wagstaff et al., Minimization of Macrosegregation in DC Cast Ingots Through Jet Processing, Author's final manuscript, Metallurgical and Materials Transactions, Mar. 29, 2016, 15 pages.
Wagstaff et al., Minimization of Macrosegregation in DC Cast Ingots Through Jet Processing, Metallurgical and Materials Transactions B, vol. 47B. No. 5, Oct. 2016, pp. 3132-3138.
Wagstaff et al., Modification of Macrosegregation Patterns in Rolling Slab Ingots by Bulk Grain Migration, Department of Materials Science and Engineering, Light Metals 2016, 2016, pp. 715-719.
Wagstaff et al., Shear Induced Grain Refinement of a Continuously Cast Ingot, Light Metals, The Minerals, Metals & Materials Series, 2017, pp. 1005-1012.
Yamahiro et al., Continuous Casting of Pseudo-Rimmed Steel by In-Mold Electromagnetic Stirrer, Steelmaking Conference Proceedings, AIME, Apr. 1983, pp. 115-126.
Zhang et al., Flow Transport and Inclusion Motion in Steel Continuous-Casting Mold under Submerged Entry Nozzle Clogging Condition, Metallurgical and Materials Transactions B, vol. 39, Issue 4, Aug. 2008, pp. 534-550.
Zhang et al., Inclusions in Continuous Casting of Steel, XXIV National Steelmaking Symposium, Morelia, Nov. 26-28, 2003, pp. 138-183.
Canadian Patent Application No. 2,949,837 , "Office Action", dated Mar. 9, 2020, 3 pages.
U.S. Appl. No. 16/149,429 , "Non-Final Office Action", dated Mar. 19, 2020, 17 pages.
Begum et al., "3-D CFD Simulation of a Vertical Direct Chill Slab Caster With a Submerged Nozzle and A Porous Filter Delivery System", International Journal of Heat and Mass Transfer, vol. 73, Jun. 2014, pp. 42-58.
Korean Patent Application No. 10-2018-7023635 , "Office Action", Jun. 9, 2020, 11 pages.
Lavers et al., "Application of Electromagnetic Forces to Reduce Tundish Nozzle Clogging", Applied Mathematical Modelling, vol. 28, No. 1, Jan. 2004, pp. 29-45.
Application No. JP2019-092101, Office Action, dated Aug. 4, 2020, 11 pages.
Canadian Patent Application No. 2,949,837, Office Action, dated Sep. 23, 2020, 3 pages.

* cited by examiner

Average Dendrite Arm Spacing: 72.63 microns

Average Dendrite Arm Spacing: 80.37 microns

Average Dendrite Arm Spacing: 49.85 microns

Average Dendrite Arm Spacing: 37.86 microns

Average Dendrite Arm Spacing: 30.52 microns

Average Dendrite Arm Spacing: 27.76 microns

Average Dendrite Arm Spacing: 39.46 microns

Average Dendrite Arm Spacing: 29.09 microns

Average Dendrite Arm Spacing: 20.22 microns

Average Dendrite Arm Spacing: 18.88 microns

Average Grain Size:
1118.01 microns

Average Grain Size:
1353.38 microns

Average Grain Size:
714.29 microns

Average Grain Size:
642.85 microns

Average Grain Size:
514.29 microns

Average Grain Size:
362.17 microns

Average Grain Size:
428.57 microns

Average Grain Size:
342.85 microns

Average Grain Size:
321.42 microns

Average Grain Size:
306.12 microns

MIXING EDUCTOR NOZZLE AND FLOW CONTROL DEVICE

CROSS REFERENCE TO RELATED APPLICATIONS

The present application is a divisional of U.S. patent application Ser. No. 14/719,100 filed on May 21, 2015, issued as U.S. Pat. No. 10,118,221, which claims the benefit of U.S. Provisional Application No. 62/001,124 filed on May 21, 2014, entitled "MAGNETIC BASED STIRRING OF MOLTEN ALUMINUM," and U.S. Provisional Application No. 62/060,672 filed on Oct. 7, 2014, entitled "MAGNET-BASED OXIDE CONTROL," all of which are hereby incorporated by reference in their entirety.

TECHNICAL FIELD

The present disclosure relates to metal casting generally and more specifically to controlling delivery of molten metal to a mold cavity.

BACKGROUND

In the metal casting process, molten metal is passed into a mold cavity. For some types of casting, mold cavities with false, or moving, bottoms are used. As the molten metal enters the mold cavity, generally from the top, the false bottom lowers at a rate related to the rate of flow of the molten metal. The molten metal that has solidified near the sides can be used to retain the liquid and partially liquid metal in the molten sump. Metal can be 99.9% solid (e.g., fully solid), 100% liquid, and anywhere in between. The molten sump can take on a V-shape, U-shape, or W-shape, due to the increasing thickness of the solid regions as the molten metal cools. The interface between the solid and liquid metal is sometimes referred to as the solidifying interface.

As the molten metal in the molten sump becomes between approximately 0% solid to approximately 5% solid, nucleation can occur and small crystals of the metal can form. These small (e.g., nanometer size) crystals begin to form as nuclei, which continue to grow in preferential directions to form dendrites as the molten metal cools. As the molten metal cools to the dendrite coherency point (e.g., 632° C. in 5182 aluminum used for beverage can ends), the dendrites begin to stick together. Depending on the temperature and percent solids of the molten metal, crystals can include or trap different particles (e.g., intermetallics or hydrogen bubbles), such as particles of $FeAl_6$, $Mg_2Si$, $FeAl_3$, $Al_8Mg_5$, and gross $H_2$, in certain alloys of aluminum.

Additionally, when crystals near the edge of the molten sump contract during cooling, yet-to-solidify liquid compositions or particles can be rejected or squeezed out of the crystals (e.g., out from between the dendrites of the crystals) and can accumulate in the molten sump, resulting in an uneven balance of particles or less soluble alloying elements within the ingot. These particles can move independently of the solidifying interface and have a variety of densities and buoyant responses, resulting in preferential settling within the solidifying ingot. Additionally, there can be stagnation regions within the sump.

The inhomogenous distribution of alloying elements on the length scale of a grain is known as microsegregation. In contrast, macrosegregation is the chemical inhomogeneity over a length scale larger than a grain (or number of grains), such as up to the length scale of meters.

Macrosegregation can result in poor material properties, which may be particularly undesirable for certain uses, such as aerospace frames. Unlike microsegregation, macrosegregation cannot be fixed through homogenization. While some macrosegregation intermetallics may be broken up during rolling (e.g., $FeAl_6$, FeAlSi), some intermetallics take on shapes that are resistant to being broken up during rolling (e.g., $FeAl_3$).

While the addition of new, hot liquid metal into the metal sump creates some mixing, additional mixing can be desired. Some current mixing approaches in the public domain do not work well as they increase oxide generation.

Further, successful mixing of aluminum includes challenges not present in other metals. Contact mixing of aluminum can result in the formation of structure-weakening oxides and inclusions that result in an undesirable cast product. Non-contact mixing of aluminum can be difficult due to the thermal, magnetic, and electrical conductivity characteristics of the aluminum.

In some casting techniques, molten metal flows into a distribution bag near the top of the mold cavity, which directs the molten metal along the top surface of the molten sump. The use of a distribution bag will result in temperature stratification in the molten sump, as well as deposition of grains in the center of the ingot where the flow velocity and potential energy are lowest.

Some approaches to resolving alloy segregation in the metal casting process can result in very thin ingots, which provide less metal cast per ingot due to limitations in ingot length, contaminated ingots due to mechanical barriers and dams, and undesired fluctuations in casting speed. Attempts at increasing mixing efficiency are often made by increasing casting speed, thereby increasing mass flow rate. However, doing so can lead to hot cracks, hot tears, bleed outs, and other problems. It can also be desirable to mitigate alloy macrosegregation.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
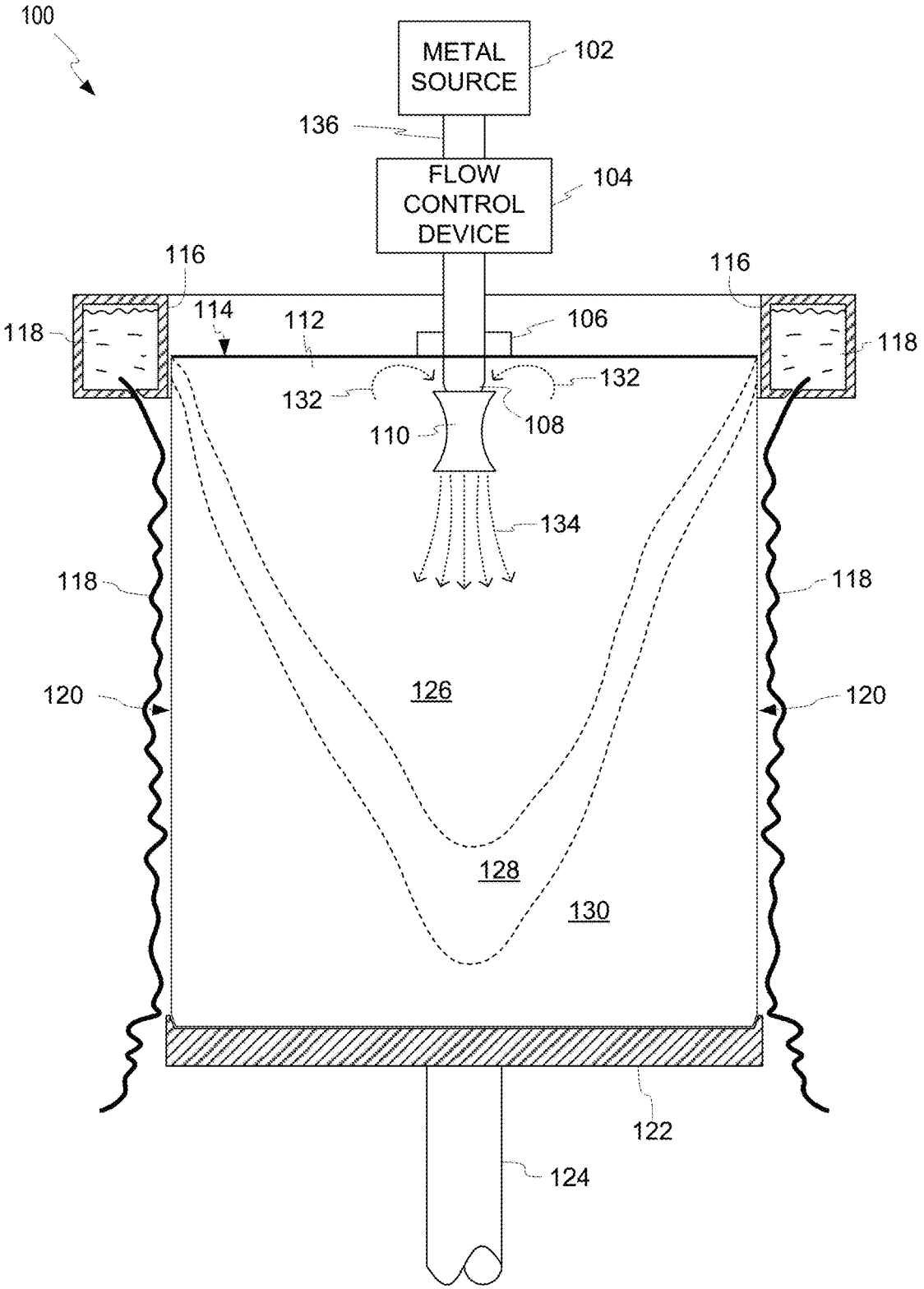
FIG. 1 is a partial cross-sectional view of a metal casting system according to certain aspects of the present disclosure.

Certain aspects and features of the present disclosure relate to techniques for reducing macrosegregation in cast metals. Techniques include providing an eductor nozzle capable of increasing mixing in the fluid region of an ingot being cast. Techniques also include providing a non-contacting flow control device to mix and/or apply pressure to the molten metal that is being introduced to the mold cavity. The non-contacting flow control device can be permanent magnet or electromagnet based. Techniques can additionally include actively cooling and mixing the molten metal before introducing the molten metal to the mold cavity.

During a casting process, molten metal can enter a mold cavity through a feed tube. A secondary nozzle can be operably coupled to the existing feed tube of a casting system or built into a new feed tube of a new casting system. The secondary nozzle provides flow multiplication and homogenization of the molten sump temperature and composition gradients. The secondary nozzle increases the mixing efficiency without increasing the mass flow rate into the mold cavity. In other words, the secondary nozzle increases mixing efficiency without requiring an increase in the rate with which new metal is being introduced to the molten sump (e.g., the liquid metal in the mold cavity or other receptacle).

The secondary nozzle can be known as an eductor nozzle. The secondary nozzle uses the flow from the feed tube to induce flow within the molten sump. A Venturi effect can create a low pressure zone that draws metal from the molten sump into the secondary nozzle and out through the exit of the secondary nozzle. This increased flow volume can aid in homogenization of the molten sump temperature and composition gradients, resulting in reduced macrosegregation. The eductor nozzle is not limited by casting speed in terms of its volumetric flow rate.

The secondary nozzle generates a higher volume jet of molten metal than would normally be possible without the secondary nozzle. The improved jet prevents the sedimentation of grains rich in primary phase aluminum. The improved jet homogenizes temperature gradients, which leads to more uniform solidification through the cross section of the ingot.

A secondary nozzle can also be used in filter or furnace applications. The secondary nozzle can be used in a primary melting furnace to provide thermal homogenization by mixing the molten metal. The secondary nozzle can be used in degassers to increase the mixing of argon and chlorine gas in the molten metal (e.g., aluminum). The secondary nozzle can be especially useful when increased homogenization is desired and where flow volume is typically a limiting factor of operation. The secondary nozzle can provide for a more homogenous ingot in terms of grain structure and chemical composition, which can allow for a higher quality product and less downstream processing time. The secondary nozzle can provide homogenization of temperature or a solute within the molten metal.

The secondary nozzle can be a high-chromium steel alloy. The secondary nozzle can be made of a ceramic material or refractory material or any other material suitable for immersion in the molten sump.

Also disclosed are mechanisms for introducing pressure in molten metal in a feed tube. Casting techniques generally operate by using gravity to urge molten metal through a feed tube. The length of the feed tube, with hydrostatic pressure, determines the primary nozzle diameter at the bottom of the feed tube, which determines the jet and mixing efficiency of the molten metal exiting the feed tube. Mixing efficiency can be improved without changing the overall mass flow rate of the molten metal by providing a more pressurized flow through a primary nozzle having a smaller diameter. Mixing efficiency can also be improved by introducing pressure to the molten metal while in the feed tube. The control of pressure (e.g., positive or negative) applied to the molten metal in the feed tube can be used to control the rate of flow of the metal in the feed tube. Controlling the flow rate without the need to introduce a movable pin into the feed tube can be very advantageous.

While the techniques described herein can be used with any metal, the techniques can be especially useful with aluminum. In some instances the combination of a pumping mechanism and an eductor nozzle can be especially useful for increasing the mixing efficiency in cast aluminum. A pumping mechanism can be necessary in some cases to provide sufficient additional pressure, above the natural hydrostatic pressure of the molten aluminum, such that a jet of molten aluminum entering the molten sump can generate sufficient primary and/or secondary flows within the molten sump. Such hydrostatic pressure may not be present in other metals, such as steel. Primary flows are the flows induced by the new metal itself entering the sump. Secondary flows (or sympathetic flows) are the flows induced by the primary flows. For example, primary flows within the top portion (e.g., top half) of the molten sump can induce secondary flows in the bottom portion (e.g., bottom half) or other parts of the top portion of the sump.

One example of a mechanism to introduce pressure to molten metal in a feed tube is a permanent magnet flow control device that includes permanent magnets placed on rotors on sides of a feed tube. As the rotors spin, the rotating permanent magnets induce pressure waves in the molten metal in the feed spout. The feed tube can be shaped to increase the efficiency of the rotating magnets. The feed tube can be lofted to a thin cross-section near the rotors to allow the rotors to be placed closer together, while having the same overall cross-sectional area as the remainder of the feed tube. The magnets can be rotated in one direction to speed up the flow velocity, or rotated in an opposite direction to slow down the flow velocity.

Another example of a mechanism to introduce pressure to molten metal in a feed tube is an electromagnet driven screw flow control device that includes electromagnets placed around a feed tube fitted with a helical screw. The helical screw can be permanently incorporated into the feed tube or removably placed in the feed tube. The helical screw is fixed so that it does not rotate. Electromagnetic coils are placed around the feed tube and powered to induce magnetic fields in the molten metal, causing the molten metal to spin within the feed tube. The spinning action causes the molten metal to impact the inclined planes of the helical screw. Spinning the molten metal in a first direction can force the molten metal towards the bottom of the feed tube, increasing the overall flow rate of the molten metal within the feed tube. Spinning the molten metal in a reverse or opposite direction can force the molten metal up the feed tube, decreasing the overall flow rate of the molten metal within the feed tube. The electromagnetic coils can be coils from a three-phase stator. Other electromagnetic sources can be used. As one non-limiting example, permanent magnets can be used instead of electromagnets to induce rotational movement of the molten metal.

Another example of a mechanism to introduce pressure to molten metal in a feed tube is an electromagnetic linear induction flow control device that includes a linear induction motor positioned around a feed tube. The linear induction motor can be a three-phase linear induction motor. Activation of the coils of the linear induction motor can pressurize the molten metal to move up or down the feed tube. Flow control can be achieved by varying magnetic field and frequency.

Another example of a mechanism to introduce pressure to molten metal in a feed tube is an electromagnetic helical induction flow control device that includes electromagnetic coils surrounding a feed tube to generate electromagnetic fields within the molten metal of the feed tube. The electromagnetic fields can pressurize the molten metal to move upwards or downwards within the feed tube. The electromagnetic coils can be coils from a three-phase stator. Each coil can generate electromagnetic fields at different angles, resulting in the molten metal encountering magnetic fields of changing direction as the molten metal moves from the top to the bottom of the feed tube. As the molten metal moves down the feed tube, the rotational movement is induced in the molten metal, providing additional mixing in the feed tube. Each coil can be wrapped at the same angle (e.g., pitch) around the feed tube, but spaced apart. A different amplitude and frequency can be applied to each coil, 120° out of phase from one another. Variable pitch coils can be used.

Another example of a mechanism to introduce pressure to molten metal in a feed tube is a permanent magnet variable-pitch flow control device that includes permanent magnets positioned to rotate around a rotational axis parallel the longitudinal axis of the feed tube. Rotation of the magnets generates circumferential rotational movement of the molten metal. The pitch of the rotational axis of the permanent magnets can be adjusted to induce movement of the molten metal upwards or downwards within the feed tube. Varying the pitch of the rotational axis of the rotating magnets pressurizes the molten metal. Flow control is achieved through control of the pitch and rotational speed.

Yet another example of a mechanism to introduce pressure to molten metal in a feed tube is a centripetal downspout flow control device that includes any flow control device that generates circumferential motion (e.g., a permanent magnet based or electromagnet based flow control device). The centripetal downspout can be a feed tube that is shaped to either restrict flow velocity or increase flow velocity when the molten metal within the feed tube is accelerated centripetally. Alternatively, the centripetal downspout itself rotates to induce centripetal acceleration in the molten metal within the feed tube.

Another example of a mechanism to introduce pressure to molten metal in a feed tube is a direct current (DC) conduction flow control device that includes a feed tube having electrodes extending to the interior of the feed tube to contact the molten metal. The electrodes can be graphite electrodes or any other suitable high-temperature electrodes. A voltage can be applied across the electrodes to drive a current through the molten metal. A magnetic field generator can generate a magnetic field across the molten metal in a direction perpendicular to the direction of the current moving through the molten metal. The interaction between the moving current and the magnetic field generates force to pressurize the molten metal upwards or downwards within the feed tube according to the right hand rule (cross product of the magnetic and electric fields). In other instances, alternating current can be used, such as with alternating magnetic fields. Flow control can be achieved by adjusting the intensity, direction, or both, of the magnetic field, current, or both. Any shape feed tube can be used.

A multi-chamber feed tube can be used alone or in combination with a flow control device, such as one of the flow control devices described herein. The multi-chamber feed tube can have two, three, four, five, six, or more chambers. Each chamber can be individually driven by a flow control device to direct more or less flow to certain areas of the molten pool. The multi-chamber feed tube can be driven, as a whole, by a single flow control device. The multi-chamber feed tube can be driven so that its chambers release molten metal simultaneously or individually (e.g., first from the first chamber and then the second chamber). The multi-chamber feed tube can provide pulsed flow control to each chamber, causing molten metal to flow with increased or decreased pressure out of each chamber simultaneously or individually.

Another example of a mechanism to introduce pressure to molten metal in a feed tube is a Helmholtz Resonator flow control device that includes spinning permanent magnets or electromagnets to generate moving magnetic fields. The spinning permanent magnets or electromagnetics can generate oscillating magnetic fields that generate alternating force in the molten metal (e.g., by forcing metal upwards by one magnetic source and downwards by another magnetic source) to create oscillations. The oscillating field can be imposed on top of a stationary field. The oscillating pressure waves in the molten metal within the feed tube can propagate into the molten sump. The oscillating pressure waves in the molten metal can increase grain refinement. Oscillating pressure waves can cause forming crystals to break (e.g., at the ends of the crystals), which can provide additional nucleation sites. These additional nucleation sites can allow less grain refiner to be used in the molten metal, which is beneficial to the desired composition of the cast ingot. Furthermore, the additional nucleation sites can allow for the ingot to be cast faster and more reliably without as much risk of hot cracking. Sensors can be coupled to a controller to sense pressure fields inside the molten metal. The Helmholtz resonator can be swept through a range of frequencies until the most effective frequency (e.g., with the most constructive interference) occurs.

A semi-solid casting feed tube can be used with one or more of the various flow control devices described herein. The semi-solid casting feed tube includes a temperature regulating device to regulate the temperature of the metal flowing through the feed tube. The temperature regulating device can include cooling tubes (e.g., water-filled cooling tubes), like a cold crucible. The temperature regulating device can include an inductive heater or other heater. At least one flow control device can be used to generate constant shear force within the metal, allowing the metal to be cast at a certain fraction of solid. With a certain amount of the nucleation barrier overcome, casting is possible at higher speeds without mold change out. The viscosity of the metal within the feed tube can decrease as it is sheared. The force generated by the flow control device (e.g., electromagnet or permanent magnet flow control device) can overcome the latent heat of fusion. By extracting some of the heat from the molten metal in the feed tube, less heat needs to be extracted from the molten metal in the mold, which can allow for faster casting. As the metal exits the feed tube, the metal can be between approximately 2% and approximately 15% solid, or more particularly, between approximately 5% and approximately 10% solid. A closed loop controller can be used to control the stirring, heating, cooling, or any combination thereof. The fraction of solids can be measured by a thermistor, thermocouple, or other device at or near the exit of the feed tube. The temperature measuring device can be measured from the outside or inside of the feed tube. The temperature of the metal can be used to estimate the fraction of solids based on a phase diagram. Casting in this fashion can increase the ability of alloying elements to diffuse within small collections of crystals. Additionally, casting in this fashion can allow crystals being formed to ripen for a period of time before entering the molten sump. Ripening of solidifying crystals can include rounding the shape of the crystal such that they may be packed more closely together.

In some cases, the aforementioned nozzles and pumps can be used in combination with flow directors. A flow director can be a device submersible within the molten aluminum and positioned to direct flow in a particular fashion.

In some cases, it can be desirable to induce the formation of intermetallics of a particular size (e.g., large enough to induce recrystallization during hot rolling, but not large enough to cause failures). For example, in some cast aluminum, intermetallics having a size of less than 1 μm in equivalent diameter are not substantially beneficial; intermetallics having a size of greater than about 60 μm in equivalent diameter can be harmful and large enough to potentially cause failures in final gauge of a rolled sheet product after cold rolling. Thus, intermetallics having a size (in equivalent diameter) of about 1-60 μm, 5-60 μm, 10-60 μm, 20-60 μm, 30-60 μm, 40-60 μm, or 50-60 μm can be desirable. Non-contact induced molten metal flow can help distribute intermetallics around sufficiently so that these semi-large intermetallics are able to form more easily.

In some cases, it can be desirable to induce the formation of intermetallics that are easier to break apart during hot rolling. Intermetallics that can be easily broken up during rolling tend to occur more often with increased mixing or stirring, especially into the stagnation regions, such as the corners and center and/or bottom of the sump.

Due to the preferential settling of the crystals formed during solidification of the molten metal, a stagnation region of crystals can occur in the middle portion of the molten sump. The accumulation of these crystals in the stagnation region can cause problems in ingot formation. The stagnation region can achieve solid fractions of up to approximately 15% to approximately 20%, although other values outside of that range are possible. Without increased mixing using the techniques disclosed herein, the molten metal does not flow well into the stagnation region, and thus the crystals that may form in the stagnation region accumulate and are not mixed throughout the molten sump.

Additionally, as alloying elements are rejected from the crystals forming in the solidifying interface, they can accumulate in a low-lying stagnation region. Without increased mixing using the techniques disclosed herein, the molten metal does not flow well into the low-lying stagnation region, and thus the crystals and heavier particles within the low-lying stagnation region would not normally mix well throughout the molten sump.

Additionally, crystals from an upper stagnation region and a low-lying stagnation region can fall towards and collect near the bottom of the sump, forming a center hump of solid metal at the bottom of the transitional metal region. This center hump can result in undesirable properties in the cast metal (e.g., an undesirable concentration of alloying elements, intermetallics and/or an undesirably large grain structure). Without increased mixing using the techniques disclosed herein, the molten metal may not flow low enough to move around and mix up these crystals and particles that have accumulated near the bottom of the sump.

Increased mixing can be used to increase homogeneity within the molten sump and resultant ingot, such as by mixing crystals and heavy particles. Increased mixing can also move crystals and other particles around the molten sump, slowing the solidification rate and allowing alloying elements to diffuse throughout forming metal crystals. Additionally, the increased mixing can allow forming crystals to ripen faster and to ripen for longer (e.g., due to slowed solidification rate).

The techniques described herein can be used to induce sympathetic flow throughout a molten metal sump. Due to the shape of the molten metal sump and the properties of the molten metal, primary flow may not reach the entire depth of the molten sump in some circumstances. Sympathetic flow (e.g., flow induced by the primary flow), however, can be induced through proper direction and strength of primary flow, and can reach the stagnation regions of the molten sump (e.g., the bottom-middle of the molten sump).

Ingots cast with the techniques described herein may have a uniform grain size, unique grain size, intermetallic distribution along the exterior surface of the ingot, non-typical macrosegregation effect in the center of the ingot, increased homogeneity, or any combination thereof. Ingots cast using the techniques and systems described herein may have additional beneficial properties. A more uniform grain size and increased homogeneity can reduce or eliminate the need for grain refiners to be added to the molten metal. The techniques described herein can create increased mixing without cavitation and without increased oxide generation. Increased mixing can result in a thinner liquid-solid interface within the solidifying ingot. In an example, during the casting of an aluminum ingot, if the liquid-solid interface is approximately 4 millimeters in width, it may be reduced by up to 75% or more (to approximately 1 millimeter in width or less) when non-contacting molten flow inducers are used to stir the molten metal.

In some cases, the use of the techniques disclosed herein can decrease the average grain sizes in a resultant cast product and can induce relatively even grain size throughout the cast product. For example, an aluminum ingot cast using the techniques disclosed herein can have only grain sizes at or below approximately 280 μm, 300 μm, 320 μm, 340 μm, 360 μm, 380 μm, 400 μm, 420 μm, 440 μm, 460 μm, 480 μm, or 500 μm, 550 μm, 600 μm, 650 μm, or 700 μm. For example, an aluminum ingot cast using the techniques disclosed herein can have an average grain size at or below approximately 280 μm, 300 μm, 320 μm, 340 μm, 360 μm, 380 μm, 400 μm, 420 μm, 440 μm, 460 μm, 480 μm, 500 μm, 550 μm, 600 μm, 650 μm, or 700 μm. Relatively even grain size can include maximum standard deviations in grain size at or under 200, 175, 150, 125, 100, 90, 80, 70, 60, 50, 40, 30, 20 or smaller. For example, a product cast using the techniques disclosed herein can have a maximum standard deviation in grain size at or under 45.

In some cases, the use of the techniques disclosed herein can decrease the dendrite arm spacing (e.g., distance between adjacent dendrite branches of dendrites in crystalized metal) in the resultant cast product and can induce relatively even dendrite arm spacing throughout the cast product. For example, an aluminum ingot cast using the non-contacting molten flow inducers can have average dendrite arm spacing across the entire ingot of about 10 μm, 15 μm, 20 μm, 25 μm, 30 μm, 35 μm, 40 μm, 45 μm, or 50 μm. Relatively even dendrite arm spacing can include a maximum standard deviation of dendrite arm spacing at or under 16, 15, 14, 13, 12, 11, 10, 9, 8.5, 8, 7.5, 7, 6.5, 6, 5.5, 5 or smaller. For example, a cast product having average dendrite arm spacing (e.g., as measured at locations across the thickness of a cast ingot at a common cross section) of 28 μm, 39 μm, 29 μm, 20 μm, and 19 μm can have a maximum standard deviation of dendrite arm spacing of approximately 7.2. For example, a product cast using the techniques disclosed herein can have a maximum standard deviation of dendrite arm spacing at or under 7.5.

In some cases, the techniques described herein can allow for more precise control of macrosegregation (e.g., intermetallics and/or where the intermetallics collect). Increased control of intermetallics can allow for optimal grain structures to be produced in a cast product despite starting with molten material having content of alloying elements or higher recycled content, which would normally hinder the formation of optimal grain structures. For example, recycled aluminum can generally have a higher iron content than new or prime aluminum. The more recycled aluminum used in a cast, generally the higher the iron content, unless additional time-consuming and cost-intensive processing is done to dilute the iron content. With a higher iron content, it can sometimes be difficult to produce a desirable product (e.g., with small crystal sizes throughout and without undesirable intermetallic structures). However, increased control of intermetallics, such as using the techniques described herein, can enable the casting of desirable products, even with molten metal having high iron content, such as up to 100% recycled aluminum. The use of 100% recycled metals can be strongly desirable for environmental and other business needs.

In some cases, a plate-type nozzle can be used. The plate-type nozzle can be constructed of machineable ceramic, rather than relying on castable ceramics necessary for forming round nozzles. The nozzles made from machineable ceramic (or other materials) may be made from desirable materials that are less reactive with the aluminum and various alloys of aluminum. Thus, the machineable ceramic nozzles may require less frequent replacement than the castable ceramic nozzles. The plate-type nozzle design can enable the use of such machineable ceramics.

A plate-type nozzle design can include one or more plates of ceramic material or refractory material into which one or more passageways have been machined for the passage of molten metal. For example, a plate-type nozzle design can be a parallel plate nozzle consisting of two plates sandwiched together. One or both of the two plates sandwiched together can have a passageway machined therein through which the molten metal can flow. In some cases, molten metal pumps can be included in the plate-type nozzle design. For example, the plate-type nozzle can include permanent magnets to induce a static or moving magnetic field through the passageway and electrodes to deliver electrical charges through the molten metal within the passageway. Due to Fleming's law, a force (e.g., pumping force) can be induced in the molten metal as it passes the permanent magnets and electrodes. In some cases, a pumping mechanism included in the plate-type nozzle design can overcome pressure loss due to the increased turbulence of the non-round passageway. The increased turbulence within the non-round passageway can provide added mixing benefits of the molten metal before entering the molten sump. In some cases, the plate-type nozzle design includes an eductor. The eductor can be held in place by attachment points to the plate-type nozzle.

In some cases, the dimensions of the eductor nozzle can be selected given a desired casting speed and particular alloy. Knowing the casting speed and particular alloy, the average density of the molten metal and depth of the molten sump can be determined or estimated. These values can be used to determine the size of eductor nozzle necessary for generating an ideal amount of mixing at the bottom of the sump. The mixing at the bottom of the sump can occur due to sympathetic molten metal flow induced from the primary flow from the eductor nozzle.

If using an eductor nozzle and/or pumps, it can be desirable to not use any sort of skimmer or distribution bag that would hinder the primary flow or sympathetic flow within the molten sump.

One or more of the techniques described herein can be combined with the use of non-contacting flow inducers designed to induce flow on a molten sump after the molten metal has entered the molten sump. For example, a non-contacting flow inducer can include rotating permanent magnets placed above the surface of the molten sump. Other suitable flow inducers can be used. The combination of the techniques described herein with such flow inducers can provide for even better mixing and more control over grain size and/or intermetallic formation and distribution.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein are not necessarily drawn not to scale.

FIG. 1 is a partial cross-sectional view of a metal casting system 100 according to certain aspects of the present disclosure. A metal source 102, such as a tundish, can supply molten metal 126 down a feed tube 136. A skimmer 106 can be used around the feed tube 136 to help distribute the molten metal 126 and reduce generation of metal oxides at the upper surface 114 of the molten metal 126. A bottom block 122 may be lifted by a hydraulic cylinder 124 to meet the walls of the mold cavity 116. As molten metal begins to solidify within the mold, the bottom block 122 can be steadily lowered. The cast metal 112 can include sides 120 that have solidified, while molten metal 126 added to the cast can be used to continuously lengthen the cast metal 112. In some cases, the walls of the mold cavity 116 define a hollow space and may contain a coolant 118, such as water. The coolant 118 can exit as jets from the hollow space and flow down the sides 120 of the cast metal 112 to help solidify the cast metal 112. The ingot being cast can include solidified metal 130, transitional metal 128, and molten metal 126.

Molten metal 126 can exit the feed tube 136 at a primary nozzle 108 that is submerged in the molten metal 126. A secondary nozzle 110 can be located near the exit of the primary nozzle 108. The secondary nozzle 110 can be fixed adjacent the primary nozzle 108 or attached to the feed tube 136 or primary nozzle 108. The secondary nozzle 110 can use the flow of new metal from the metal source 102 to create a Venturi effect that generates inflow 132 of molten metal 126 into the secondary nozzle 110. The inflow 132 of molten metal 126 into the secondary nozzle 110 generates increased outflow 134 out of the secondary nozzle 110, as described in more detail below.

The feed tube 136 can additionally include a flow control device 104, non-limiting examples of which are described in more detail below. The flow control device can be positioned between the metal source 102 and the primary nozzle 108. The flow control device 104 can be a non-contact flow control device. The flow control device 104 can be a permanent magnet based or electromagnet based flow control device. The flow control device 104 can induce pressure waves in the molten metal 126 within the feed tube 136. The flow control device 104 can increase mixing within the feed tube 136, can increase the flow velocity of molten metal 126 exiting the feed tube 136, can decrease the flow velocity of molten metal 126 exiting the feed tube 136, or any combination thereof.

Figure 2:
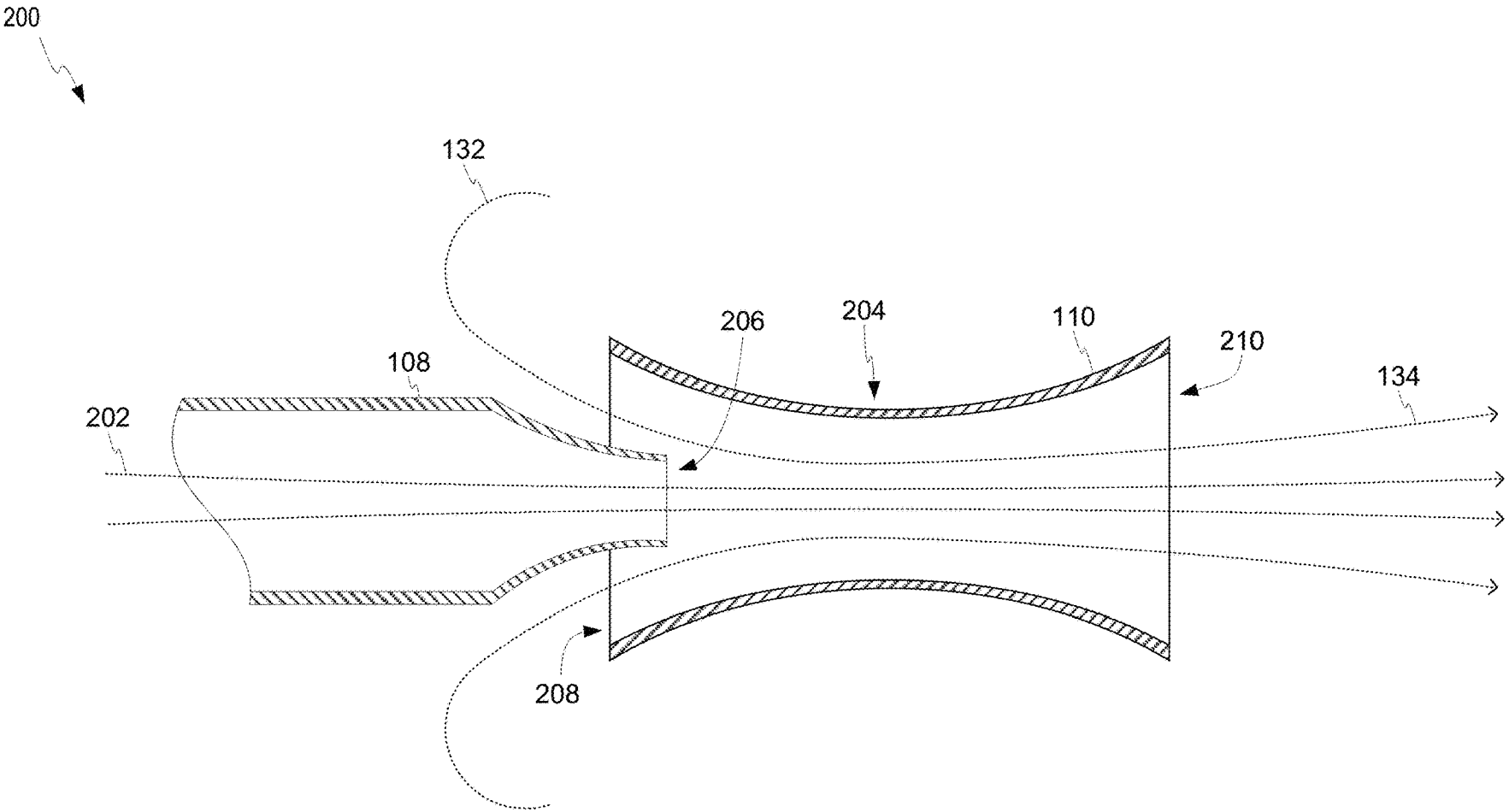
FIG. 2 is a cross-sectional depiction of an eductor nozzle assembly according to certain aspects of the present disclosure.

FIG. 2 is a cross-sectional depiction of an eductor nozzle assembly 200 according to certain aspects of the present disclosure. Eductor nozzle assembly 200 includes a primary nozzle 108 from a feed tube positioned adjacent a secondary nozzle 110. Both the primary nozzle 108 and the secondary nozzle 110 can be submerged within a molten sump (e.g., the molten metal already present in a mold cavity or other receptacle). The primary nozzle 108 includes an exit opening 206 through which a new metal flow 202 passes. The new metal flow 202 is the flow of molten metal that is not already part of the molten sump. As the new metal flow 202 exits the exit opening 206 of the primary nozzle 108, the new metal flow 202 passes through a restriction 204 in the secondary nozzle 110 and then out an exit opening 210 of the secondary nozzle 110. The new metal flow 202 passing through the restriction 204 creates a low pressure area that generates a Venturi effect, which causes existing metal (e.g., metal already in the molten sump) to pass into the secondary nozzle 110 through an inflow opening 208. The existing metal inflow 132 is the flow of existing metal into the inflow opening 208. The combined outflow 134 from the secondary nozzle 110 includes new metal from the new metal flow 202 and existing metal from the existing metal inflow 132. Using the secondary nozzle 110 thereby uses the energy of the new metal flow 202 to increase the mixing of the molten sump without requiring new metal to be added at an increased flow rate. The use of a secondary nozzle 110 can also allow the exit opening 206 of the primary nozzle 108 to be smaller in size while still obtaining the same amount, or more, mixing in the molten sump.

Figure 3:
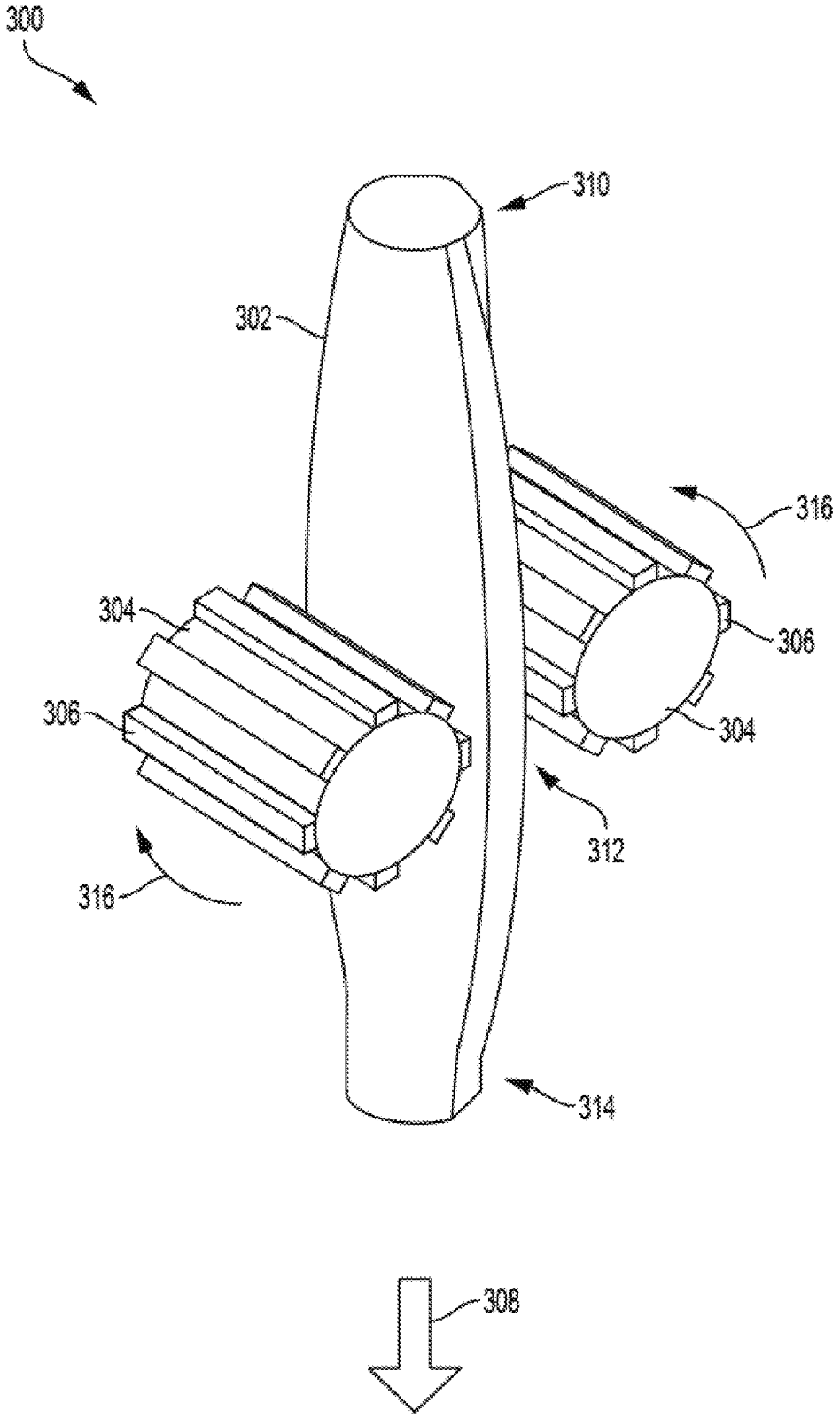
FIG. 3 is projection perspective view of a permanent magnet flow control device according to certain aspects of the present disclosure.

FIG. 3 is perspective view of a permanent magnet flow control device 300 according to certain aspects of the present disclosure. Permanent magnets 306 can be placed around a rotor 304. Any suitable number of permanent magnets 306 can be used such that when the rotor 304 is rotated, a changing magnetic field is generated adjacent the rotor 304. Two or more rotors 304 can be placed on opposite sides of a feed tube 302. The feed tube 302 can be any suitable shape. In a non-limiting example, the feed tube 302 has a lofted shape that corresponds to the shape of magnetic fields created by the permanent magnets 306. The lofted shape can move from a first circular cross section 310, to an area with a thin, rectangular cross section 312, to an area with a second circular cross section 314. The overall cross-sectional area of the first circular cross section 310, rectangular cross section 312, and second circular cross section 314 can be the same, but need not be. Rotation of the rotors 304 in a respective first direction 316 (where each rotor can rotate in a direction 316 opposite of the other rotor) can create changing magnetic fields through the feed tube 302, which can induce increased metal flow in flow direction 308 by generating pressure waves in the molten metal. Rotation of the rotors 304 in a direction opposite the first direction 316 can create changing magnetic fields through the feed tube 302, which can induce decreased metal flow in the flow direction 308 by generating pressure waves in the molten metal. The speed of the rotors 304 can be controlled to control the metal flow in flow direction 308. The distance of the rotors 304 from the feed tube 302 can additionally be controlled to control the metal flow in flow direction 308.

Figure 4:
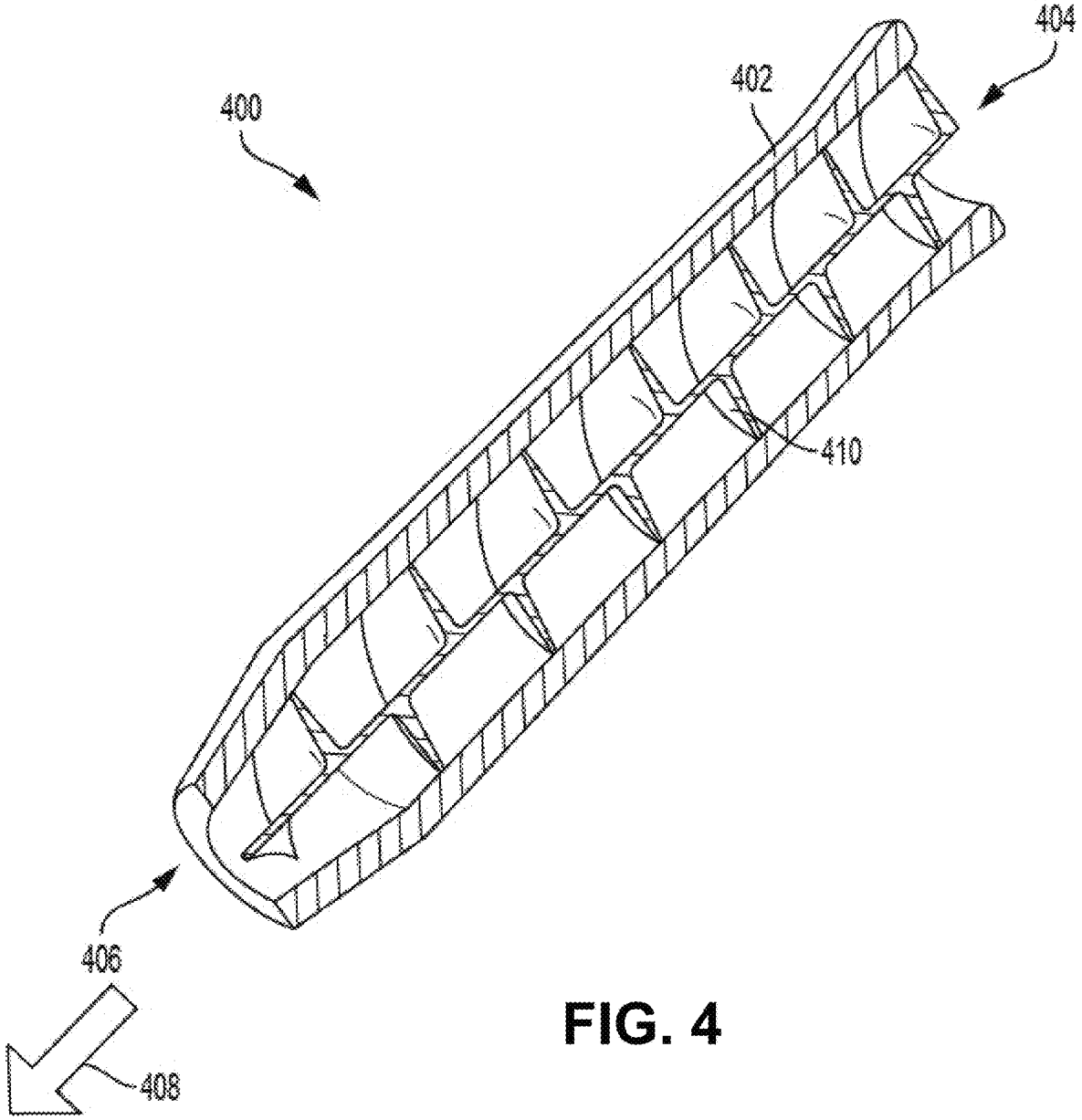
FIG. 4 is a perspective, cross-sectional view of an electromagnet driven screw flow control device according to certain aspects of the present disclosure.

FIG. 4 is a perspective, cross-sectional view of an electromagnet driven screw flow control device 400 according to certain aspects of the present disclosure. A feed tube 402 can include a helical screw 410. The helical screw 410 can be permanently or removably incorporated in the feed tube 402. The feed tube 402 can have an upper end 404 and a lower end 406. Metal can flow from a metal source into the upper end 404 and out through the lower end 406. Generally, the feed tube 402 can be oriented so that gravity will gradually cause molten metal to flow from the upper end 404 to the lower end 406 in flow direction 408.

Figure 5:
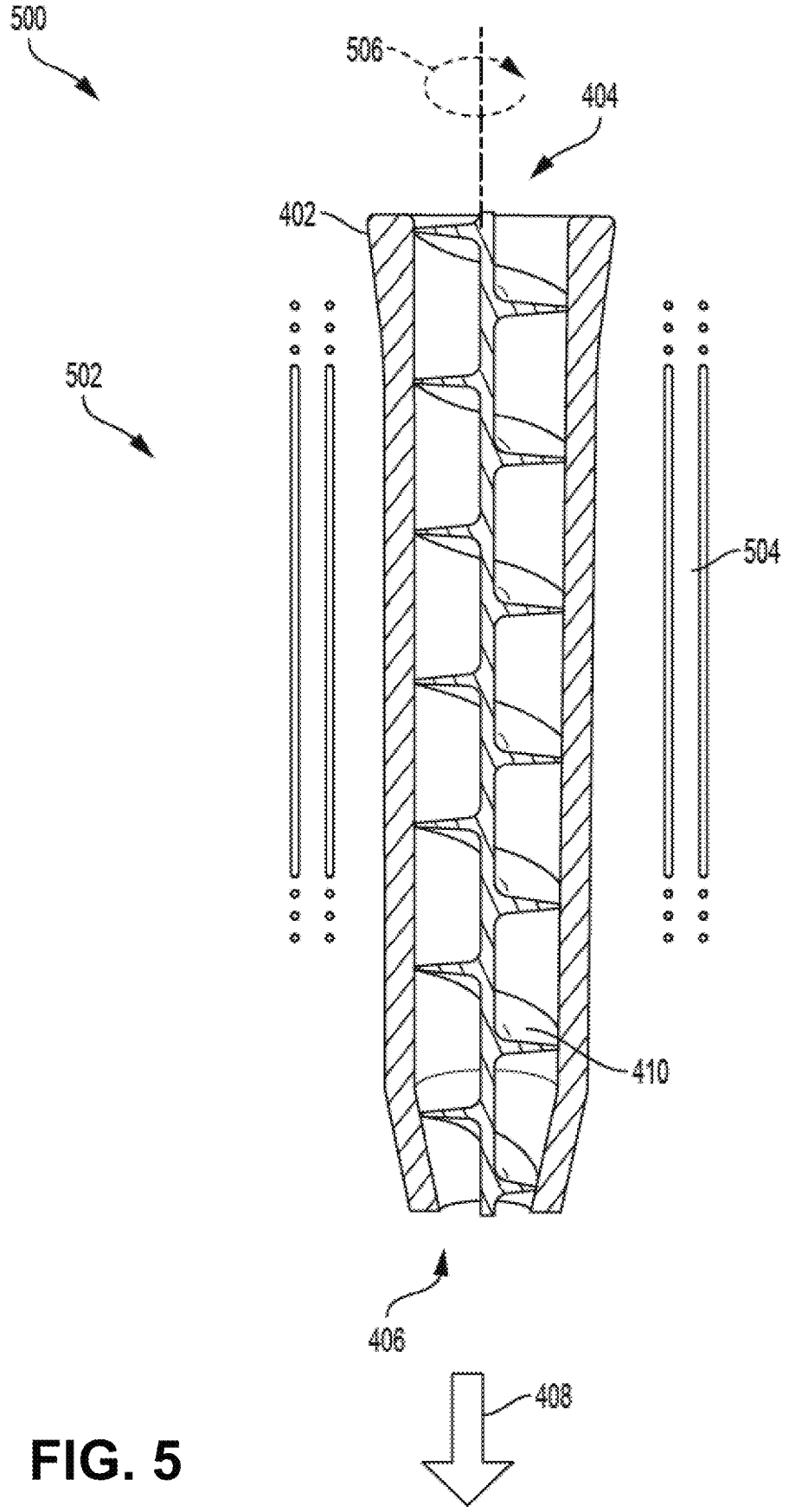
FIG. 5 is a cross-sectional side view of an electromagnet driven screw flow control device according to certain aspects of the present disclosure.

FIG. 5 is a cross-sectional side view of an electromagnet driven screw flow control device 500 according to certain aspects of the present disclosure. The feed tube 402 of FIG. 4, including a helical screw 410 positioned between an upper end 404 and a lower end 406, can be located adjacent a magnetic field source 502. The magnetic field source 502 can be comprised of electromagnetic coils 504 placed around and adjacent to the feed tube 402. The electromagnetic coils 504 can be coils from a three-phase stator, which are used to generate a changing electromagnetic field within the feed tube 402. The changing electromagnetic field can induce rotational movement of the molten metal within the feed tube 402. Generating an electromagnetic field that induces rotational movement in a clockwise direction 506 (e.g., clockwise when viewed from the top of the feed tube 402) can cause the molten metal to be pressed through the inclined planes of the helical screw 410 in a flow direction 408, generating increased pressure and flow in flow direction 408. Generating an electromagnetic field that induces rotational movement in a direction opposite a clockwise direction 506 (e.g., counter-clockwise when viewed from the top of the feed tube 402) can cause the molten metal to be pressed through the inclined planes of the helical screw 410 in a direction opposite flow direction 408, generating decreased pressure and flow in flow direction 408. A sufficient changing magnetic field may be able to stop the flow of molten metal within the feed tube 402 or even cause molten metal to flow in a direction opposite the flow direction 408. As a non-limiting example, the helical screw 410 can be a pin having a screw portion attached thereto, such as an extrusion screw. If the helical screw 410 is removable, it can be rotationally fixed, such as near the top of the helical screw 410. The helical screw 410 can be rotationally fixed with a clamp, a cotter pin, or other suitable mechanism.

Figure 6:
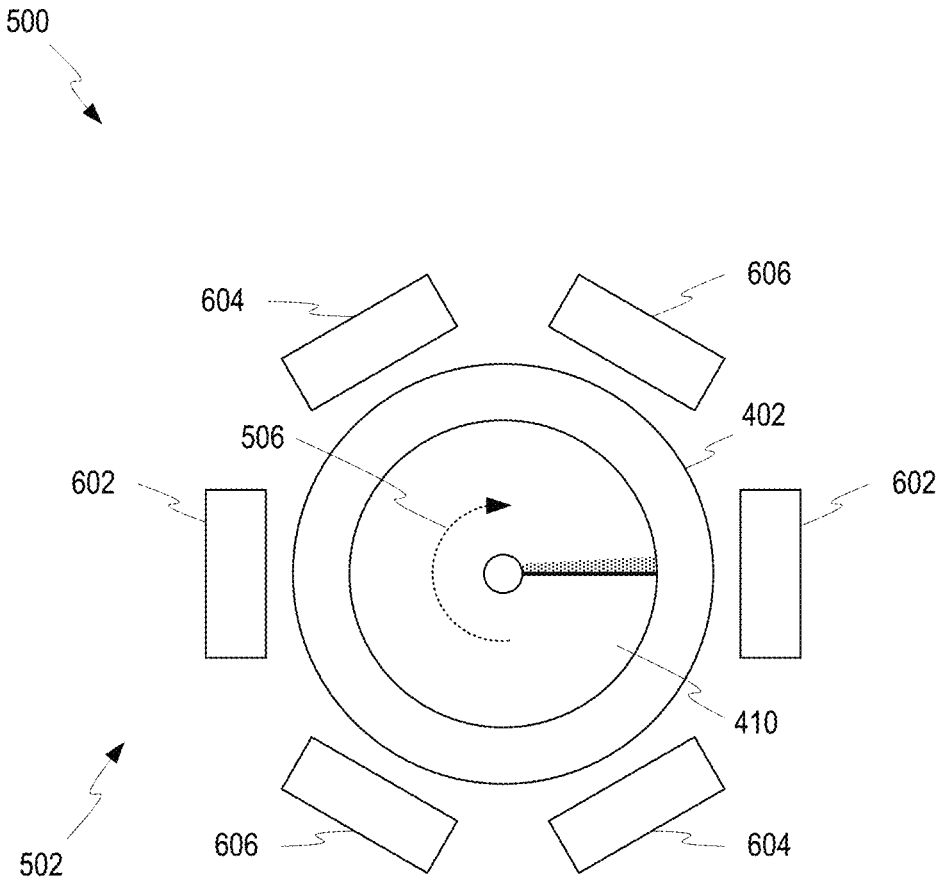
FIG. 6 is a top view of an electromagnet driven screw flow control device according to certain aspects of the present disclosure.

FIG. 6 is a top view of the electromagnet driven screw flow control device 500 of FIG. 5 according to certain aspects of the present disclosure. The feed tube 402 can include the helical screw 410. A magnetic field source 502 can be located around the feed tube 402. The magnetic field source 502 can include electromagnetic coils from a three-phase stator. A first set of electromagnetic coils 602 can generate a magnetic field in a first phase, a second set of electromagnetic coils 604 can generate a second magnetic field in a second phase, and a third set of electromagnetic coils 606 can generate a third magnetic field in a third phase. Each set of electromagnetic coils 602, 604, 606 can include one, two, or more actual electromagnetic coils, therefore the number of electromagnetic coils surrounding the feed tube 402 is in multiples of three. The first phase, second phase, and third phase can be offset from one another, such as by 120°.

As the magnetic field source 502 generates magnetic fields that induce movement of the molten metal in the feed tube 402 in a clockwise direction 506, the molten metal can be forced down the feed tube 402 and out the lower end of the feed tube 402.

Figure 7:
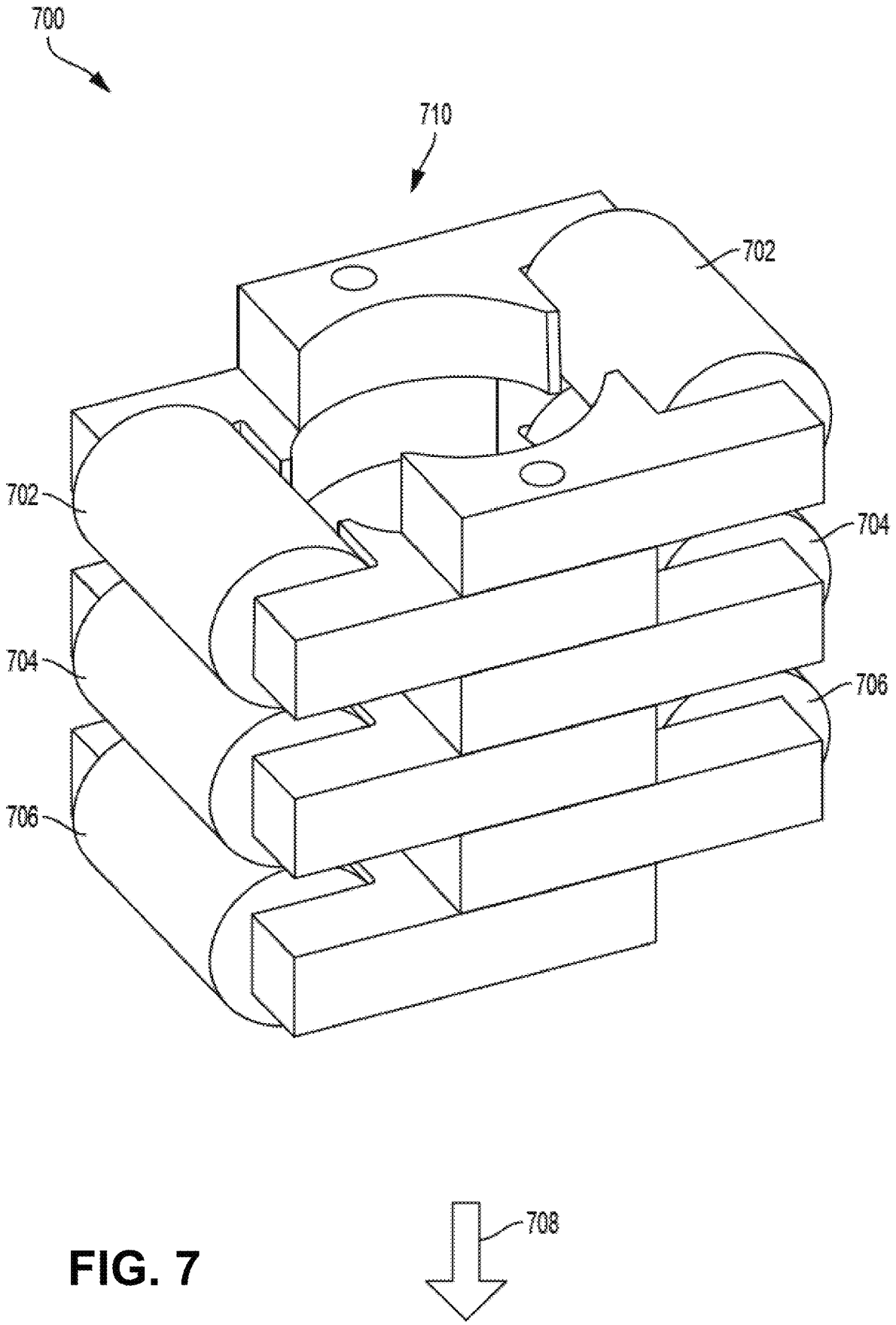
FIG. 7 is perspective view of an electromagnet linear induction flow control device according to certain aspects of the present disclosure.

FIG. 7 is a perspective view of an electromagnet linear induction flow control device 700 according to certain aspects of the present disclosure. Electromagnetic linear inductors 702, 704, 706 are positioned about a cavity 710. A feed tube can be placed within the cavity. The feed tube can have any suitable shape, such as a lofted shape as described above with reference to FIG. 3. The linear inductors 702, 704, 706 can operate in offset phases, such as in three phases offset by 120°. Induction of electromagnetic fields by the linear inductors 702, 704, 706 can induce pressure or movement in the molten metal within the feed tube in a flow direction 708 or a direction opposite the flow direction 708. Flow control can be achieved by varying the magnetic field and frequency applied to the linear inductors 702, 704, 706.

Figure 8:
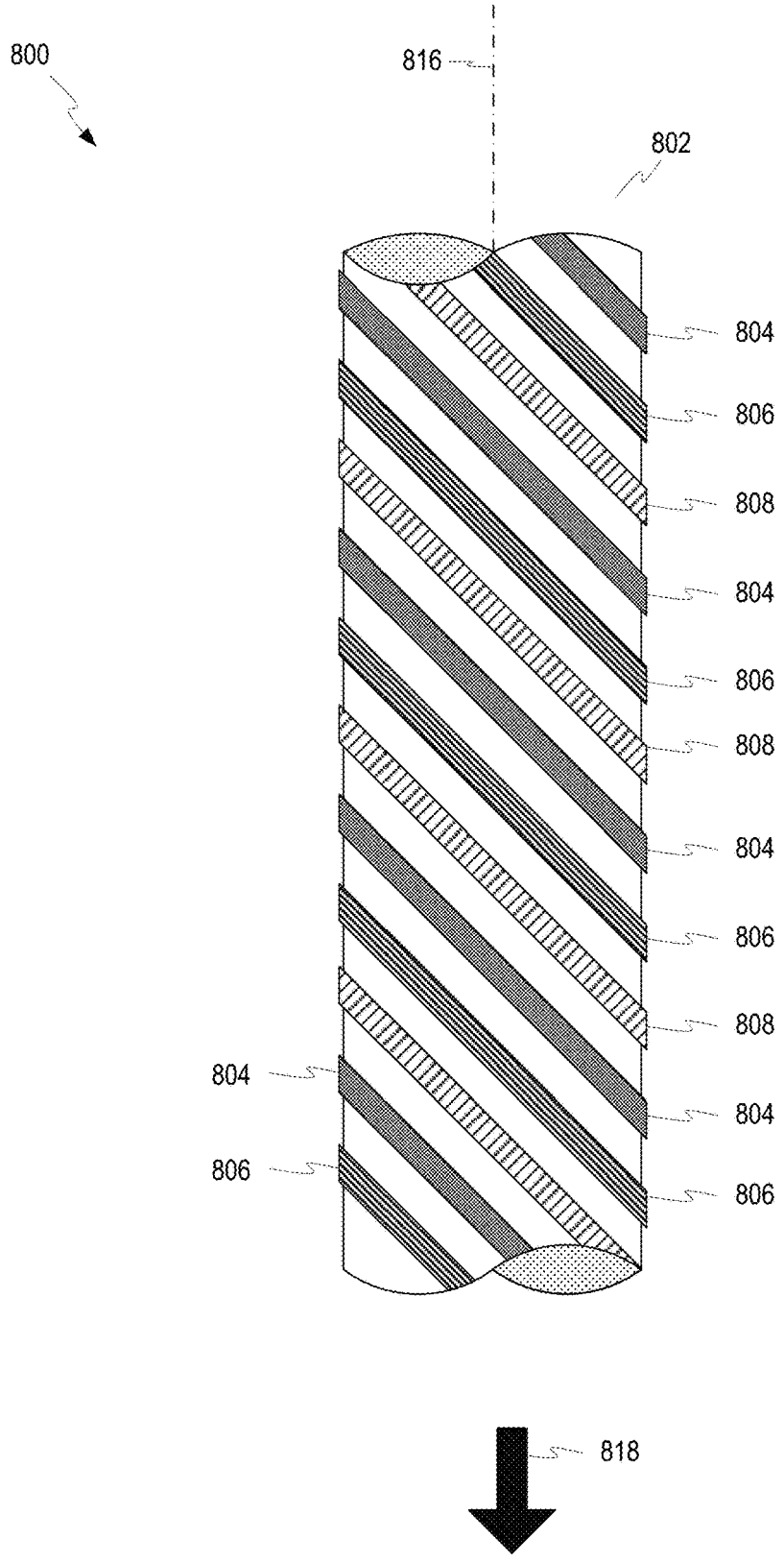
FIG. 8 is a front view of an electromagnetic helical induction flow control device according to certain aspects of the present disclosure.

FIG. 8 is a front view of an electromagnetic helical induction flow control device 800 according to certain aspects of the present disclosure. Electromagnetic coils 804, 806, 808 are wrapped around the feed tube 802. The electromagnetic coils 804, 806, 808 can operate in offset phases, such as in three phases offset by 120°. A first coil 804 can be operated in a first phase, a second coil 806 can be operated in a second phase, and a third coil 808 can be operated in a third phase. The coils 804, 806, 808 can be positioned with similar or different pitch angles relative to a longitudinal axis 816 of the feed tube 802. Alternatively, the coils 804, 806, 808 are each positioned with variable pitch angles relative to a longitudinal axis 816.

Flow control is achieved by varying the frequency, amplitude, or both of the driving current that powers each coil 804, 806, 808. Each coil 804, 806, 808 can be driven with the same frequency and amplitude, but 120° out of phase. The coils 804, 806, 808, when powered, generate a helical, rotating magnetic field within the feed tube 802. The rotating magnetic field induces rotational movement of molten metal in the feed tube 802 (e.g., in a clockwise or counter-clockwise direction when viewed from the top), as well as longitudinal pressure or movement in the feed tube 802 in a flow direction 818 or a direction opposite the flow direction 818.

Figure 9:
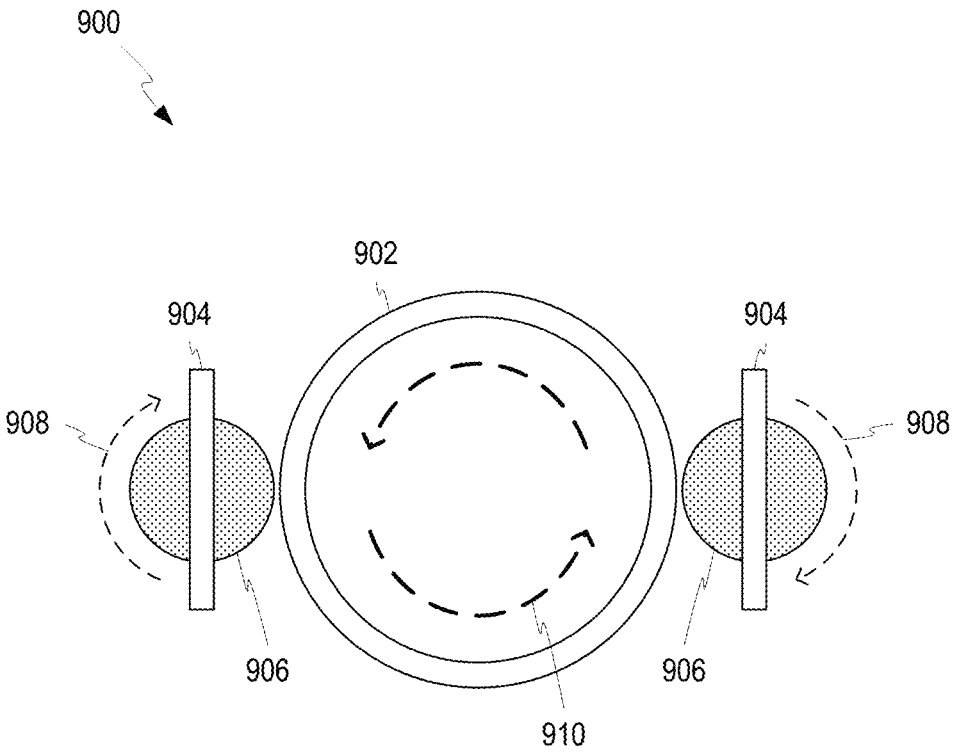
FIG. 9 is a top view of a permanent magnet variable-pitch flow control device according to certain aspects of the present disclosure.

FIG. 9 is a top view of a permanent magnet variable-pitch flow control device 900 according to certain aspects of the present disclosure. A set of rotating permanent magnets 906 is positioned around a feed tube 902. The rotating permanent magnets 906 can be the rotor and permanent magnet combination as described above with reference to FIG. 3, or other rotating permanent magnets. As the rotating permanent magnets 906 rotate in a first direction 908, they generate changing magnetic fields that induce rotational movement of the molten metal in the feed tube 902 in direction 910. Rotation of the rotating permanent magnets 906 in a direction opposite the first direction 908 can induce movement of the molten metal in a direction opposite direction 910. The rotating permanent magnets 906 are positioned in a frame 904 to vary the pitch of the rotational axis.

Figure 10:
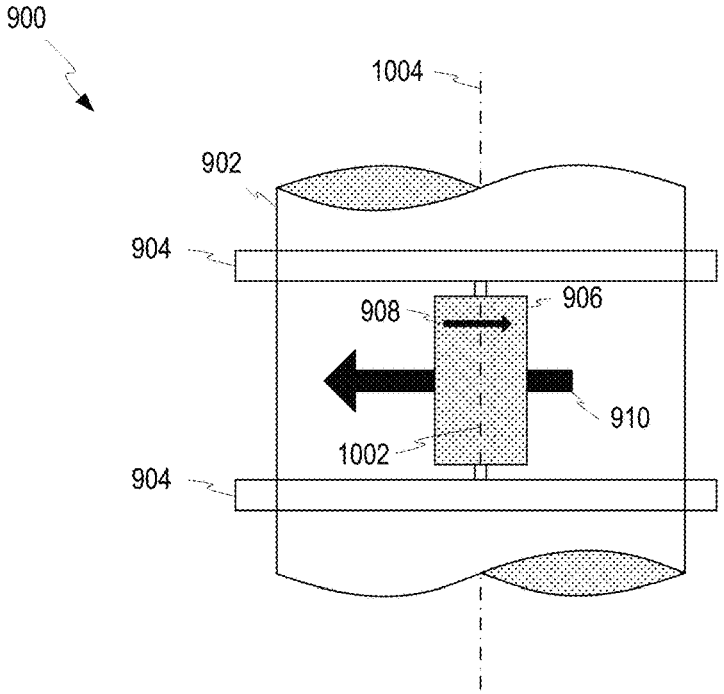
FIG. 10 is a side view of the permanent magnet variable-pitch flow control device of FIG. 9 in a rotation-only orientation according to certain aspects of the present disclosure.

FIG. 10 is a side view of the permanent magnet variable-pitch flow control device 900 of FIG. 9 in a rotation-only orientation according to certain aspects of the present disclosure. The rotational axis 1002 of the rotating permanent magnet 906 is parallel to the longitudinal axis 1004 of the feed tube 902. The rotating permanent magnet 906 is positioned in the frame 904 and rotates in the first direction 908. As the rotating permanent magnet 906 rotates, it induces rotational flow of the metal inside the feed tube 902 in direction 910. In a rotation-only orientation, the rotational axis 1002 and longitudinal axis 1004 are parallel, resulting in no additional pressure being applied to the molten metal in a longitudinal direction (e.g., upwards or downwards, as seen in FIG. 10).

Figure 11:
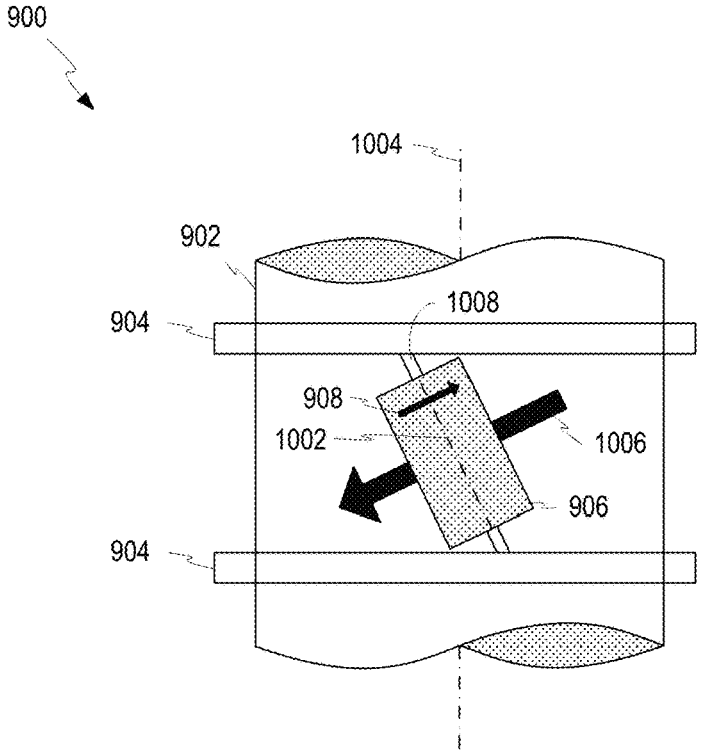
FIG. 11 is a side view of the permanent magnet variable-pitch flow control device of FIG. 9 in a downward pressure orientation according to certain aspects of the present disclosure.

FIG. 11 is a side view of the permanent magnet variable-pitch flow control device 900 of FIG. 9 in a downward pressure orientation according to certain aspects of the present disclosure. The rotational axis 1002 of the rotating permanent magnet 906 is non-parallel to the longitudinal axis 1004 of the feed tube 902. The pitch of the rotational axis 1002 can be adjusted, such as by adjusting the position of a spindle 1008 of the rotating permanent magnets 906 within the frame 904 (e.g., within the top portion of the frame, the bottom portion of the frame, or both). When the pitch of the rotational axis 1002 is non-parallel with the longitudinal axis 1004 of the feed tube 902, rotation of the rotating permanent magnet 906 induces pressure in the molten metal within the feed tube 902 in a longitudinal direction (e.g., upwards or downwards, as seen in FIG. 11). The net metal flow occurs in direction 1006, a direction perpendicular to the rotational axis 1002 of the rotating permanent magnets 906, when the rotating permanent magnet 906 rotates in the first direction 908.

Control of longitudinal flow and rotational flow can be controlled through rotation speed of the rotating permanent magnet 906 and pitch of the rotational axis 1002 of the rotating permanent magnet 906.

Figure 12:
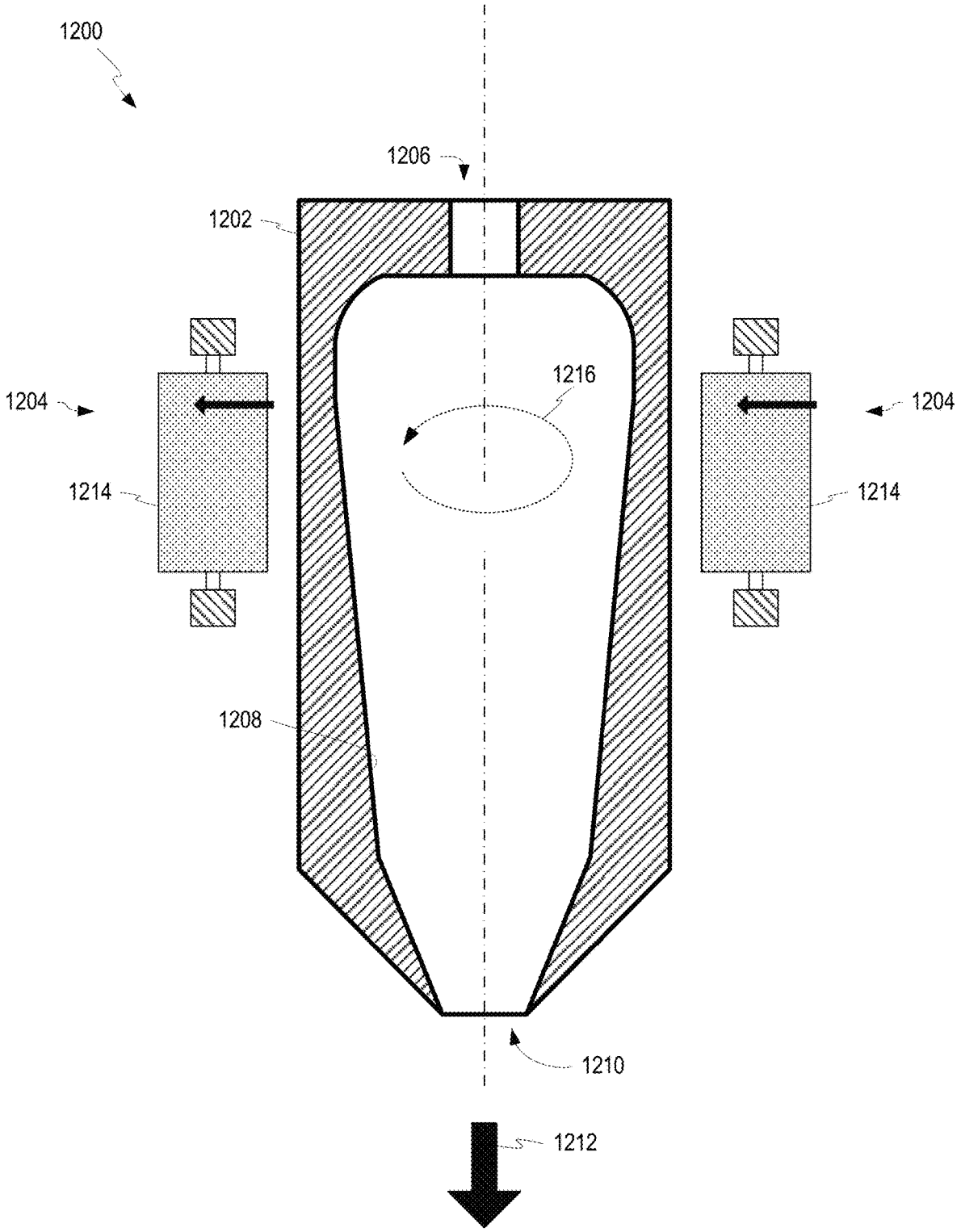
FIG. 12 is a cross-sectional side view of a centripetal downspout flow control device according to certain aspects of the present disclosure.

FIG. 12 is a cross-sectional side view of a centripetal downspout flow control device 1200 according to certain aspects of the present disclosure. A centripetal downspout 1202 can be used with any flow control device 1204 that induces rotational motion (e.g., centripetal motion or circumferential motion) of molten metal within a feed tube. The flow control device 1204 can be a pair of rotating permanent magnets 1214, such as those described above with reference to FIG. 11.

Molten metal can enter the centripetal downspout 1202 through an upper opening 1206. Molten metal can generally pass through the centripetal downspout 1202 and out a lower opening 1210 due to gravitational forces. As the flow control device 1204 induces circumferential motion 1216 in the molten metal within the centripetal downspout 1202, the molten metal will be drawn out to the inner wall 1208 of the centripetal downspout 1202. The inner wall 1208 can be inclined at an angle, such that molten metal impacting the inner wall 1208 will be forced upwards or downwards (e.g., as seen in FIG. 12). As seen in FIG. 12, the inner wall 1208 is angled to provide upward pressure when the molten metal inside the centripetal downspout 1202 is induced with circumferential motion 1216. Thus, while the molten metal will normally flow in flow direction 1212 due to gravity, increased inducement of circumferential motion 1216 can cause the molten metal to flow in flow direction 1212 with less intensity or even flow in a direction opposite flow direction 1212. In some cases, the inner wall 1208 can be angled to provide increased pressure and flow intensity in flow direction 1212 in response to inducement of circumferential motion 1216 in the molten metal within the centripetal downspout 1202.

Figure 13:
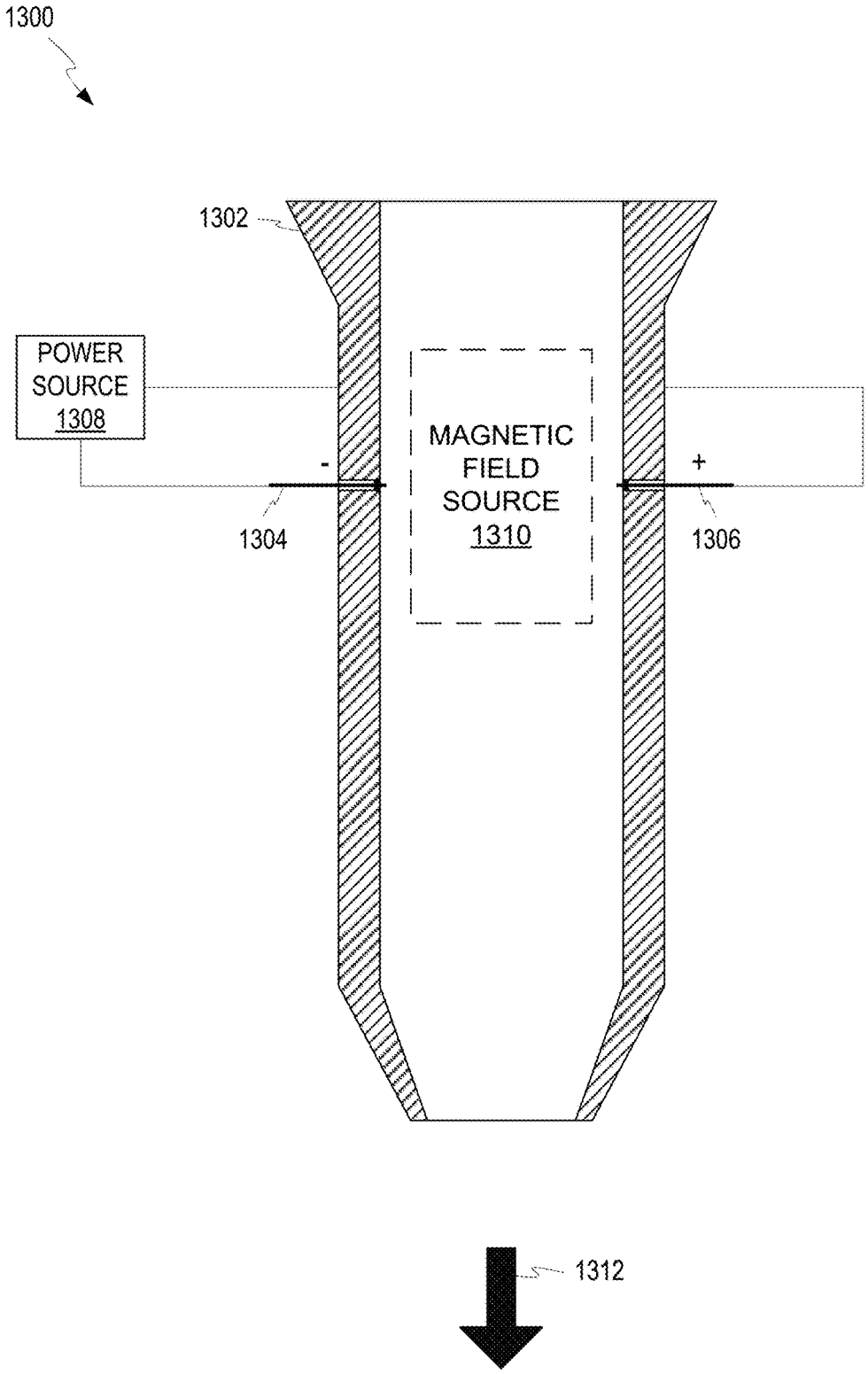
FIG. 13 is a cross-sectional side view of a direct current conduction flow control device according to certain aspects of the present disclosure.

FIG. 13 is a cross-sectional side view of a direct current conduction flow control device 1300 according to certain aspects of the present disclosure. A feed tube 1302 can include a first electrode 1304 and a second electrode 1306 positioned to contact molten metal within the feed tube 1302. The electrodes 1304, 1306 can be positioned within holes of the feed tube 1302. The electrodes 1304, 1306 can be graphite electrodes. The first electrode 1304 can be a cathode and the second electrode 1306 can be an anode. The electrodes 1304, 1306 can be coupled to a power source 1308. The power source 1308 can be a source of direct current (DC) power or a source of alternating current (AC) power. The power source 1308 can generate a current through the molten metal in the feed tube 1302 between the electrodes 1304, 1306. In some cases, the power source 1308 can be a controller that provides controllable power (e.g., AC or DC) through electrodes 1304, 1306. Such controllable power can be controlled based on measurements, such as time elapsed, length of cast, or other measurable variables.

A magnetic field source 1310 can be located outside the feed tube 1302 (e.g., behind the feed tube 1302, as seen in FIG. 13). The magnetic field source 1310 can be a permanent magnet or electromagnet positioned adjacent the feed tube 1302 to induce a magnetic field through the feed tube 1302 approximately between the electrodes 1304, 1306, where the electric current is generated by the power source 1308.

The interaction of the electric current flowing in the molten metal in a direction perpendicular to the magnetic field can result in a force that pressurizes the molten metal in a longitudinal direction, such as flow direction 1312. Flow can be controlled by controlling the current flow through the electrodes 1304, 1306 and the magnetic field generated by the magnetic field source 1310.

Figure 14:
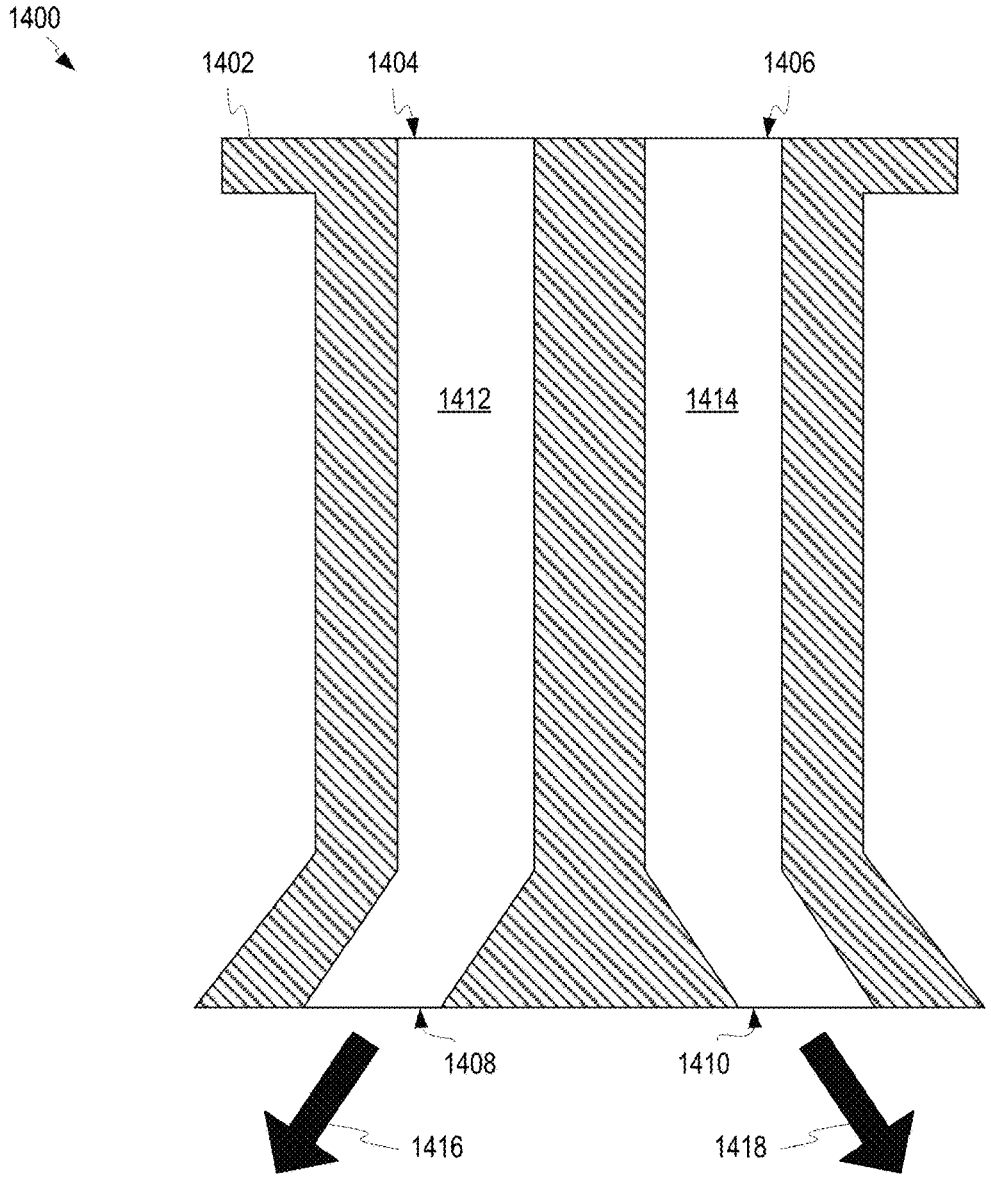
FIG. 14 is a cross-sectional side view of a multi-chamber feed tube according to certain aspects of the present disclosure.

FIG. 14 is a cross-sectional side view of a multi-chamber feed tube 1400 according to certain aspects of the present disclosure. The multi-chamber feed tube 1400 includes a feed tube 1402 having multiple passageways (e.g., chambers) through the feed tube 1402. The feed tube 1402 can include a first passageway 1412 and a second passageway 1414. The first passageway 1412 extends from a first entry point 1404 to a first exit nozzle 1408. The second passageway 1414 extends from a second entry point 1406 to a second exit nozzle 1410. Alternatively, the first entry point 1404 and second entry point 1406 can be joined. The first exit nozzle 1408 and second exit nozzle 1410 can direct molten metal in different directions. The first exit nozzle 1408 can direct molten metal in a first direction 1416 and the second exit nozzle 1410 can direct molten metal in a second direction 1418.

In some cases, each of the passageways 1412, 1414 can be separately or jointly controlled, such as with a flow controller as described herein. The first passageway 1412 and second passageway 1414 can be controlled to release molten metal simultaneously or separately. The first passageway 1412 and second passageway 1414 can be controlled to release molten metal with differing intensities at different times in-phase or out-of-phase with one another.

Figure 15:
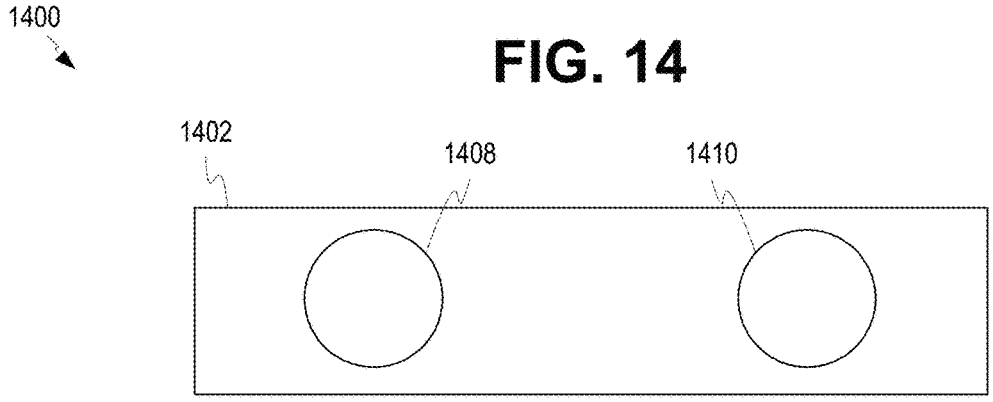
FIG. 15 is a bottom view of the multi-chamber feed tube of FIG. 14 according to certain aspects of the present disclosure.

FIG. 15 is a bottom view of the multi-chamber feed tube 1400 of FIG. 14 according to certain aspects of the present disclosure. The feed tube 1402 includes a first exit nozzle 1408 and a second exit nozzle 1410.

Figure 16:
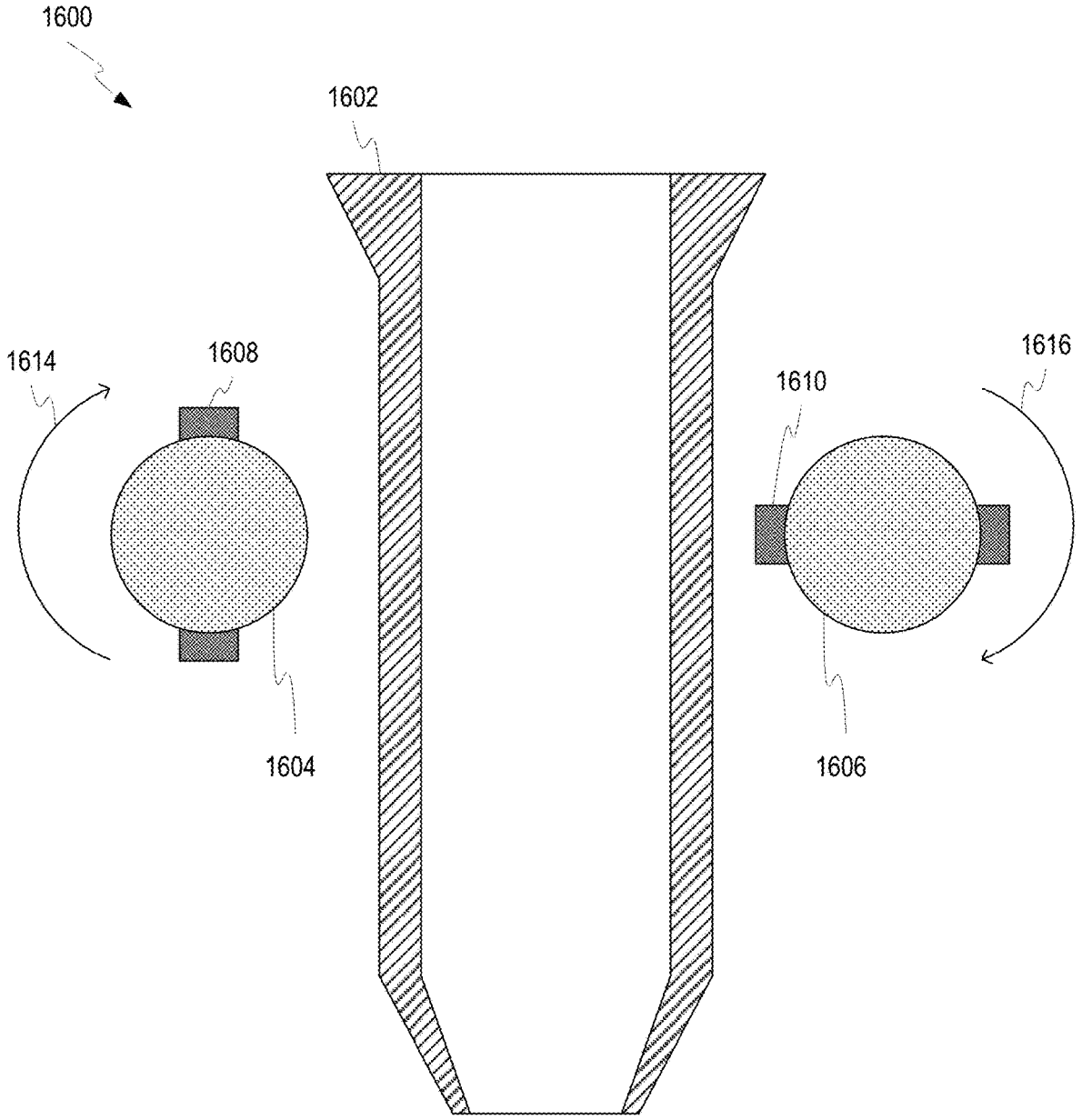
FIG. 16 is a cross-sectional side view of a Helmholtz resonator flow control device according to certain aspects of the present disclosure.

FIG. 16 is a cross-sectional side view of a Helmholtz resonator flow control device 1600 according to certain aspects of the present disclosure. A feed tube 1602 can be positioned between two rotors 1604, 1606. Each rotor 1604, 1606 can include permanent magnets 1608, 1610 attached thereto. More or fewer permanent magnets can be used than what is shown in FIG. 16. The first rotor 1604 and its permanent magnets 1608 can spin in a first direction 1614 at a first speed. The second rotor 1606 and its permanent magnets 1610 can spin in a second direction 1616 at a second speed. The first direction 1614 can be the same as the second direction 1616. The first speed and second speed can be the same. The first rotor 1604 and second rotor 1606 are rotated out of phase with one another, such that at least one of the permanent magnets 1610 of the second rotor 1606 is nearest the feed tube 1602 when both of the permanent magnets 1608 of the first rotor 1604 are offset from the feed tube 1602 (e.g., where both of the permanent magnets 1608 are at the top and bottom of the rotor 1604, as seen in FIG. 16).

By rotating these permanent magnets 1608, 1610 out of phase with one another, oscillating pressure waves can be induced in the molten metal within the feed tube 1602. Such oscillating pressure waves can be conducted through the molten metal and into the molten sump.

Figure 17:
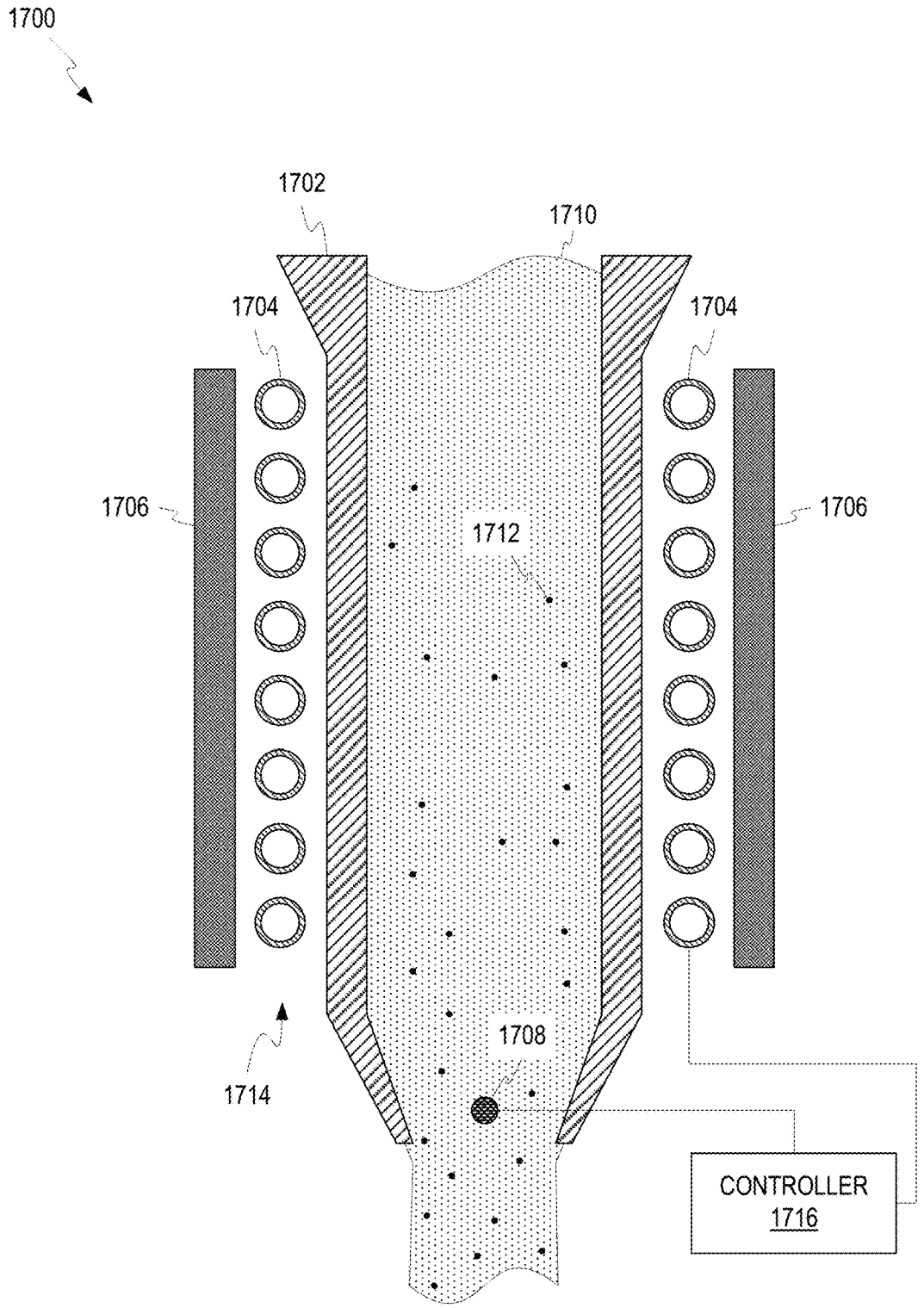
FIG. 17 is a cross-sectional side view of a semi-solid casting feed tube according to certain aspects of the present disclosure.

FIG. 17 is a cross-sectional side view of a semi-solid casting feed tube 1700 according to certain aspects of the present disclosure. Molten metal 1710 passes through a feed tube 1702 surrounded by a temperature control device 1714. The temperature control device 1714 can help control the temperature of the molten metal 1710 as it passes through the feed tube 1702. The temperature control device 1714 can be a system of fluid-filled tubes 1704, such as water-filled tubes. Recirculating a coolant fluid (e.g., water) through the tubes 1704 can remove heat from the molten metal 1710. As heat is removed from the molten metal 1710, the molten metal 1710 can begin to solidify and solid metal 1712 (e.g., nucleation sites or crystals) can begin to form.

To keep the molten metal 1710 from fully solidifying within the feed tube 1702, a flow control device 1706 can be placed around the feed tube 1702 to generate a constant shear force in the molten metal 1710. Any suitable flow control device 1706, such as those described herein, can be used to generate the constant shear force in the molten metal 1710, such as through the generation of changing magnetic fields within the feed tube 1702.

A controller 1716 can monitor the percentage of solid metal 1712 within the molten metal 1710. The controller 1716 can use a feedback loop to provide less cooling through the temperature control device 1714 when the percentage of solid metal 1712 exceeds a set-point, and provide more cooling when the percentage of solid metal 1712 is below a set-point. The percentage of solid metal 1712 can be determined by direct measurement or estimation based on temperature measurements. In a non-limiting example, a temperature probe 1708 is placed in the molten metal 1710 adjacent an exit of the feed tube 1702 to measure the temperature of the molten metal 1710 exiting the feed tube 1702. The temperature of the molten metal 1710 exiting the feed tube 1702 can be used to estimate the percentage of solid metal 1712 in the molten metal 1710. The temperature probe 1708 is coupled to the controller 1716 to provide a signal for the feedback loop. In an alternate example, the temperature probe 1708 can be placed elsewhere. If desired, a non-contact temperature probe can be used to provide a signal for the feedback loop.

The temperature control device 1714 can be placed between the flow control device 1706 and the feed tube 1702. In some cases, the temperature control device 1714 and flow control device 1706 can be integrated together (e.g., coils of a wire can be placed between successive tubes 1704). The flow control device 1706 can be placed between the temperature control device 1714 and the feed tube 1702.

A temperature control device 1714 and flow control device 1706 can be used with any suitable feed tube, such as those described herein, to perform semi-solid casting.

Figure 18:
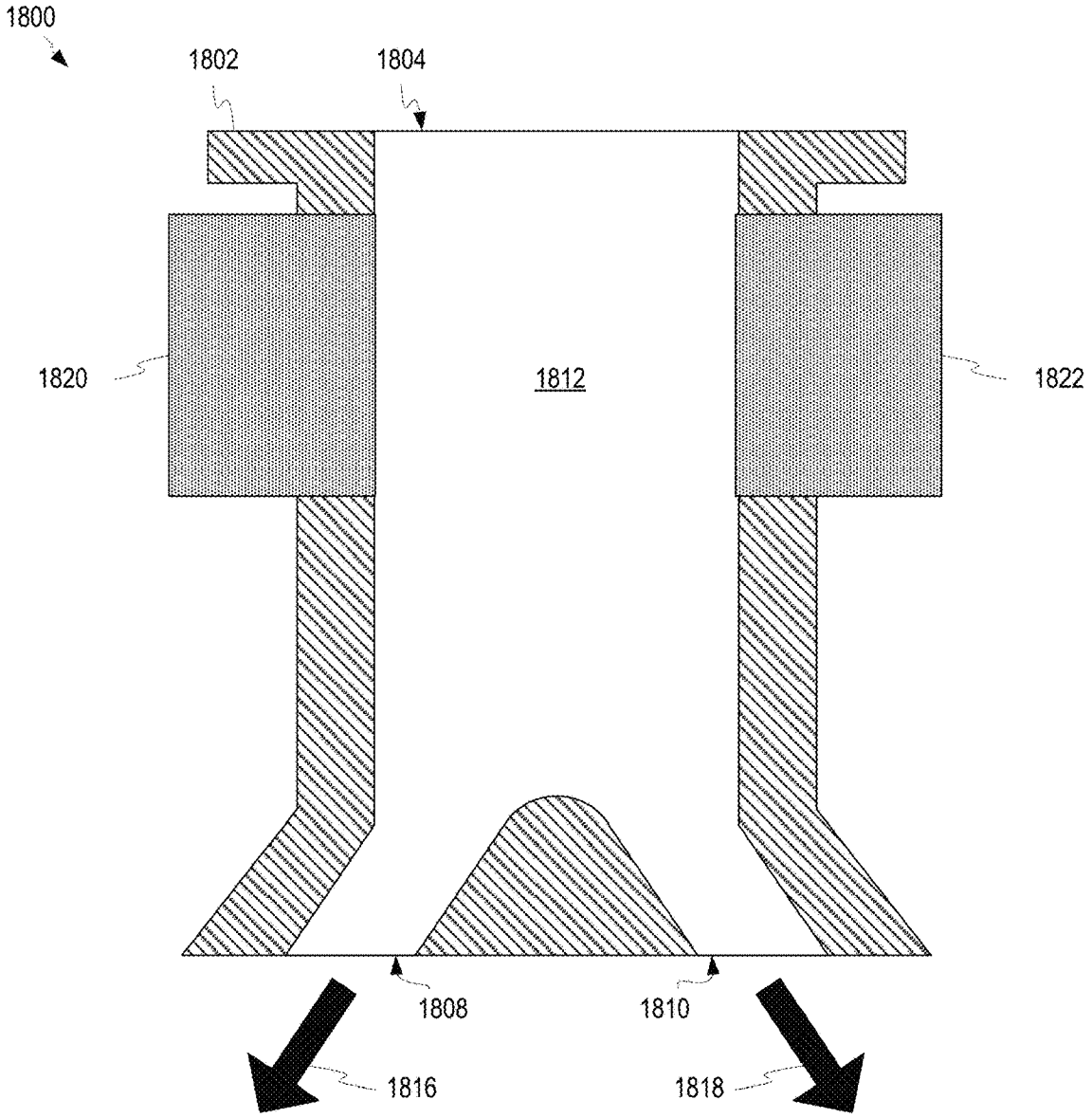
FIG. 18 is a front, cross-sectional view of a plate feed tube having multiple exit nozzles according to certain aspects of the present disclosure.

FIG. 18 is a front, cross-sectional view of a plate feed tube 1800 having multiple exit nozzles 1808, 1810 according to certain aspects of the present disclosure. The plate feed tube 1800 includes a feed tube 1802 having at least one passageways 1812 (e.g., chamber) through the feed tube 1802. The passageway 1812 extends from an entry 1804 to a first exit nozzle 1808 and a second exit nozzle 1810. If desired, the plate feed tube 1800 can include multiple passageways. The first exit nozzle 1808 and second exit nozzle 1810 can direct molten metal in different directions. The first exit nozzle 1808 can direct molten metal in a first direction 1816 and the second exit nozzle 1810 can direct molten metal in a second direction 1818.

A first electrode 1820 and a second electrode 1822 can be positioned on opposite sides of the feed tube 1802 and can electrically contact the passageway 1812. In some cases, the electrodes 1820, 1822 are made of graphite, although they can be made of any suitable conductive material capable of withstanding the high temperatures of the molten metal. A controller (such as controller 2410 shown in FIG. 24) can supply the electrodes 1820, 1822 with a current, thus inducing electrical current flow through molten metal within the passageway 1812. When combined with magnets (such as magnets 2012 and 2104, shown in FIGS. 21-22) placed in front of and behind the feed tube 1802 to generate a magnetic field through the molten metal in the passageway 1812, force can be applied to the molten metal within the passageway 1812 in an upwards or downwards direction to decrease or increase the flow of molten metal through the feed tube 1802, respectively.

The magnets and electrodes 1820, 1822 can be positioned such that the direction of the magnetic field and the direction of an electrical current passing through the electrodes 1820, 1822 within the passageway (e.g., through a molten metal within the passageway) are both oriented perpendicular to a length of the feed tube (e.g., upwards and downwards as seen in FIG. 18).

Figure 19:
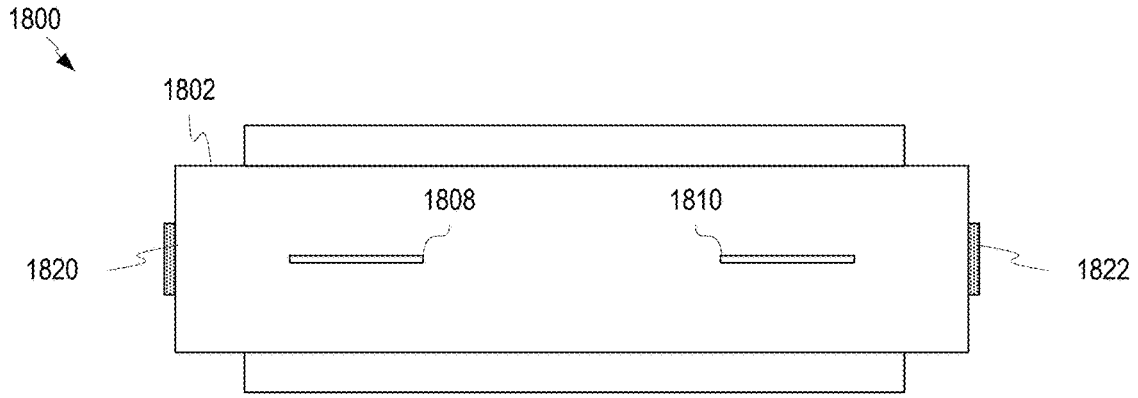
FIG. 19 is a bottom view of the plate feed tube of FIG. 18 according to certain aspects of the present disclosure.

FIG. 19 is a bottom view of the plate feed tube 1800 of FIG. 18 according to certain aspects of the present disclosure. The feed tube 1802 includes a first exit nozzle 1808 and a second exit nozzle 1810, each of which can be rectangular in shape. The electrodes 1820, 1822 can be seen.

Figure 20:
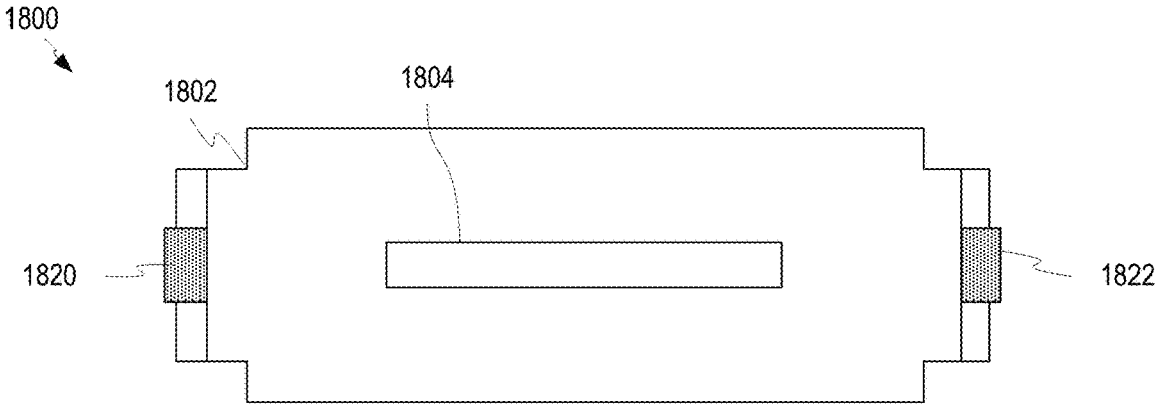
FIG. 20 is a top view of the plate feed tube of FIG. 18 according to certain aspects of the present disclosure.

FIG. 20 is a top view of the plate feed tube 1800 of FIG. 18 according to certain aspects of the present disclosure. The feed tube 1802 includes an entry 1804 that is rectangular in shape. The electrodes 1820, 1822 can be seen.

An eductor attachment and eductor nozzle are not shown in FIGS. 18-20.

Figure 21:
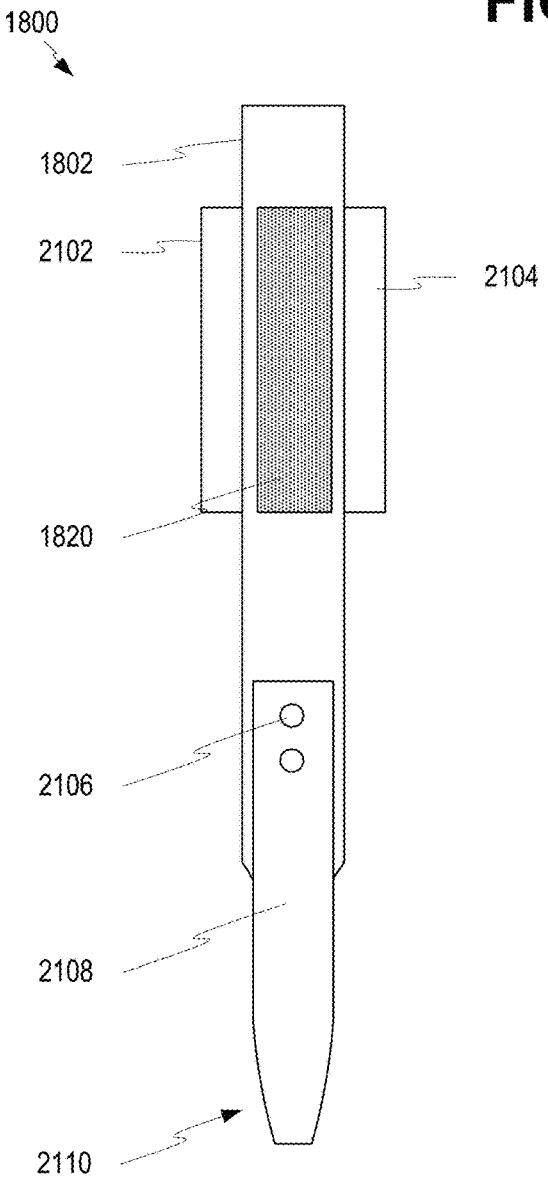
FIG. 21 is a side elevation view of the plate feed tube of FIG. 18 showing an eductor attachment according to certain aspects of the present disclosure.

FIG. 21 is a side elevation view of the plate feed tube 1800 of FIG. 18 showing an eductor attachment 2108 according to certain aspects of the present disclosure. The feed tube 1802 can include an electrode 1820 and permanent magnets 2102, 2104. Permanent magnets 2102, 2014 can be located on the rear (e.g., left) and front (e.g., right) of the feed tube 1802 to generate a magnetic field through the feed tube 1802. In some cases, electromagnets can be used instead of permanent magnets. The permanent magnets 2102, 2014 and electrodes 1820 can be located at approximately equal heights along the walls of the feed tube 1802.

An eductor attachment 2108 is shown attached to the feed tube 1802. In some alternate cases, the eductor attachment 2108 can be attached to something other than the feed tube 1802, such as the mold cavity. A single eductor attachment 2108 with multiple eductor nozzles 2110 can be positioned adjacent the feed tube 1802, with each eductor nozzle 2110 positioned adjacent an exit nozzle 1808, 1810 of the feed tube 1802. In some cases, multiple eductor attachments 2108, each with a single eductor nozzle 2110, can be positioned adjacent the feed tube 1802, with each eductor nozzle 2110 positioned adjacent an exit nozzle 1808, 1810 of the feed tube 1802.

As shown in FIG. 21, the eductor attachment 2108 can be coupled to a side of the feed tube 1802, although the eductor attachment 2108 can be coupled in any suitable manner to any suitable location of the feed tube 1802. In some cases, the eductor attachment 2108 can be removably coupled to the feed tube 1802 through the use of removable fasteners 2106 (e.g., screws, bolts, pins, or other fasteners). In some cases, given a desired casting speed and particular alloying being cast, an ideal eductor nozzle 2110 size can be selected from a range of available eductor nozzle sizes. An undesirable (i.e., with respect to the desired casting speed and alloy) eductor attachment 2108 can be removed from a feed tube 1802 and a desired eductor attachment 2108 having the desired eductor nozzle 2110 can be selected and attached to the feed tube 1802. Therefore, a plurality of eductor nozzles 2110 of different dimensions or sizes can be provided for use with a single feed tube 1802, any one of which can be selected based on the desired casting speed and alloy. In some alternate cases, only a single eductor nozzle 2110 size is provided for each feed tube 1802, however similar determinations can be made to select an appropriate feed tube 1802 and eductor nozzle 2110 for a particular casting speed and alloy.

As used herein, the eductor nozzle and eductor attachment can be made of any suitable materials, such as refractory materials or ceramic materials.

Figure 22:
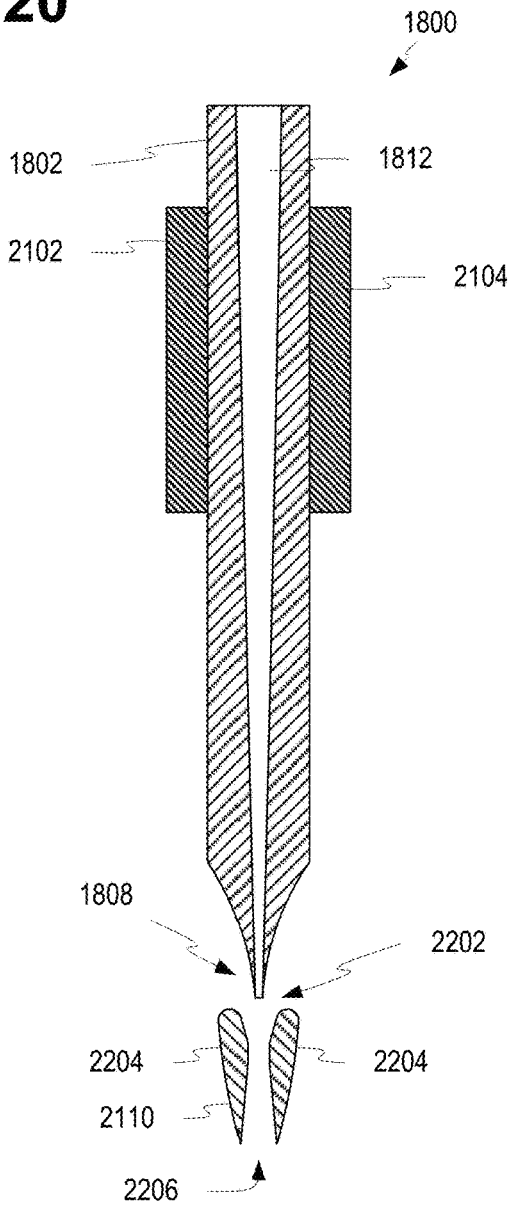
FIG. 22 is a side cross-sectional view of the plate feed tube of FIG. 18 showing an eductor nozzle according to certain aspects of the present disclosure.

FIG. 22 is a side cross-sectional view of the plate feed tube 1800 of FIG. 18 showing an eductor nozzle 2110 according to certain aspects of the present disclosure. The feed tube 1802 can include permanent magnets 2102, 2104. Permanent magnets 2102, 2104 need not extend into the passageway 1812. The feed tube 1802 includes an exit nozzle 1808. Eductor nozzle 2110 is positioned adjacent the exit nozzle 1808. Eductor nozzle 2110 can be held in place by an eductor attachment 2108, as described above.

The eductor nozzle 2110 can include two wings 2204 shaped to provide a restriction through which molten metal flowing out of the nozzle 1808 flows during the casting process. As described herein, molten metal flowing out the nozzle 1808 passes through the restriction and out the eductor exit 2206. While molten metal flows out the nozzle 1808 through the restriction, molten metal existing in the metal sump is carried through the eductor opening 2202.

Figure 23:
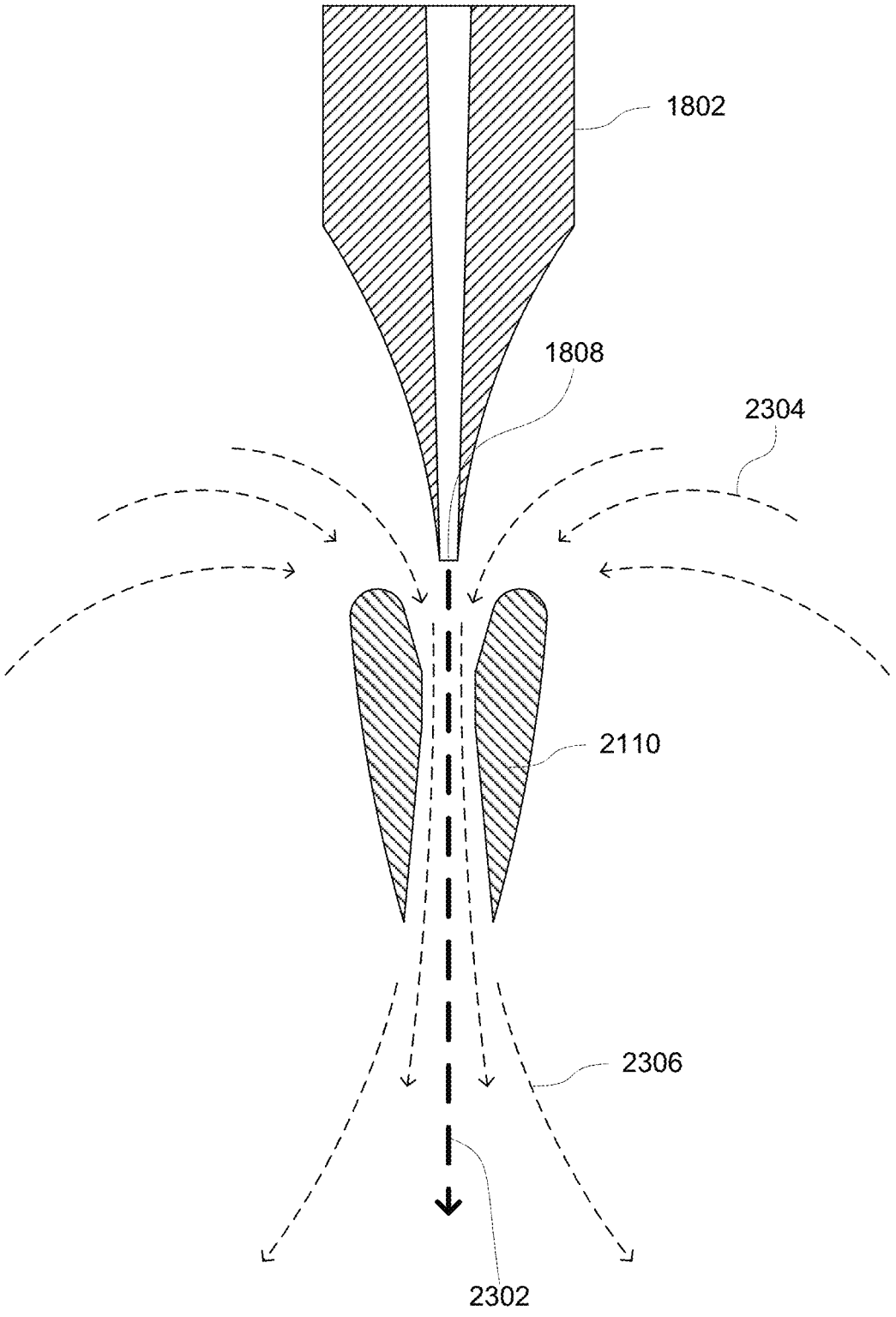
FIG. 23 is a close-up cross-sectional view of the feed tube of FIG. 22 according to certain aspects of the present disclosure.

FIG. 23 is a close-up cross-sectional view of the feed tube 1802 of FIG. 22 according to certain aspects of the present disclosure. A primary flow 2302 exits the feed tube 1802 out the exit nozzle 1808. As the primary flow 2302 passes through the eductor nozzle 2110, supplemental inflow 2304 is drawn into the eductor nozzle 2110. The combined primary flow 2302 and supplemental inflow 2304 exits the eductor nozzle 2110 as a combined flow 2306.

Figure 24:
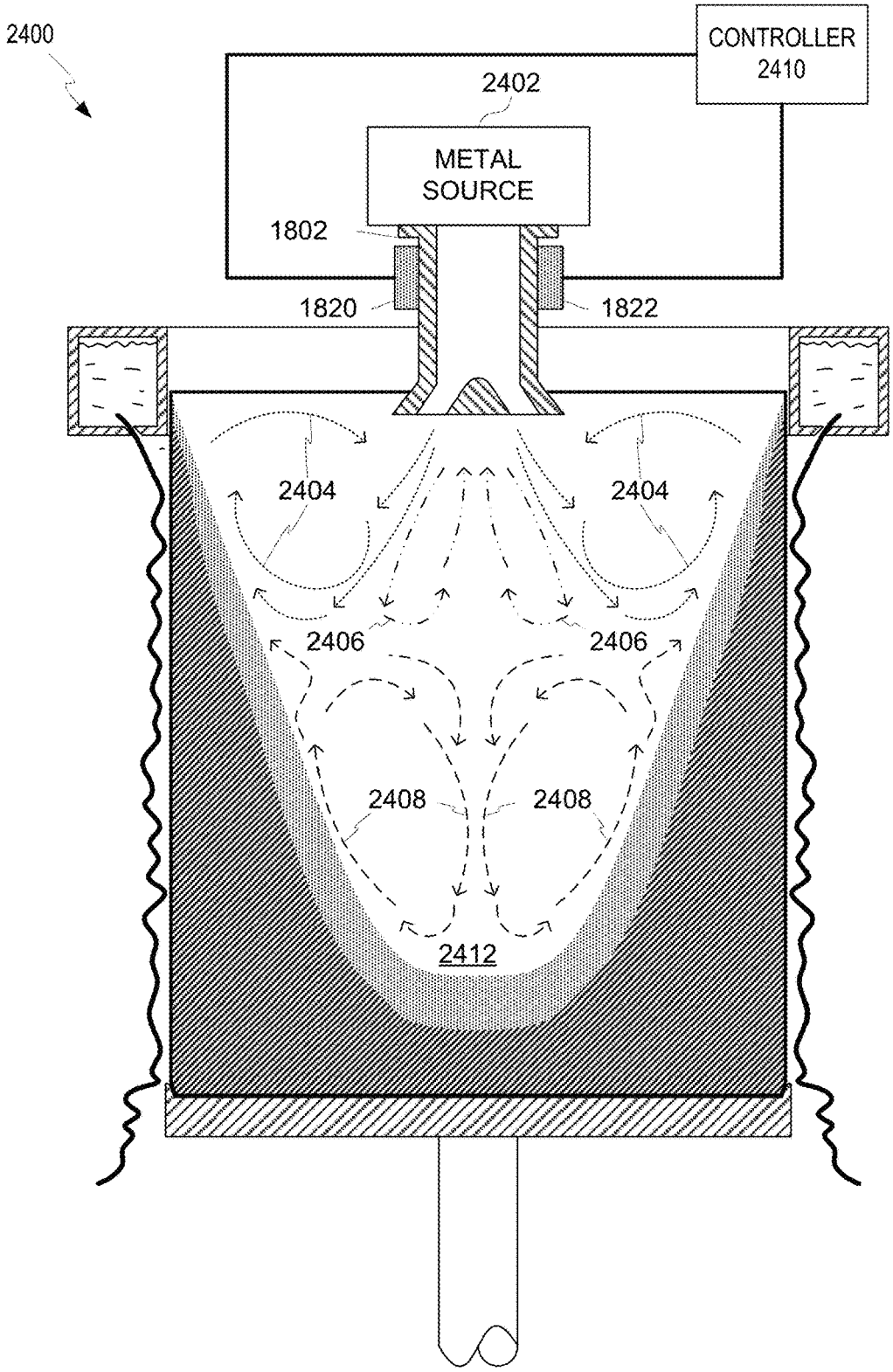
FIG. 24 is a partial cross-sectional view of a metal casting system using the feed tube of FIG. 18 according to certain aspects of the present disclosure.

FIG. 24 is a partial cross-sectional view of a metal casting system 2400 using the feed tube 1802 of FIG. 18 according to certain aspects of the present disclosure. Molten metal from the metal source 2402 passes through the feed tube 1802 and into the molten sump 2412. A controller 2410 can be coupled to the electrodes 1820, 1822 of the feed tube 1802 to provide a motive force, along with magnets positioned in front of and behind the feed tube 1802, to control flow through the feed tube 1802.

While not visible in FIG. 24, the feed tube 1802 can include an eductor nozzle to increase the velocity of the molten metal exiting the feed tube 1802 (such as the eductor nozzle 2110 shown and described with respect to FIGS. 21-23). Molten metal exiting the feed tube 1802 can induce primary flow 2404 of molten metal in the top portion of the molten sump 2412. This primary flow 2404 can induce secondary flow 2406, 2408 in the molten sump 2412. Secondary flow 2406 can increase mixing in a stagnation region near the center of the molten sump 2412. Secondary flow 2408 can increase mixing in a stagnation region near the bottom of the molten sump 2412.

Figure 25:
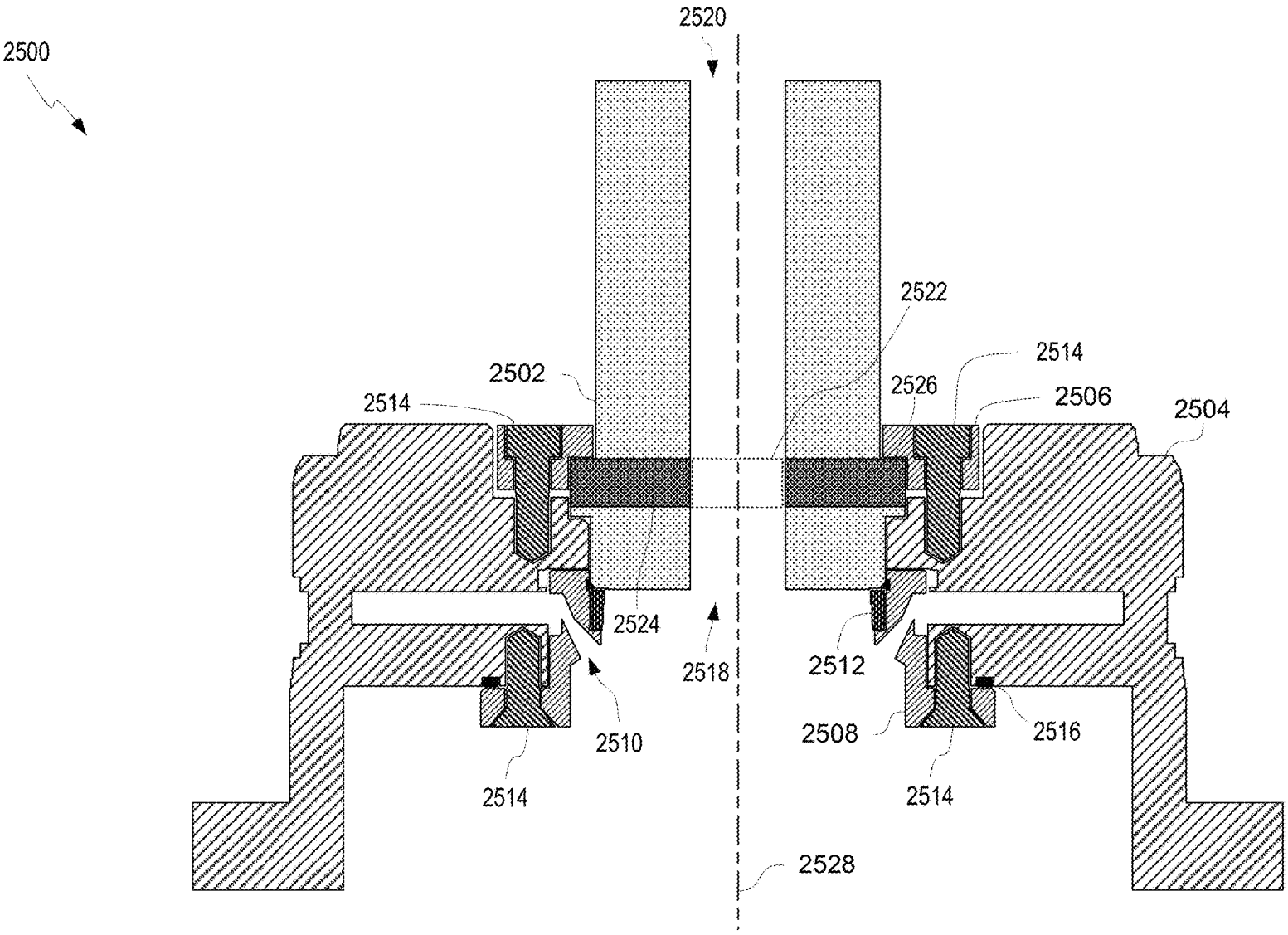
FIG. 25 is a cross-sectional view of a metal casting system for casting billets according to certain aspects of the present disclosure.

FIG. 25 is a cross-sectional view of a metal casting system 2500 for casting billets according to certain aspects of the present disclosure. The metal casting system 2500 can include a thimble 2502 for continuously casting circular billets using certain techniques described herein. The thimble 2502 can be made of a ceramic material, such as a refractory ceramic, although other suitable materials can be used. The thimble 2502 can be secured to a mold body 2504 by a retaining ring 2506. The mold body 2504 and retaining ring 2506 can be made of aluminum, although other suitable materials can be used. The metal casting system 2500 can include a mold insert 2508 designed to cool the molten metal passing through and out of the thimble 2502 using circulated coolant fluid (e.g., water) passing around and/or within the mold insert 2508, as well as ejecting out of the mold insert 2508 through ports 2510. The mold insert 2508 can be aluminum or other suitable material. A mold liner 2512 can be located between the mold insert 2508 and the molten metal at the point where the molten metal exits the thimble 2502. The molten metal can solidify an outer layer when contacting the mold liner 2512, after which remaining heat is extracted by impingement of coolant onto this shell as the billet is physically extracted from the mold liner 2508. The mold liner 2512 can be made of graphite or any other suitable material. Various fasteners 2514 can be used to retain the various parts onto the mold body 2504. O-rings 2516 can be positioned to seal joints against leakage.

Molten metal from a metal source passes through a passageway 2520 within thimble 2502 and into the mold insert 2508. The thimble 2502 can have an exit opening 2518 that is smaller than the diameter of the mold insert 2508, specifically the inner diameter of the mold liner 2512.

The thimble 2502 can include any suitable flow control device, as described above. As shown in FIG. 25, thimble 2502 includes a flow control device including at least one magnetic source (not shown) for generating a magnetic field through the passageway 2520. The magnetic source can be a pair of static (e.g., non-rotating) permanent magnets positioned adjacent and/or within a portion of the thimble 2502. The magnetic source can generate a magnetic field through the passageway 2520 generally in to or out of the page, as seen in FIG. 25, at location 2522. The flow control device can further include a pair of electrodes 2524, 2526 located in the thimble 2502 adjacent location 2522. Each electrode 2524, 2526 can be positioned to make contact with the passageway 2520, allowing an electrical current to pass from one electrode 2524, through the molten metal within the passageway 2520, to the other electrode 2526. Electrodes 2524, 2526 can be made of any suitable material capable conducting electricity, such as graphite, titanium, tungsten, and niobium. By passing an electrical current through location 2522 while simultaneously generating a magnetic field through location 2522, the flow control device can induce force (e.g., pressure) in a forwards or backwards direction along longitudinal axis 2528 based on Fleming's law. For example, a magnetic field directed into the page, as seen in FIG. 25, combined with an electrical current passing from electrode 2524 to electrode 2526 can generate forces to increase pressure and flow of molten metal from the metal source, through the thimble 2502, and to the mold insert 2508 and mold liner 2512. As described above, DC or AC current can be used as desired.

In some circumstances, cooling equipment can be placed adjacent the magnets in order to cool the magnets to a desired operating temperature.

Figure 26:
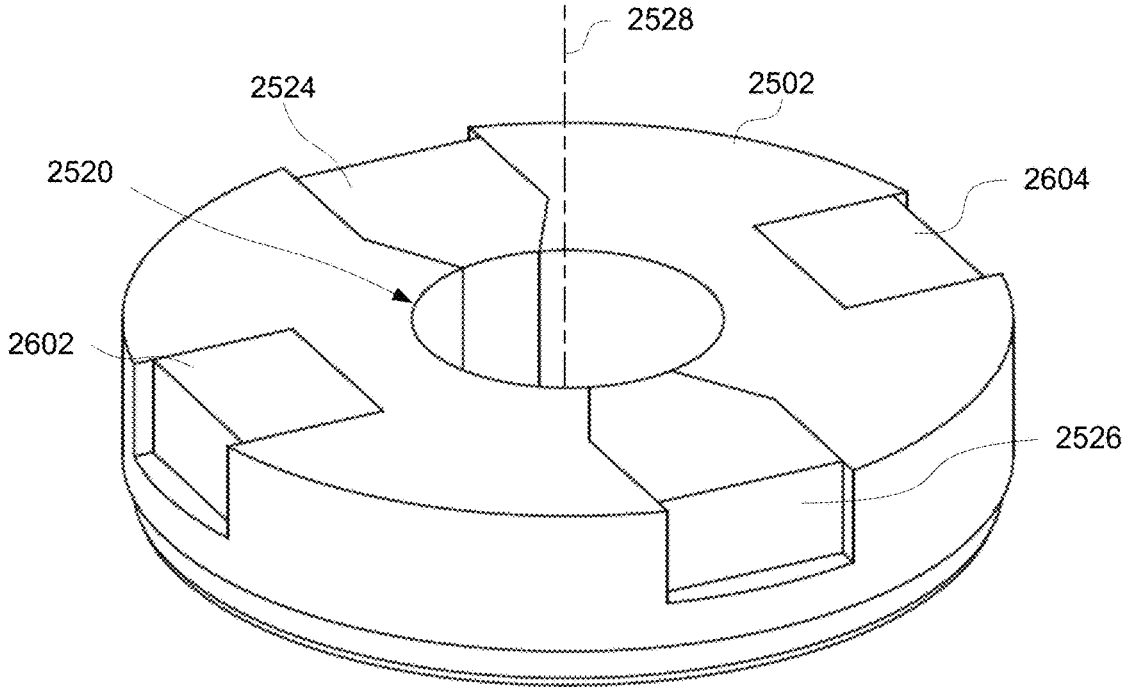
FIG. 26 is a perspective view of a portion of the thimble of FIG. 25, according to certain aspects of the present disclosure.

FIG. 26 is a perspective view of a portion of the thimble 2502 of FIG. 25, according to certain aspects of the present disclosure. The thimble 2502 is seen as cut laterally. Permanent magnets 2602, 2604 are seen positioned on opposite sides of passageway 2520. Electrodes 2524, 2526 are seen positioned on opposite sides of the passageway 2520, 90° offset from permanent magnets 2602, 2604. While electrodes 2524, 2526 and permanent magnets 2602, 2604 are shown on a single lateral plane perpendicular to the longitudinal axis 2528, they may be located on different planes and the planes may not necessarily be perpendicular with the longitudinal axis 2528 (e.g., when it is desired to induce flow in a direction other than forwards or backwards along the longitudinal axis 2528).

Electrodes 2524, 2526 are shown as penetrating the inner wall of the passageway 2520, since electrodes 2524, 2526 must come into electrical contact with the molten metal within the passageway 2520. Permanent magnets 2602, 2604 need not penetrate the inner wall of the passageway 2520. The orientation of the electrodes 2524, 2526 (e.g., a line extending between the electrodes 2524, 2526) can be positioned perpendicular to the orientation of the permanent magnets 2602, 2604 (e.g., a line extending between the permanent magnets 2602, 2604).

FIGS. 27-30 depict different types of thimbles having exit openings with different shapes to provide different outflows of molten metal. The different outflows across these figures can change the shape, direction, flow rate, and other factors of the outflow. The different exit openings can be used alone, or in conjunction with the flow control devices disclosed herein. While shown with flow control devices using magnet sources and electrodes, other flow control devices disclosed herein can be used with these different types of thimbles.

Figure 27:
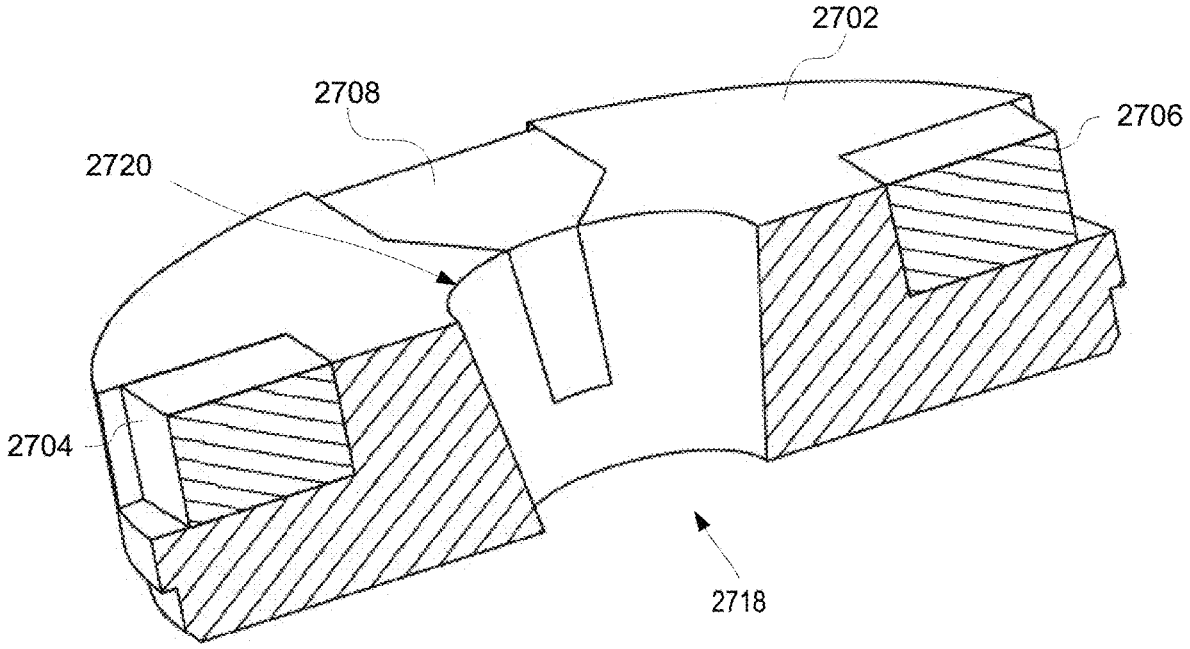
FIG. 27 is a perspective, cross-sectional view of a portion of a thimble with an angled passageway according to certain aspects of the present embodiment.

FIG. 27 is a cross-sectional view of a portion of a thimble 2702 with an angled passageway 2720 according to certain aspects of the present embodiment. The thimble 2702 can be similar to the thimble 2502 of FIG. 25, except that its passageway 2720 can be angled such that the diameter of the passageway decreases linearly for a portion of the passageway near the exit. Specifically, the portion of the passageway that is angled can be located between the permanent magnets 2704, 2706 and electrodes 2708. The passageway 2720 can be angled such that the smallest diameter of the passageway is at the exit opening 2718.

Figure 28:
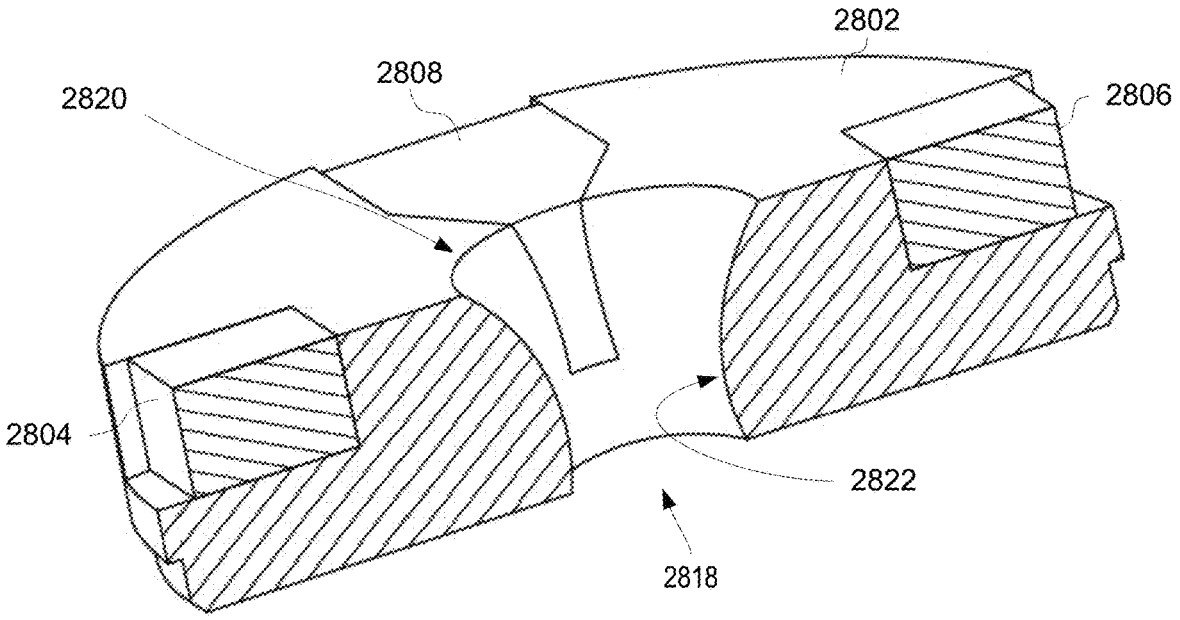
FIG. 28 is a perspective, cross-sectional view of a portion of a thimble with a passageway that is lofted, or curved, according to certain aspects of the present embodiment.

FIG. 28 is a cross-sectional view of a portion of a thimble 2802 with a passageway 2820 that is lofted, or curved, according to certain aspects of the present embodiment. The thimble 2802 can be similar to the thimble 2502 of FIG. 25, except that its passageway 2820 can be lofted, or curved, such that the diameter of the passageway decreases to a restriction 2822, then increases again. These changes in diameter can occur for a portion of the passageway near the exit. Specifically, the portion of the passageway 2820 that is lofted, or curved, can be located between the permanent magnets 2804, 2806 and electrodes 2808. In some cases, the portion just before the restriction 2822 and/or the restriction 2822 itself can be located between the permanent magnets 2804, 2806 and electrodes 2808. The restriction 2822 can be located proximally of the exit opening 2818, such that molten metal passing through the passageway 2820 will pass through the restriction 2820 and through a small portion of passageway 2820 of increasing in diameter with respect to the restriction 2820 before exiting the exit opening 2818.

Figure 29:
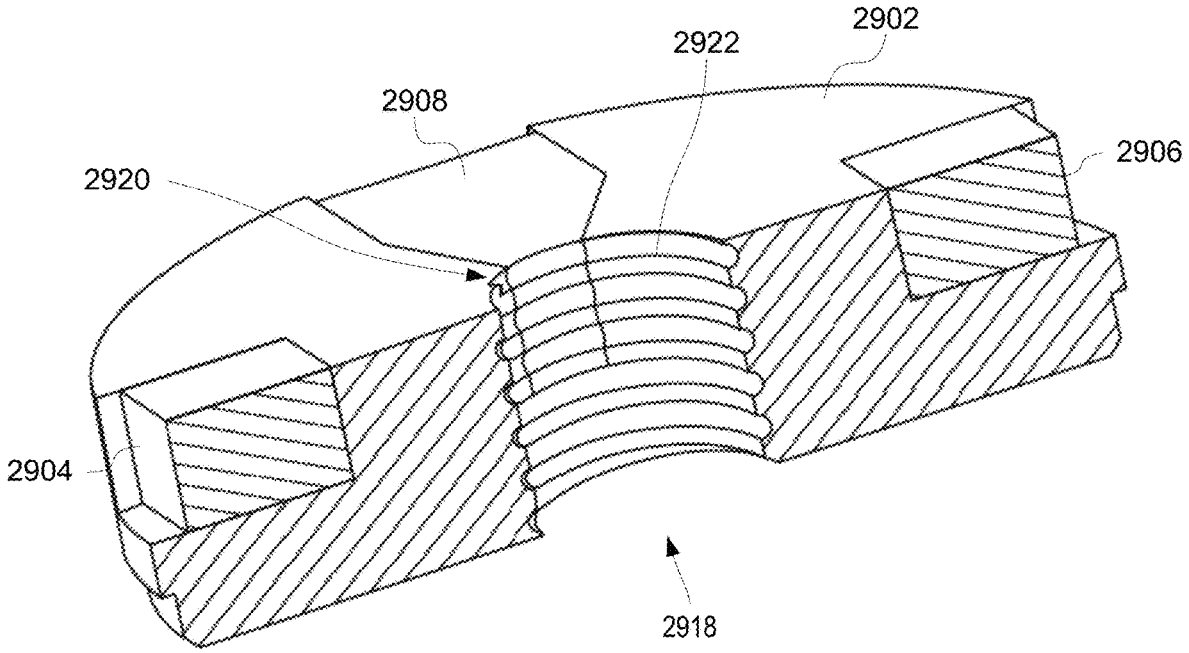
FIG. 29 is a perspective, cross-sectional view of a portion of a thimble with a threaded passageway according to certain aspects of the present embodiment.

FIG. 29 is a cross-sectional view of a portion of a thimble 2902 with a threaded passageway 2920 according to certain aspects of the present embodiment. The thimble 2902 can be similar to the thimble 2502 of FIG. 25, except that its passageway 2920 can include threads 2922 along its inner diameter for at least a portion of the passageway near the exit. Specifically, the portion of the passageway 2920 that is threaded can be located between the permanent magnets 2904, 2906 and electrodes 2908. In some cases, the entire passageway 2920 can be threaded. In some cases, only a portion of the passageway 2920 extending from at or near the exit opening 2918 to or past the permanent magnets 2904, 2906 and electrodes 2908 is threaded.

Figure 30:
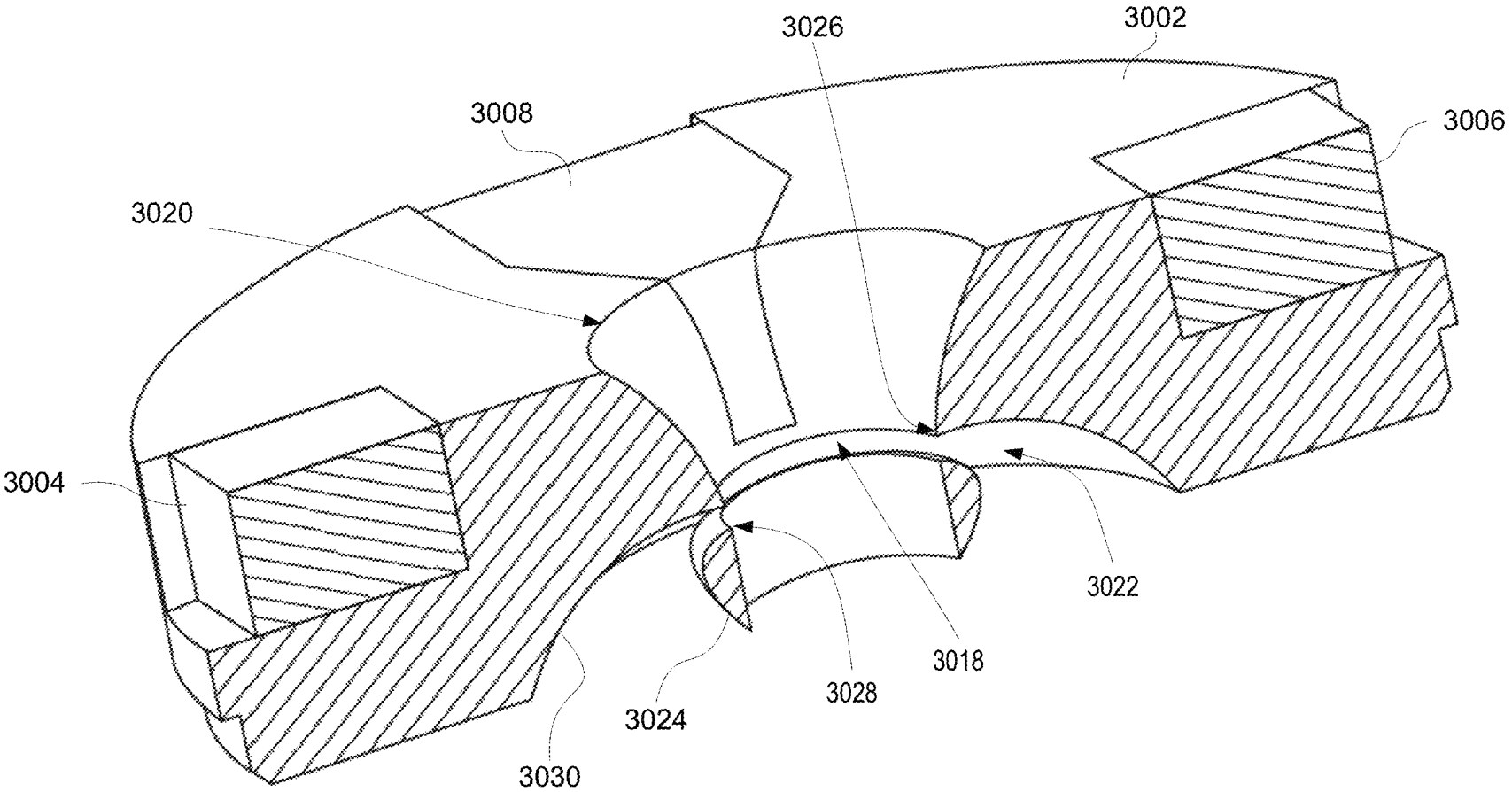
FIG. 30 is a perspective, cross-sectional view of a portion of a thimble having an eductor nozzle according to certain aspects of the present embodiment.

FIG. 30 is a cross-sectional view of a portion of a thimble 3002 having an eductor nozzle 3024 according to certain aspects of the present embodiment. The thimble 3002 can be similar to any of thimbles 2502, 2702, 2802, 2902 of FIGS. 25-29. As shown, the thimble 3002 has a lofted passageway 3020 that ends at a restriction 3026, although the thimble 3002 could take other shapes.

An eductor nozzle 3024 is positioned adjacent the exit opening 3018 of the thimble 3002. The eductor nozzle 3024 can be held in place by spars (not shown) or other connections. These spars or other connections can coupled the eductor nozzle 3024 to the thimble 3002 or to another structure (e.g., a mold body, a mold liner, a mold insert, or other part). The eductor nozzle 3024 is held in a spaced apart relationship with the exit opening 3018 to provide a supplemental opening 3022. The entry diameter 3028 of the eductor nozzle 3024 can be equal to and/or larger than the diameter of the exit opening 3018. As molten metal flows out of the exit opening 3018 and through the eductor nozzle 3024, supplemental metal flow can pass in through the supplemental opening 3022 and be carried out through the eductor nozzle 3024 with the primary metal flow (e.g., the metal flowing through the passageway 3020 and out the exit opening 3018.

The eductor nozzle 3024 can be shaped to decrease in internal diameter from its entry to its exit (e.g., generally from top to bottom, as seen in FIG. 30). Other shapes can be used, such a shape having a restriction between the entry and exit (e.g., a shape that decreases and then increases in diameter generally from top to bottom, as seen in FIG. 30).

In some embodiments, the eductor nozzle 3024 is positioned in a recess 3030 of the thimble 3002. The recess 3030 can be shaped to allow molten metal in the metal sump of the forming billet to flow into the supplemental openings 3022, as described above. In some embodiments, the flow control device (e.g., magnets 3004, 3006 and electrodes 3008) are positioned sufficiently distally along the thimble 3008 (e.g., generally down as seen in FIG. 30) such that they can effect the flow of molten metal within the recess 3030.

In some cases, additional electrodes (not shown) are installed in the recess 3030 to provide the same or a different force to the molten metal in the recess 3030 as compared to the force being provided to the molten metal in the passageway 3020 by electrodes 3008. In such cases, electrodes 3008 can provide current in one direction to provide force to push molten metal in the passageway 3020 down and through the exit opening 3018, while additional electrodes (not shown) can provide current in an opposite direction to provide force to push molten metal in the recess 3030 upwards and through the supplemental openings 3022. When additional electrodes are used, the magnets 3004, 3006 or other suitable magnetic source(s) can be positioned to generate a magnetic field through both the passageway 3020 and the recess 3030.

The various thimble designs described with reference to FIGS. 25-30 can improve homogenization of temperature and composition of the molten metal, can minimize macrosegregation, can optimize grain size (e.g., through increased ripening of grains), and can improve sump shape in the forming billet.

FIGS. 31-50 are graphs depicting the dendrite arm spacing of products made with and without using the techniques described herein. FIGS. 31-35 and 41-45 represent an ingot cast without using the techniques described herein ("Normal Sample"), whereas FIGS. 36-40 and 46-50 represent an ingot cast using the techniques described herein ("Enhanced Sample"). Two ingots were cast in a 600 mm×1750 mm Low Head Composite (LHC) casting mold with the direct chill (DC) process. A traditional 0.10% Si, 0.50% Fe purity (P1050) was solidified with the absence of any additional grain refiners or modifiers other than what is commonly found with P1020 alloyed up to a 0.50% Fe purity. Neither batch contained any material from the previous ingots cast, assuring that there was absolutely no micron-sized particle grain stimuli available to modify the solidification conditions in the ingot sump. The molten metal was degassed with a commercially available aluminum compact degasser (ACD). The molten metal was subsequently filtered with a reticulated ceramic foam filter with a nominal opening of 50 Pores Per Inch (ppi). After filtration, the molten metal was introduced into an LHC casting mold. Steady State conditions were, for both examples in this comparison, 60 mm/minute lowering velocity with a temperature of 695-700° C. as measured by a Type K thermocouple in the trough directly above the mold. The metal level in the mold, measured in the vertical direction up from the water to hot ingot surface contact point was 57 mm. The tip of the downspout was submerged 50 mm into the metal sump.

The Normal Sample ingot was cast by distributing metal into a thermally-formed combo bag (e.g., a distribution bag), which distributes metal out toward the short face of the ingot. Metal flow into the molten sump or ingot cavity was regulated by a conventional pin which, when open, allows metal under metal static pressure to fill the distribution bag and flow out to the short face of the ingot mold.

The Enhanced Sample ingot was cast without a combo bag, but instead using an eductor nozzle, such as those described in further detail above (see, FIG. 1, for example). Metal flow into the molten sump or ingot cavity was again regulated by a conventional pin and downspout combination, but in addition to metal static pressure, the metal in the spout was pressurized with a permanent-magnet based pump (e.g., flow control device), such as those described above. The increased flow velocity and momentum generated by the eductor nozzle and/or permanent-magnet based pump was clearly seen by the naked eye, during casting, at the head of the ingot.

Both ingots were sectioned in the 600 mm×1750 mm section, machined, and polished prior to etching with a Tri-Acid Etch (e.g., equal parts of HCl, HNO3, and water, with roughly 3 ml of HF per hundred mL of water). Samples were then photographed and microstructural samples were prepared from adjacent slices at sequential distances extending from the center of the slice.

Figure 31:
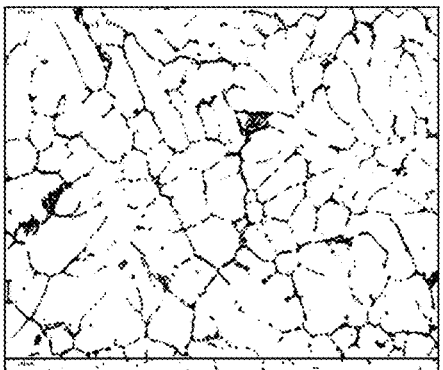
FIGS. 31-35 are micrographic images showing dendrite arm spacing of sequentially shallower portions, from the center to the surface, of a section of a sample ingot cast without using the techniques described herein.
Figure 32:
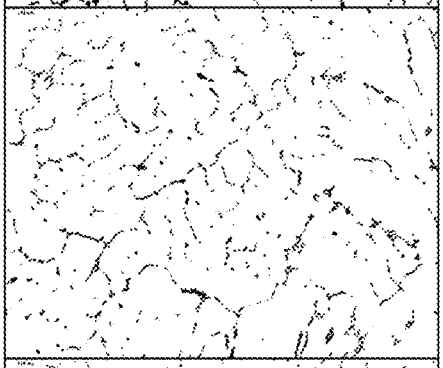
Figure 33:
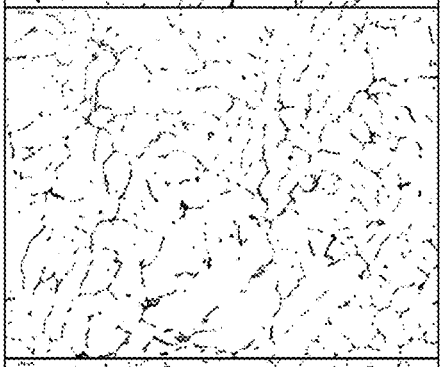
Figure 34:
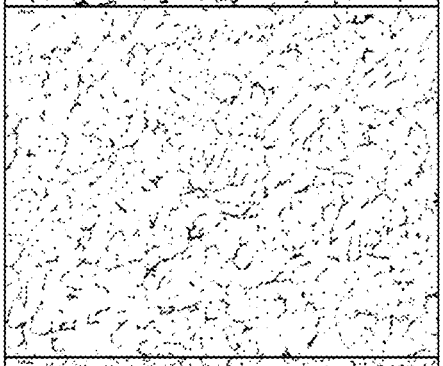
Figure 35:
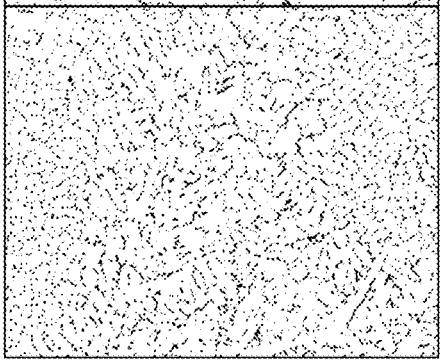

FIGS. 31-35 are micrographic images of different portions of a section of the Normal Sample ingot according to certain aspects of the present disclosure. Each micrographic image is taken at the lateral center (e.g., center of the rolling face or width of the ingot), but at different depths. FIG. 31 shows the lateral center of the ingot at a depth near the geometric center of the ingot. FIGS. 32-35 show consecutively shallower portions of the ingot, with FIG. 35 showing a portion of the ingot proximate the surface of the ingot. FIG. 31 shows the average dendrite arm spacing of the Normal Sample is approximately 72.63 microns near the center of the ingot. FIG. 32 shows the dendrite arm spacing of the Normal Sample is approximately 80.37 microns further towards the surface of the ingot. FIG. 33 shows the dendrite arm spacing of the Normal Sample is approximately 49.85 microns further towards the surface of the ingot. FIG. 34 shows the dendrite arm spacing of the Normal Sample is approximately 37.86 microns further towards the surface of the ingot. FIG. 35 shows the dendrite arm spacing of the Normal Sample is approximately 30.52 microns near the surface of the ingot. The variation in dendrite arm spacing from the center to the surface is large, ranging from about 73 microns to about 30 microns. The average dendrite arm spacing is about 54.2 microns with a standard deviation of about 19.3.

Figure 36:
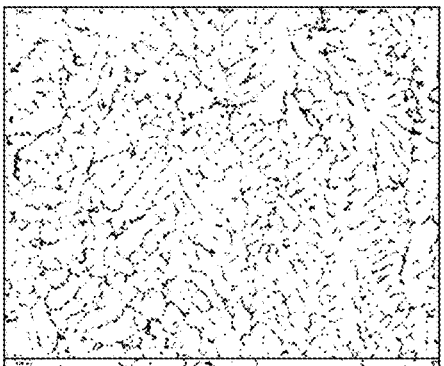
FIGS. 36-40 are micrographic images, taken at locations corresponding to the locations of FIGS. 31-35, showing dendrite arm spacing of sequentially shallower portions, from the center to the surface, of a section of a sample ingot cast using the techniques described herein according to certain aspects of the present disclosure.
Figure 37:
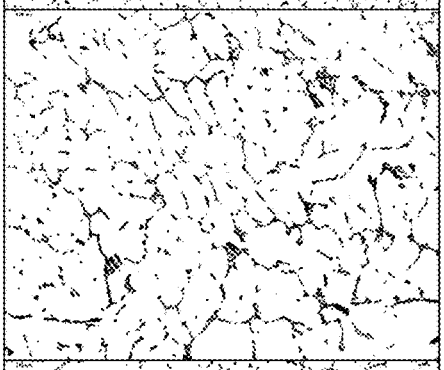
Figure 38:
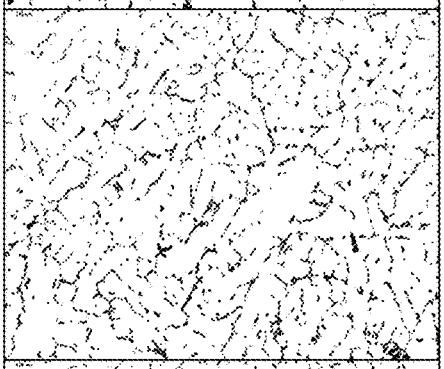
Figure 39:
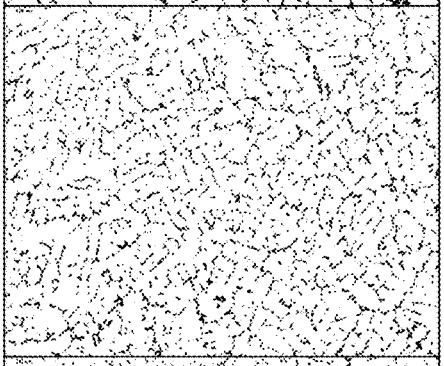
Figure 40:
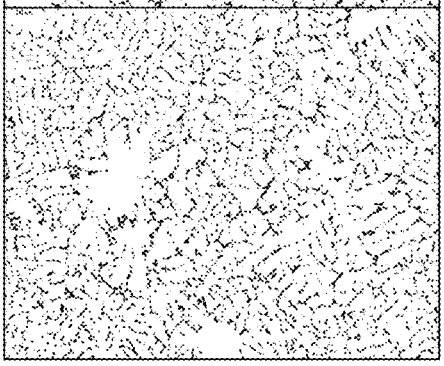

FIGS. 36-40 are micrographic images of different portions of a section of the Enhanced Sample ingot according to certain aspects of the present disclosure. Each image of FIGS. 36-40 are taken at locations of the Enhanced Sample that correspond with the locations of FIGS. 31-35 for the Normal Sample. FIG. 36 shows the average dendrite arm spacing of the Enhanced Sample is approximately 27.76 microns near the center of the ingot. FIG. 37 shows the dendrite arm spacing of the Enhanced Sample is approximately 39.46 microns further towards the surface of the ingot. FIG. 38 shows the dendrite arm spacing of the Enhanced Sample is approximately 29.09 microns further towards the surface of the ingot. FIG. 39 shows the dendrite arm spacing of the Enhanced Sample is approximately 20.22 microns further towards the surface of the ingot. FIG. 40 shows the dendrite arm spacing of the Enhanced Sample is approximately 18.88 microns near the surface of the ingot. The variation in dendrite arm spacing from the surface to center is relatively small, ranging from only about 19 microns to about 28 microns (with an intermediate maximum of about 39 microns). The average dendrite arm spacing is about 27.1 microns with a standard deviation of about 7.4. These types of smaller average dendrite arm spacing and/or less variation in dendrite arm spacing can be indicative that a cast product has been prepared using the techniques described herein.

Figure 41:
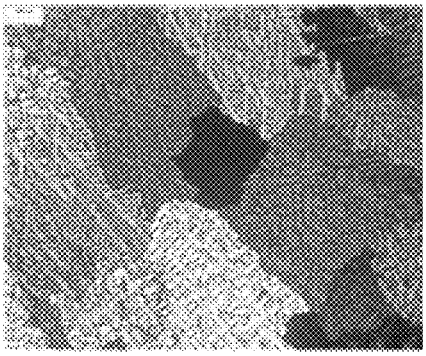
FIGS. 41-45 are micrographic images, taken at locations corresponding to the locations of FIGS. 31-35, showing grain sizes of sequentially shallower portions, from the center to the surface, of a section of a sample ingot cast without using the techniques described herein.
Figure 42:
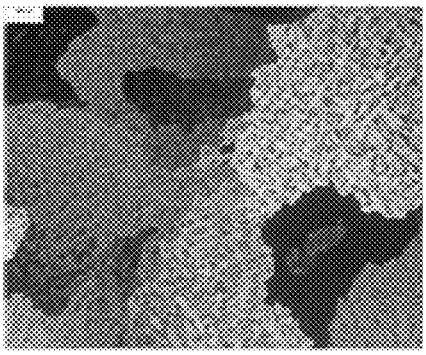
Figure 43:
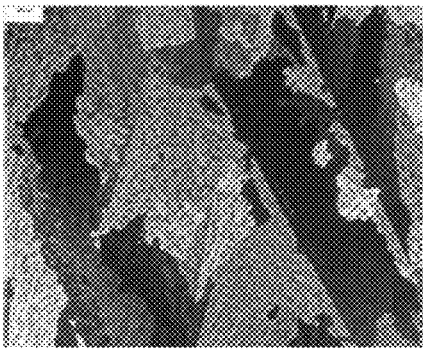
Figure 44:
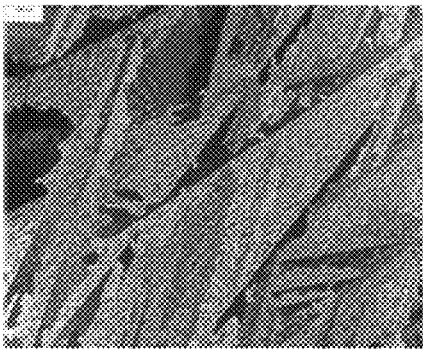
Figure 45:
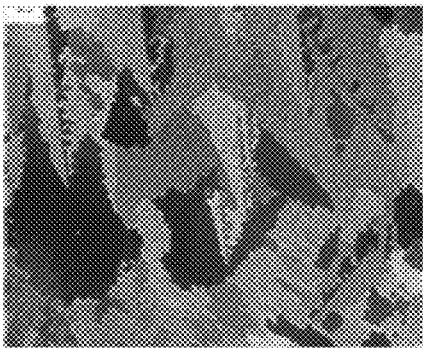

FIGS. 41-45 are micrographic images of different portions of the section of the Normal Sample ingot shown in FIGS. 31-35 according to certain aspects of the present disclosure. Each image of FIGS. 41-45 are taken at locations that correspond with the locations of FIGS. 31-35. FIG. 41 shows the average grain size of the Normal Sample is approximately 1118.01 microns near the center of the ingot. FIG. 42 shows the average grain size of the Normal Sample is approximately 1353.38 microns further towards the surface of the ingot. FIG. 43 shows the average grain size of the Normal Sample is approximately 714.29 microns further towards the surface of the ingot. FIG. 44 shows the average grain size of the Normal Sample is approximately 642.85 microns further towards the surface of the ingot. FIG. 45 shows the average grain size of the Normal Sample is approximately 514.29 microns near the surface of the ingot. The variation in grain size from the surface to center is large, ranging from about 514 microns to about 1118 microns. The average grain size is about 868.6 microns with a standard deviation of about 315.4.

Figure 46:
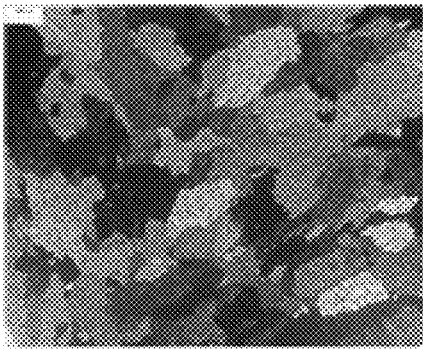
FIGS. 46-50 are micrographic images, taken at locations corresponding to the locations of FIGS. 31-35, showing grain sizes of sequentially shallower portions, from the center to the surface, of a section of a sample ingot cast using the techniques described herein according to certain aspects of the present disclosure.
Figure 47:
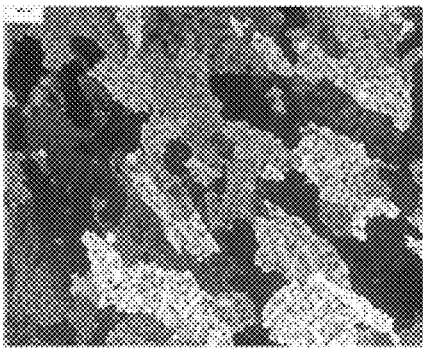
Figure 48:
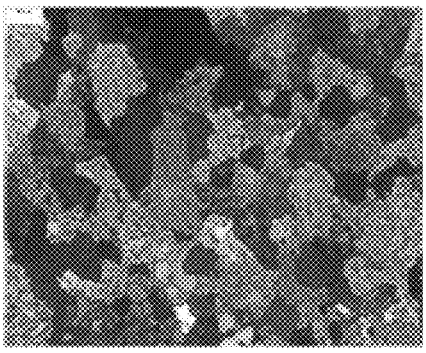
Figure 49:
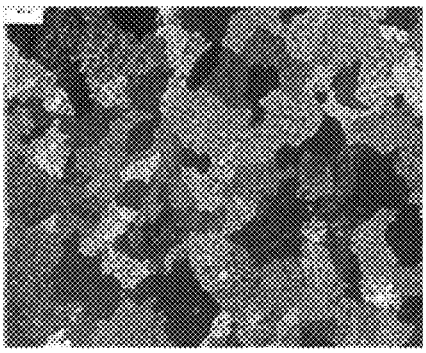
Figure 50:
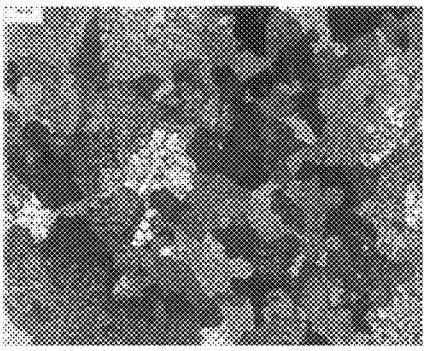

FIGS. 46-50 are micrographic images of different portions of a section of the Enhanced Sample ingot according to certain aspects of the present disclosure. Each image of FIGS. 46-50 are taken at locations of the Enhanced Sample that correspond with the locations of FIGS. 41-45 for the Normal Sample. FIG. 46 shows the average grain size of the Enhanced Sample is approximately 362.17 microns near the center of the ingot. FIG. 47 shows the average grain size of the Enhanced Sample is approximately 428.57 microns further towards the surface of the ingot. FIG. 48 shows the average grain size of the Enhanced Sample is approximately 342.85 microns further towards the surface of the ingot. FIG. 49 shows the average grain size of the Enhanced Sample is approximately 321.42 microns further towards the surface of the ingot. FIG. 50 shows the average grain size of the Enhanced Sample is approximately 306.12 microns near the surface of the ingot. The variation in grain size from the surface to center is relatively small, ranging from only about 306 microns to about 362 microns (with an intermediate maximum of about 429 microns). The average grain size is about 352.2 microns with a standard deviation of about 42.6. The clear benefit of the techniques described herein on grain size (e.g., smaller average grain size and/or less variation in grain size throughout and ingot) can be easily seen when comparing the Enhanced Sample to the Normal Sample.

FIGS. 51-54 are charts depicting various measurements for grain size and macrosegregation deviation for another set of normal (Normal Sample') and enhanced samples (Enhanced Sample'). The samples for which the data is shown in FIGS. 51-54 were prepared in a manner similar to the Normal and Enhanced Samples of FIGS. 31-50, in that the Normal Sample' was cast using a combo bag and conventional pin and spout, whereas the Enhanced Sample' was cast without the use of a combo bag but instead using an eductor nozzle (such as that shown in FIG. 1). However, for the data shown in FIGS. 51-54, the alloy and/or casting parameters differed.

Figure 51:
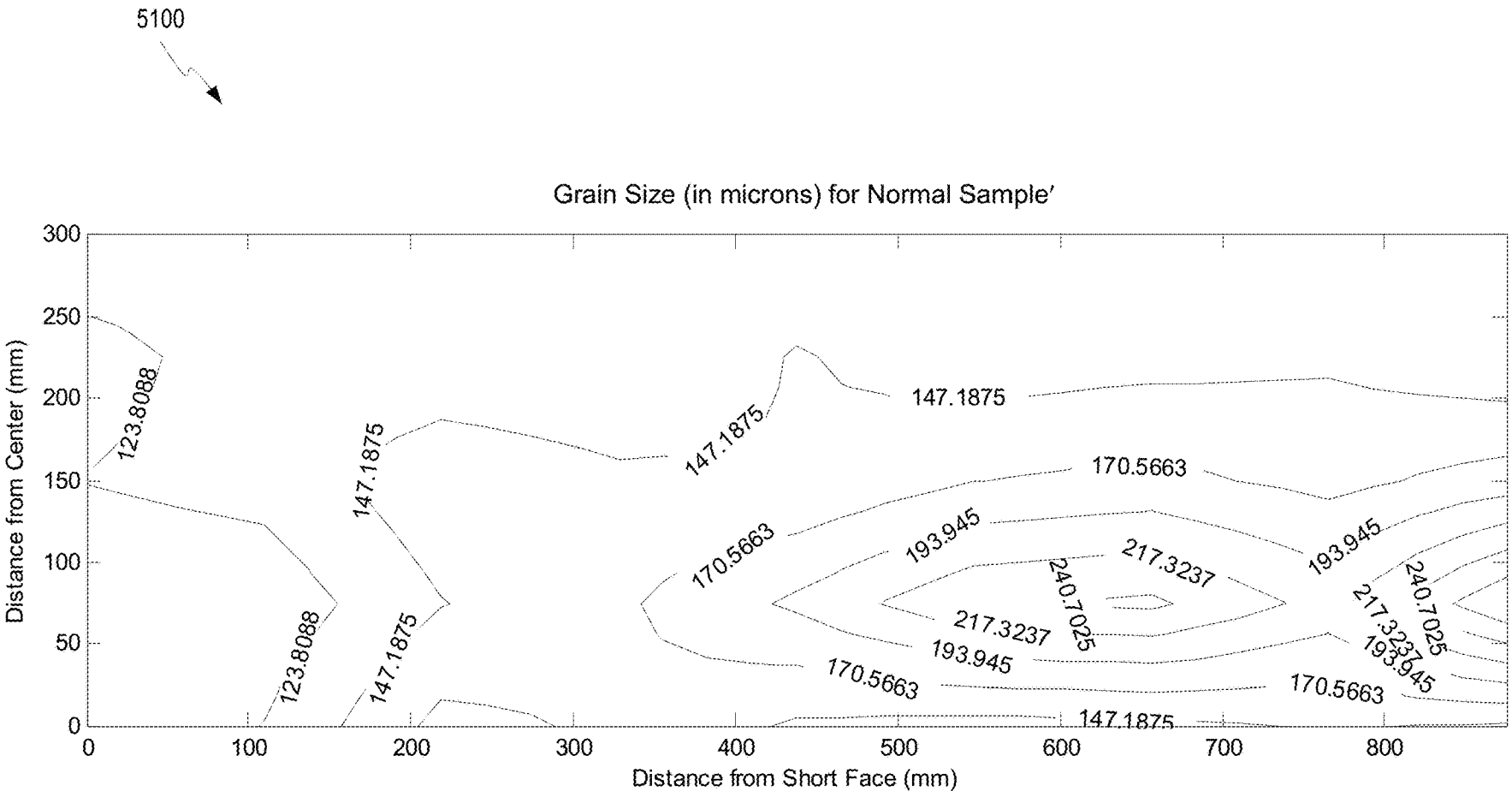
FIG. 51 is a chart depicting grain size for a Normal Sample' according to certain aspects of the present disclosure.

FIG. 51 is a chart 5100 depicting grain size for the Normal Sample' according to certain aspects of the present disclosure. The top left corner of the chart 5100 represents the top left corner of a section of the ingot, whereas the bottom right corner of the chart 5100 represents the center of the section of the ingot (e.g., the center of the ingot itself). The grain sizes extend from very large (e.g., approximately 220 microns) to moderately small (e.g., approximately 120 microns).

Figure 52:
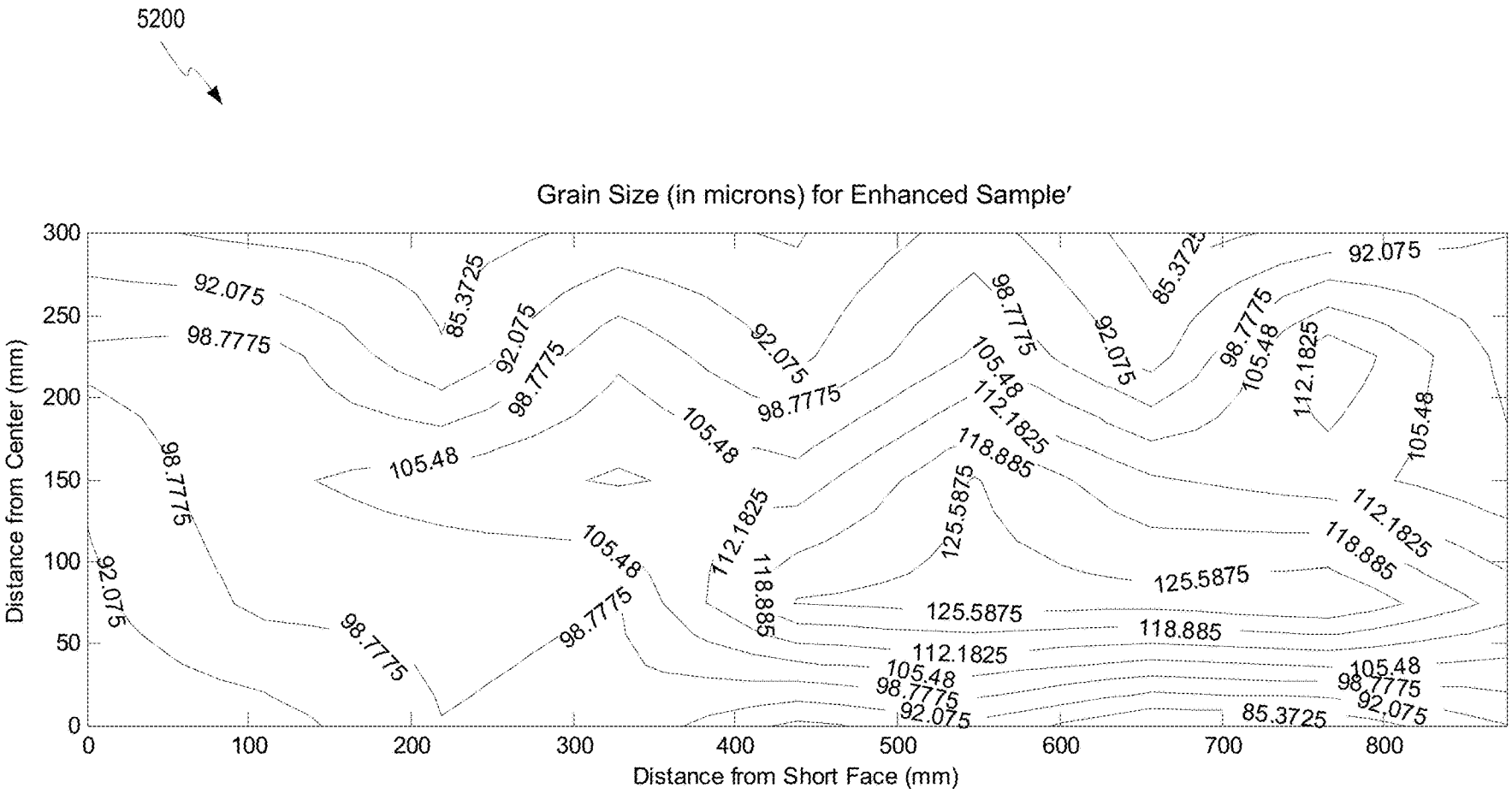
FIG. 52 is a chart depicting grain size for an Enhanced Sample' according to certain aspects of the present disclosure.

FIG. 52 is a chart 5200 depicting grain size for the Enhanced Sample' according to certain aspects of the present disclosure. The locations in the chart 5200 correspond to the same locations in chart 5100 for the Normal Sample' of FIG. 51. The grain sizes are all present around 90-120 microns, without substantial variation throughout the section. The clear benefit of the techniques described herein on grain size (e.g., smaller average grain size and/or less variation in grain size) can be easily seen when comparing the Enhanced Sample' to the Normal Sample'.

Figure 53:
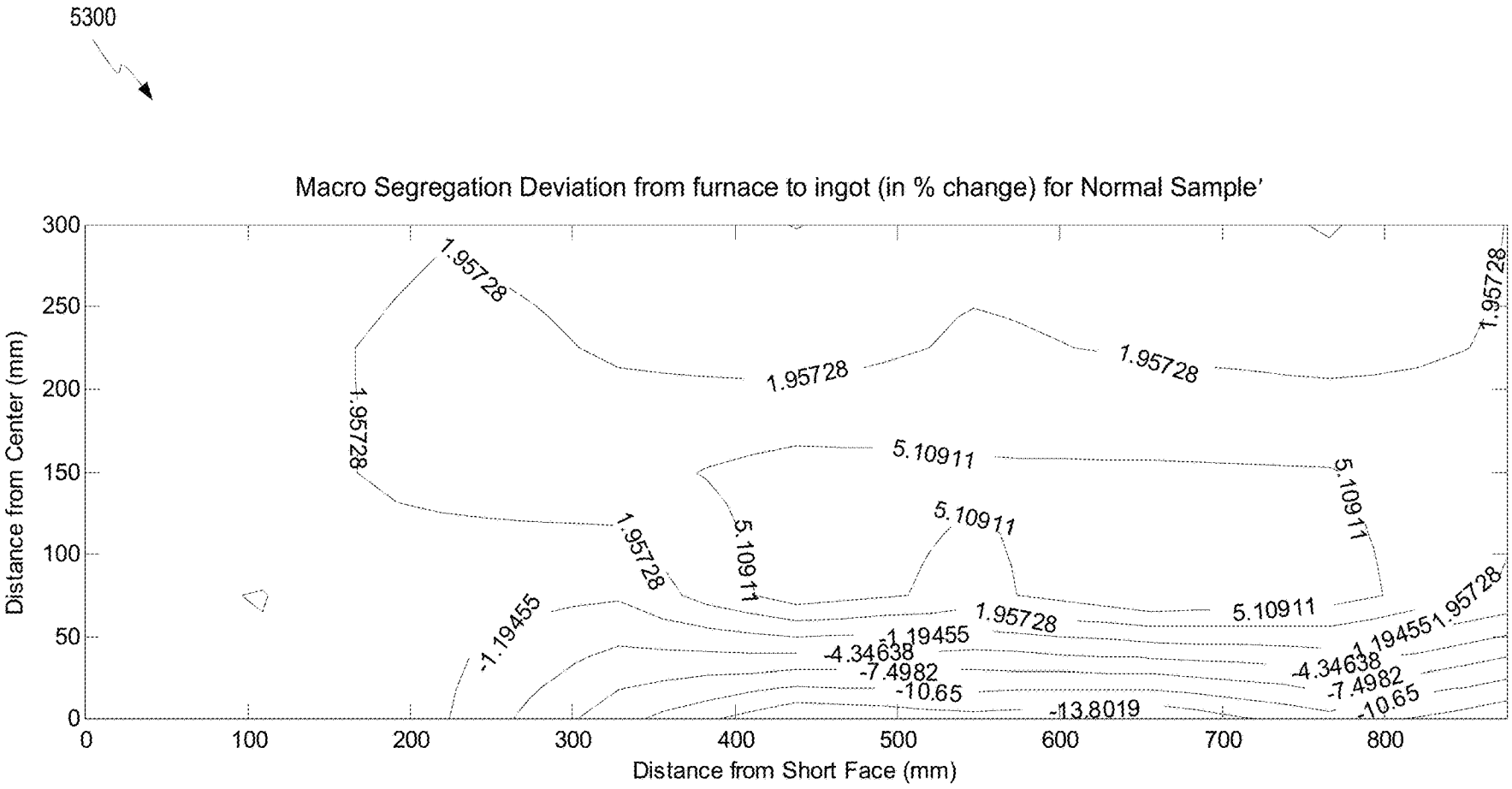
FIG. 53 is a chart depicting macrosegregation deviation for the Normal Sample' of FIG. 51 according to certain aspects of the present disclosure.

FIG. 53 is a chart 5300 depicting macrosegregation deviation for the Normal Sample' according to certain aspects of the present disclosure. As used herein, macrosegregation deviation is the percent deviation throughout the cast ingot from the intended alloy composition. The locations in the chart 5300 correspond to the same locations in chart 5100 of FIG. 51. The top left corner of the chart 5300 represents the top left corner of a section of the ingot, whereas the bottom right corner of the chart 5300 represents the center of the section of the ingot (e.g., the center of the ingot itself). The macrosegregation deviations extend from very large (e.g., approximately 5%) to highly negative (e.g., approximately −10%).

Figure 54:
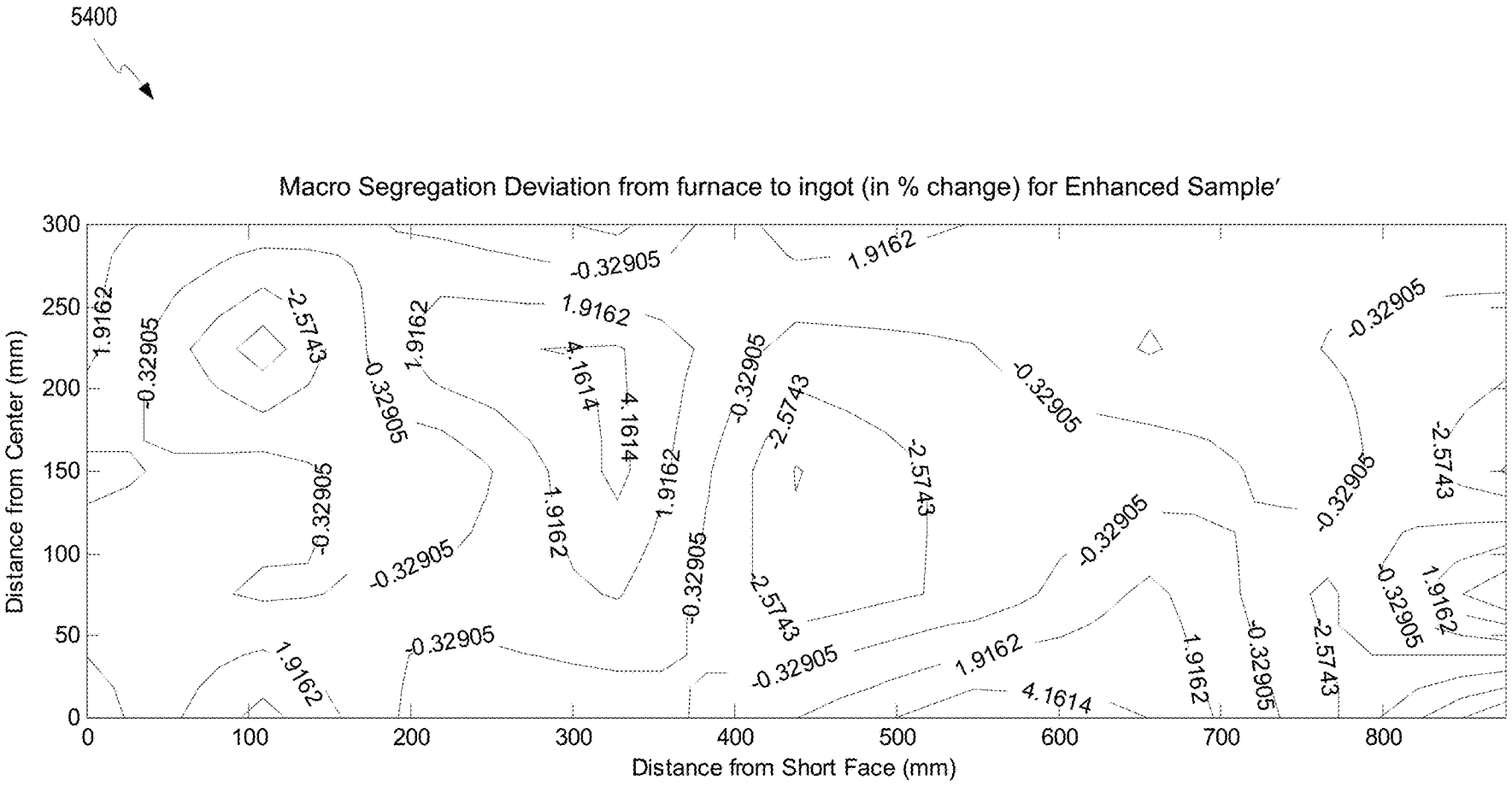
FIG. 54 is a chart depicting macrosegregation deviation for the Enhanced Sample' of FIG. 52 according to certain aspects of the present disclosure.

FIG. 54 is a chart 5400 depicting macrosegregation deviation for the Enhanced Sample' according to certain aspects of the present disclosure. The locations in the chart 5400 correspond to the same locations in chart 5300 for the Normal Sample' of FIG. 53. The top left corner of the chart 5400 represents the top left corner of a section of the ingot, whereas the bottom right corner of the chart 5400 represents the center of the section of the ingot (e.g., the center of the ingot itself). The macrosegregation deviations are much smaller (e.g., from about 4% to about −2%) and much more consistent overall. The clear benefit of the techniques described herein on macrosegregation deviation (e.g., smaller average macrosegregation deviation and/or less variation in macrosegregation deviation) can be easily seen when comparing the Enhanced Sample' to the Normal Sample'.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a system comprising a feed tube couplable to a source of molten metal; a primary nozzle located at a distal end of the feed tube, wherein the primary nozzle is submersible in a molten sump for delivering the molten metal to the molten sump; and a secondary nozzle submersible in the molten sump and positionable adjacent the primary nozzle, wherein the secondary nozzle includes a restriction shaped to generate a low pressure area to circulate the molten sump in response to the molten metal from the source passing through the restriction.

Example 2 is the system of example 1 wherein the molten sump is liquid metal of an ingot being cast.

Example 3 is the system of example 1, wherein the molten sump is liquid metal within a furnace.

Example 4 is the system of examples 1-3, wherein the secondary nozzle is coupled to the primary nozzle.

Example 5 is the system of examples 1-4, additionally comprising a flow control device adjacent the feed tube for controlling flow of the molten metal through the primary nozzle.

Example 6 is the system of examples 5, wherein the flow control device includes one or more magnetic sources for generating a changing magnetic field within the feed tube.

Example 7 is the system of example 6, wherein the one or more magnetic sources is positioned to induce rotational movement of the molten metal within the feed tube.

Example 8 is the system of examples 5-7, further comprising a temperature control device positioned adjacent the feed tube for removing heat from the molten metal within the feed tube.

Example 9 is the system of example 8, further comprising a temperature probe adjacent the feed tube for measuring a temperature of the molten metal; and a controller coupled to the temperature probe and the temperature control device to adjust the temperature control device in response to the temperature measured by the temperature probe.

Example 10 is the system of examples 1-9, wherein the primary nozzle is rectangular in shape.

Example 11 is the system of examples 1-10, wherein the feed tube further includes a second primary nozzle located at the distal end of the feed tube, wherein the second primary nozzle is submersible in the molten sump for delivering the molten metal to the molten sump; and wherein the system further comprises a second secondary nozzle submersible in the molten sump and positionable adjacent the second primary nozzle, wherein the second secondary nozzle includes a second restriction shaped to generate a second low pressure area to circulate the molten sump in response to the molten metal from the source passing through the second restriction.

Example 12 is the system of example 11, additionally comprising a flow control device adjacent the feed tube for controlling flow of the molten metal through the primary nozzle and the second primary nozzle.

Example 13 is the system of example 12, wherein the flow control device includes a plurality of permanent magnets positioned around the feed tube for generating a magnetic field through the feed tube and a plurality of electrodes electrically coupled to a pathway within the feed tube for conducting an electrical current through the molten metal within the feed tube.

Example 14 is a system comprising a feed tube couplable to a source of molten metal; a nozzle located at a distal end of the feed tube, wherein the nozzle is submersible in a molten sump for delivering the molten metal to the molten sump; and a flow control device positioned adjacent the feed tube, wherein the flow control device includes at least one magnetic source for inducing movement of the molten metal within the feed tube.

Example 15 is the system of example 14, wherein the flow control device includes a plurality of permanent magnets positioned about at least one rotor, wherein a changing magnetic field is generated in response to rotation of the at least one rotor.

Example 16 is the system of example 15, wherein the feed tube has a lofted shape adjacent the flow control device, wherein the lofted shape corresponds to a shape of the changing magnetic field.

Example 17 is the system of examples 15 or 16, wherein a rotational axis of the at least one rotor is variable with respect to a longitudinal axis of the feed tube.

Example 18 is the system of examples 14-17, wherein the flow control device includes a stator, the stator including at least one first electromagnetic coil driven in a first phase, at least one second electromagnetic coil driven in a second phase, and at least one third electromagnetic coil driven in a third phase, wherein the first phase is offset from the second phase and the third phase by 120°, wherein the second phase is offset from the third phase by 120°, and wherein a changing magnetic field is generated in response to driving the stator.

Example 19 is the system of example 18, wherein the feed tube includes a helical screw, and wherein the changing magnetic field induces rotational movement in the molten metal within the feed tube.

Example 20 is the system of examples 14-19, wherein the movement of the molten metal is a rotational movement within the feed tube, and wherein the feed tube includes an inner wall shaped at an angle to generate longitudinal movement of the molten metal in the feed tube in response to the rotational movement of the molten metal in the feed tube.

Example 21 is the system of examples 14-20, further comprising a power source, wherein the feed tube includes a plurality of electrodes coupled to the power source for providing a current through the molten metal in the feed tube.

Example 22 is the system of examples 14-21, further comprising a temperature control device positioned adjacent the feed tube for removing heat from the molten metal within the feed tube.

Example 23 is the system of example 22, further comprising a temperature probe adjacent the feed tube for measuring a temperature of the molten metal; and a controller coupled to the temperature probe and the temperature control device to adjust the temperature control device in response to the temperature measured by the temperature probe.

Example 24 is the system of examples 14-23, further comprising a secondary nozzle submersible in the molten sump and positionable adjacent the nozzle, wherein the secondary nozzle includes a restriction shaped to generate a low pressure area to circulate the molten sump in response to the molten metal from the source passing through the restriction.

Example 25 is a method comprising delivering molten metal from a metal source to a metal sump through a feed tube; generating a changing magnetic field adjacent the feed tube; and inducing movement of the molten metal in the feed tube in response to generating the changing magnetic field.

Example 26 is the method of example 25, further comprising removing heat, by a temperature control device, from the molten metal in the feed tube; determining a percentage of solid metal in the molten metal; and controlling the temperature control device in response to determining the percentage of solid metal in the molten metal.

Example 27 is the method of examples 25 or 26, wherein delivering molten metal from the metal source includes generating a primary metal flow through a primary nozzle submersible in a molten sump; passing the primary metal flow through a secondary nozzle having a restriction; and generating supplemental inflow through the secondary nozzle in response to passing the primary metal flow through the secondary nozzle, wherein the supplemental inflow is sourced from the molten sump.

Example 28 is a method comprising delivering molten metal through a primary nozzle of a feed tube; passing the molten metal through a secondary nozzle positioned adjacent the primary nozzle and submersible within a molten sump; and inducing supplemental inflow through the secondary nozzle in response to passing the molten metal through the secondary nozzle, wherein the supplemental inflow is sourced from the molten sump.

Example 29 is an aluminum product having a crystalline structure with a maximum standard deviation of dendrite arm spacing at or below 16, the aluminum product obtained by delivering molten metal through a primary nozzle of a feed tube; passing the molten metal through a secondary nozzle positioned adjacent the primary nozzle and submersible within a molten sump; and inducing supplemental inflow through the secondary nozzle in response to passing the molten metal through the secondary nozzle, wherein the supplemental inflow is sourced from the molten sump.

Example 30 is the aluminum product of example 29, wherein the maximum standard deviation of dendrite arm spacing is at or below 10.

Example 31 is the aluminum product of example 29, wherein the maximum standard deviation of dendrite arm spacing is at or below 7.5.

Example 32 is the aluminum product of examples 29-31, wherein the average dendrite arm spacing is at or below 38 μm.

Example 33 is the aluminum product of examples 29-31, wherein the average dendrite arm spacing is at or below 30 μm.

Example 34 is the aluminum product of examples 29-33, wherein delivering molten metal through a primary nozzle includes inducing flow using a flow control device coupled to the feed tube.

Example 35 is an aluminum product having a crystalline structure with a maximum standard deviation of grain size at or below 200, the aluminum product obtained by delivering molten metal through a primary nozzle of a feed tube; passing the molten metal through a secondary nozzle positioned adjacent the primary nozzle and submersible within a molten sump; and inducing supplemental inflow through the secondary nozzle in response to passing the molten metal through the secondary nozzle, wherein the supplemental inflow is sourced from the molten sump.

Example 36 is the aluminum product of example 35, wherein the maximum standard deviation of grain size is at or below 80.

Example 37 is the aluminum product of example 35, wherein the maximum standard deviation of grain size is at or below 33.

Example 38 is the aluminum product of examples 35-37, wherein the average grain size is at or below 700 μm.

Example 39 is the aluminum product of examples 35-37, wherein the average grain size is at or below 400 μm.

Example 40 is the aluminum product of examples 35-39, wherein delivering molten metal through a primary nozzle includes inducing flow using a flow control device coupled to the feed tube.

Example 41 is the aluminum product of examples 35-40, wherein the maximum standard deviation of dendrite arm spacing is at or below 10.

Example 42 is the aluminum product of examples 35-40, wherein the maximum standard deviation of dendrite arm spacing is at or below 7.5.

Example 43 is the aluminum product of examples 35-40, wherein the average dendrite arm spacing is at or below 38 μm.

Example 44 is the aluminum product of examples 35-40, wherein the average dendrite arm spacing is at or below 30 μm.

Example 45 is an apparatus comprising a feed tube including a plate nozzle having a first plate and a second plate coupled together in parallel, wherein the feed tube includes a passageway for directing molten metal through the plate nozzle toward at least one exit nozzle.

Example 46 is the apparatus of example 45, further comprising a secondary nozzle submersible in a molten sump and positionable adjacent the at least one exit nozzle of the plate nozzle, wherein the secondary nozzle includes a restriction shaped to generate a low pressure area to circulate the molten sump in response to molten metal from the plate nozzle passing through the restriction.

Example 47 is the apparatus of example 46, wherein the secondary nozzle is removably couplable to the plate nozzle.

Example 48 is the apparatus of example 45, wherein the at least one exit nozzle includes two exit nozzles for directing the molten metal in non-parallel directions.

Example 49 is the apparatus of example 48, further comprising two secondary nozzles submersible in a molten sump, wherein each secondary nozzle is positionable adjacent a respective one of the two exit nozzles of the plate nozzle, wherein each of the two secondary nozzles includes a restriction shaped to generate a low pressure area to circulate the molten sump in response to molten metal from the respective ones of the two exit nozzles passing through the restriction.

Example 50 is the apparatus of examples 45-49, further comprising a flow control device coupled to the feed tube for controlling the flow of molten metal through the plate nozzle.

Example 51 is the apparatus of example 50, wherein the flow control device includes at least one static permanent magnet positioned adjacent the feed tube to generate a magnetic field through the passageway and a pair of electrodes positioned in the feed tube in contact with the passageway.

Example 52 is the apparatus of example 51, wherein the pair of electrodes and the at least one static permanent magnet are positioned such that the direction of the magnetic field and the direction of an electrical current passing through the pair of electrodes within the passageway are both oriented perpendicular to a length of the feed tube.

What is claimed is:

1. A method, comprising:

delivering molten metal through a primary nozzle of a feed tube couplable to a source of the molten metal, the primary nozzle located at a distal end of the feed tube, wherein the primary nozzle is submersible in a molten sump and includes an exit opening through which the molten metal passes;

passing the molten metal through a secondary nozzle positioned in alignment with the exit opening of the primary nozzle and submersible within the molten sump, wherein passing the molten metal through the secondary nozzle includes passing the molten metal from the exit opening of the primary nozzle and through a restriction of the secondary nozzle; and inducing supplemental inflow through the secondary nozzle in response to passing the molten metal from the exit opening of the primary nozzle through the secondary nozzle, wherein the supplemental inflow is sourced from the molten sump, and wherein inducing the supplemental inflow comprises generating a low pressure area within the restriction in response to the molten metal from the exit opening of the primary nozzle passing through the restriction of the secondary nozzle.

2. An aluminum product obtained by the method of claim 1 and having a crystalline structure with a maximum standard deviation of grain size at or below 200.

3. The aluminum product of claim 2, wherein the maximum standard deviation of grain size is at or below 80.

4. The aluminum product of claim 2, wherein the maximum standard deviation of grain size is at or below 33.

5. The aluminum product of claim 2, wherein an average grain size is at or below 700 μm.

6. The aluminum product of claim 2, wherein an average grain size is at or below 400 μm.

7. The aluminum product of claim 2, wherein delivering molten metal through the primary nozzle includes inducing flow using a flow control device coupled to the feed tube.

8. An apparatus, comprising:

a feed tube including a plate nozzle having a first plate and a second plate coupled together in parallel, wherein the feed tube defines a passageway for directing molten metal through the plate nozzle toward at least one exit nozzle; and a secondary nozzle submersible in a molten sump and positionable in alignment with the at least one exit nozzle of the plate nozzle, wherein the secondary nozzle includes a restriction shaped to generate a low pressure area within the restriction to circulate a portion of the molten sump through an entry of the secondary nozzle and through the restriction in response to molten metal from the at least one exit nozzle of plate nozzle passing through the restriction.

9. The apparatus of claim 8, wherein the at least one exit nozzle includes two exit nozzles for directing the molten metal in non-parallel directions.

10. The apparatus of claim 9, further comprising an additional secondary nozzle submersible in the molten sump, wherein the additional secondary nozzle is positionable adjacent a second one of the two exit nozzles of the plate nozzle, wherein the additional secondary nozzle includes an additional restriction shaped to generate an additional low pressure area within the additional restriction to circulate an additional portion of the molten sump in response to the molten metal from the second one of the two exit nozzles passing through the additional restriction.

11. The apparatus of claim 8, further comprising a flow control device coupled to the feed tube for controlling the flow of molten metal through the plate nozzle.

12. The apparatus of claim 8, wherein the secondary nozzle is removably couplable to the plate nozzle.

13. A system comprising:

a feed tube couplable to a source of molten metal;

a primary nozzle located at a distal end of the feed tube, wherein the primary nozzle is submersible in a molten sump for delivering the molten metal to the molten sump and wherein the primary nozzle includes an exit opening through which the molten metal passes; and a secondary nozzle submersible in the molten sump and positionable in alignment with the exit opening of the primary nozzle, wherein the secondary nozzle comprises a flow passage that is shaped as a molten flow restriction that generates a low pressure area therein to circulate the molten sump through an entry of the secondary nozzle and through the restriction in response to the molten metal from the exit opening of the primary nozzle passing through the restriction.

14. The system of claim 13, wherein the molten sump is liquid metal of an ingot being cast.

15. The system of claim 13, wherein the molten sump is liquid metal within a furnace.

16. The system of claim 13, wherein the secondary nozzle is coupled to the primary nozzle.

17. The system of claim 13, additionally comprising a flow control device adjacent the feed tube for controlling flow of the molten metal through the primary nozzle.

18. The system of claim 13, wherein the primary nozzle is rectangular in shape.

19. The system of claim 13, wherein the feed tube further includes a second primary nozzle located at the distal end of the feed tube, wherein the second primary nozzle is submersible in the molten sump for delivering the molten metal to the molten sump; and wherein the system further comprises a second secondary nozzle submersible in the molten sump and positionable adjacent the second primary nozzle, wherein the second secondary nozzle includes a second restriction shaped to generate a second low pressure area to circulate the molten sump in response to the molten metal from the source passing through the second restriction.

20. The system of claim 19, additionally comprising a flow control device adjacent the feed tube for controlling flow of the molten metal through the primary nozzle and the second primary nozzle.

* * * * *